US007701419B2

(12) United States Patent
Shoji et al.

(10) Patent No.: US 7,701,419 B2
(45) Date of Patent: Apr. 20, 2010

(54) DISPLAY DEVICE AND DRIVE METHOD THEREOF

(75) Inventors: Hidehiko Shoji, Hirakata (JP); Kazuo Oohira, Settsu (JP); Hironari Taniguchi, Takatsuki (JP)

(73) Assignee: Panasonic Corporation, Osaka (JP)

( * ) Notice: Subject to any disclaimer, the term of this patent is extended or adjusted under 35 U.S.C. 154(b) by 1103 days.

(21) Appl. No.: 10/563,813

(22) PCT Filed: Jun. 23, 2004

(86) PCT No.: PCT/JP2004/009248

§ 371 (c)(1),
(2), (4) Date: Jan. 6, 2006

(87) PCT Pub. No.: WO2005/006288

PCT Pub. Date: Jan. 20, 2005

(65) Prior Publication Data

US 2006/0176246 A1 Aug. 10, 2006

(30) Foreign Application Priority Data

Jul. 11, 2003 (JP) ..... 2003-273800
May 28, 2004 (JP) ..... 2004-160191

(51) Int. Cl.
*G09G 3/28* (2006.01)
*G09G 3/10* (2006.01)

(52) U.S. Cl. ..... 345/72; 345/60; 315/169.3

(58) Field of Classification Search ..... 345/60, 345/72

See application file for complete search history.

(56) References Cited

U.S. PATENT DOCUMENTS 5,517,207 A 5/1996 Kawada et al.
6,400,344 B1 6/2002 Tsunoda et al.
6,529,177 B2 3/2003 Nakamura
6,559,603 B2 5/2003 Iwami (Continued)

FOREIGN PATENT DOCUMENTS

EP 1018722 7/2000

(Continued)

OTHER PUBLICATIONS

English Language Abstract of JP 305319.

(Continued)

*Primary Examiner*—Amr Awad
*Assistant Examiner*—Randal Willis
(74) *Attorney, Agent, or Firm*—Greenblum & Bernstein P.L.C.

(57) ABSTRACT

A first group of data drivers is connected to a sub-field processor, a first power recovery circuit, and a PDP, and a second group of data drivers is connected to a sub-field processor, a second power recovery circuit, and a PDP. The first and second groups of data drivers apply to the PDP data pulses that differ in phases. The first and second power recovery circuits generate a voltage for generating the data pulses to the first and second groups of data drivers due to LC resonance, and discharge and recover charges to and from the PDP. Recovery potentials of recovery capacitors in the first and second power recovery circuits are changed depending on the number of times of switching between discharges and non-discharges of discharge cells in the PDP.

3 Claims, 36 Drawing Sheets

U.S. PATENT DOCUMENTS

| | | | | |
|---|---|---|---|---|
| 6,633,285 | B1 | 10/2003 | Kigo et al. | |
| 6,900,781 | B1 | 5/2005 | Mori et al. | |
| 7,212,194 | B2 * | 5/2007 | Nagaoka | 345/204 |
| 2001/0024179 | A1 * | 9/2001 | Nakamura | 345/60 |
| 2002/0047575 | A1 * | 4/2002 | Iwami | 315/169.3 |
| 2003/0169214 | A1 | 9/2003 | Kigo et al. | |
| 2004/0070577 | A1 | 4/2004 | Kigo et al. | |
| 2004/0125095 | A1 | 7/2004 | Kigo et al. | |
| 2004/0125096 | A1 | 7/2004 | Kigo et al. | |
| 2005/0082957 | A1 * | 4/2005 | Hoppenbrouwers et al. | 313/3 |

FOREIGN PATENT DOCUMENTS

| | | |
|---|---|---|
| EP | 1187088 | 3/2002 |
| JP | 63-070291 | 3/1988 |
| JP | 7-222030 | 8/1995 |
| JP | 8-305319 | 11/1996 |
| JP | 2946921 | 7/1999 |
| JP | 3080064 | 6/2000 |
| JP | 2000-206919 | 7/2000 |
| JP | 2000-242225 | 9/2000 |
| JP | 2001-051648 | 2/2001 |
| JP | 2001-272948 | 10/2001 |
| JP | 2002-156941 | 5/2002 |
| JP | 8-305319 | 4/2006 |
| KR | 2001-13487 | 2/2001 |
| WO | 99/53470 | 10/1999 |

OTHER PUBLICATIONS

English Language Abstract of JP 2002-156941.
English Language Abstract of JP 2001-051648.
English Language Abstract of JP 7-222030.
English Language Abstract of JP 2000-206919.
English Language Abstract of JP 2000-242225.
English Language Abstract of family member JP 11-316572.
English Language Abstract of family member JP 5-249916.
English language Abstract of JP 2001-272948.
European Office Action dated Dec. 9, 2009 that issued with respect to patent family member European Patent Application No. 04746717.0.

* cited by examiner

WRITE VOLTAGE AT WHICH STABLE DISCHARGES CAN BE OBTAINED
(CASE WHERE SUSTAIN VOLTAGE IS TAKEN AS PREDETERMINED VOLTAGE
VALUE Ve, AND Vr=0.8Vd)

WRITE VOLTAGE AT WHICH STABLE DISCHARGES CAN BE OBTAINED
(CASE WHERE SUSTAIN VOLTAGE IS TAKEN AS PREDETERMINED VOLTAGE
VALUE Ve, AND PHASE DIFFERENCE IS TAKEN AS 200ns)

DISPLAY DEVICE AND DRIVE METHOD THEREOF

TECHNICAL FIELD

The present invention relates to a display device that selectively discharges a plurality of discharge cells to display an image and a method of driving the same.

BACKGROUND ART

In fields of display devices that display images, plasma display devices using plasma display panels (hereinafter abbreviated as PDPs) have the advantages that thinning and larger screens are possible. In the plasma display devices, images are displayed utilizing light emission in cases where discharge cells composing pixels are discharged.

The plasma display devices are roughly classified into AC type and DC type plasma display devices depending on driving forms.

FIG. 29 is a block diagram showing the basic configuration of a conventional AC-type plasma display device.

A plasma display device 900 shown in FIG. 29 comprises an analog-to-digital converter (hereinafter referred to as an A/D converter) 910, a video signal/sub-field corresponder 920, a sub-field processor 930, a data driver 940, a scan, river 950, a sustain driver 960, and a PDP 970.

An analog video signal VD is fed to the A/D converter 910. The A/D converter 910 converts the video signal VD into digital image data, and feeds the digital image data into the video signal/sub-field corresponder 920. Since the video signal/sub-field corresponder 920 divides one field into a plurality of sub-fields to perform display, image data SP corresponding to each of the sub-fields is generated from image data corresponding to one field, and is fed to the sub-field processor 930.

The sub-field processor 930 generates a data driver driving control signal DS, a scan driver driving control signal CS, and a sustain driver driving control signal US from the image data SP for each sub-field, and respectively feeds the signals to the data driver 940, the scan driver 950, and the sustain driver 960.

The PDP 970 comprises a plurality of address electrodes (data electrodes) 911, a plurality of scan electrodes 912, and a plurality of sustain electrodes 913. The plurality of address electrodes 911 are arranged in the vertical direction on a screen, and the plurality of scan electrodes 912 and the plurality of sustain electrodes 913 are arranged in the horizontal direction on the screen. The plurality of sustain electrodes 913 are commonly connected to one another.

A discharge cell is formed at each of intersections of the address electrodes 911, the scan electrodes 912, and the sustain electrodes 913. Each of the discharge cells 914 composes a pixel on the screen.

The data driver 940 is connected to the plurality of address electrodes 911 in the PDP 970. The scan driver 950 contains a drive circuit provided for each of the scan electrodes 912, and each of the drive circuits is connected to the corresponding scan electrode 912 in the PDP 970. The sustain driver 960 is connected to the plurality of sustain electrodes 913 in the PDP 970.

The data driver 940 applies a data pulse to the corresponding address electrode 911 in the PDP 970 in response to the image data SP in a write time period in accordance with the data driver driving control signal DS. The scan driver 950 successively applies a write pulse to the plurality of scan electrodes 912 in the PDP 970 while shifting a shift pulse in a vertical scanning direction in the write time period in accordance with the scan driver driving control signal CS. Consequently, address discharges are induced in the corresponding discharge cell 914.

The scan driver 950 applies a periodical sustain pulse to the plurality of scan electrodes 912 in the PDP 970 in a sustain time period in accordance with the scan driver driving control signal CS. On the other hand, the sustain driver 960 simultaneously applies a sustain pulse whose phase is shifted by 180 degrees from the sustain pulse in the scan electrode 912 to the plurality of sustain electrodes 913 in the PDP 970. Consequently, sustain discharges are induced in the corresponding discharge cell 914.

FIG. 30 is a timing chart showing an example of respective driving voltages of the address electrodes, the scan electrodes, and the sustain electrodes in the PDP 7 shown in FIG. 29.

In an initialization time period, an initial setup pulse Pset is simultaneously applied to the plurality of scan electrodes 912. Thereafter, in a write time period, a data pulse Pda that is turned on or off in response to a video signal is applied to each of the address electrodes 911, and a write pulse Pw is successively applied to the plurality of scan electrodes 912 in synchronization with the data pulse Pda. Thus, address discharges are successively induced in the selected discharge cells 914 in the PDP 970.

In a sustain time period, a sustain pulse Psc is periodically applied to the plurality of scan electrodes 912, and a sustain pulse Psu is periodically applied to the plurality of sustain electrodes 913. The phase of the sustain pulse Psu is shifted by 180 degrees from the phase of the sustain pulse Psc. Consequently, sustain discharges are induced subsequently to the address discharges.

In such a plasma display device, an increase in the number of discharge cells 14 (an increase in the number of pixels) with larger screens and higher precision has been significant in recent years. A peak current value of an address discharge current flowing on one of the scan electrodes 912 at the time of address discharges may, in some cases, be increased by the increase in the number of discharge cells 14. When the peak current value of the address discharge current is increased, a large voltage drop is produced in the write pulse Pw applied to the scan electrode 912. As a result, address discharges become unstable. In order to induce stable address discharges, therefore, a voltage SH2 of the write pulse Pw to be applied to the scan electrode 912 must be set to a high voltage.

On the other hand, as a method of reducing the peak current value of the address discharge current, a method of driving a plasma display panel for giving a phase difference to the data pulse Pda to be applied to the address electrode between a plurality of data drivers divided from the data driver 940 shown in FIG. 29 has been proposed (see JP 08-305319 A, for example)

The method of driving the plasma display panel will be described.

FIG. 31 is a schematic view showing an example of the display state of a PDP 970 in a plasma display device composed of a plurality of data drivers obtained by the division, and FIG. 32 is a diagram for explaining dependency of an address discharge current on a data pulse phase difference. The data pulse phase difference will be described later.

In FIG. 31, first and second data drivers 940*a* and 940*b* are connected to the sub-field processor 930 shown in FIG. 29. The PDP 970 has the same configuration as that of the PDP 970 shown in FIG. 29 except that it comprises a plurality of address electrodes 911*a* and 911*b*.

A shift TR between timing at which the first data driver 940*a* applies the data pulse Pda shown in FIG. 30 to the address electrode 911*a* and timing at which the second data driver 940*b* applies the data pulse Pda shown in FIG. 30 to the address electrode 911*b* will be described while referring to FIG. 32.

In the following description, the timings at which the first and second data drivers 940*a* and 940*b* respectively apply the data pulse Pda to the address electrodes 911*a* and 911*b* will be referred to as timing of data pulse application. Further, the shift TR between the timing of data pulse application to the address electrode 911*a* and the timing of data pulse application to the address electrode 911*b* will be referred to as a data pulse phase difference TR.

In FIG. 31, all the discharge cells 914 on a scan electrode 912*f* on the first line from above out of the discharge cells 914 on the PDP 970 are light-emitted.

A case where the discharge cell 914 on the scan electrode 912*f* on the first line from above is light-emitted is assumed. In a case where the data pulse phase difference TR does not exist, as shown in FIG. 32(*a*). The discharge cell 914 on the address electrode 911*a* and the discharge cell 914 on the address electrode 911*b* respectively induce address discharges at the same timing t1. Thus, a discharge current DA2 having one peak is generated in the scan electrode 912*f*.

In this case, respective discharge currents of the discharge cell 914 on the address electrode 911*a* and the discharge cell 914 on the address electrode 911*b* simultaneously flow through the scan electrode 912*f*, so that the amplitude AM2 of the discharge current DA2 increases. Consequently, a large voltage drop E2 is produced in a write pulse Pw applied to the scan electrode 912*f*. As a result, address discharges become unstable, as described above.

On the other hand, in a case where the data pulse phase difference TR exists, as shown in FIG. 32(*b*), the discharge cell 914 on the address electrode 911*a* induces address discharges at the timing t1, and the discharge cell 914 on the address electrode 911*b* induces address discharges at the timing t2. Thus, a discharge current DA1 having two peaks is generated in the scan electrode 912*f*.

In this case, respective discharge currents of the discharge cell 914 on the address electrode 911*a* and the discharge cell 914 on the address electrode 911*b* respectively flow through the scan electrode 912*f* at the different timings t1 and t2, so that the amplitude AM1 of the discharge current DA1 decreases as the data pulse phase difference TR increases. Thus, a voltage drop E1 produced in the write pulse Pw applied to the scan electrode 912*f* also decreases as the data pulse phase difference TR increases. Even in a case where a voltage SH1 of the write pulse Pw to be applied to the scan electrode 912*f* is set to a low voltage, stable discharges can be ensured. In other words, the data pulse phase difference TR is set to a large value, so that a voltage (a driving voltage) of the write pulse Pw can be reduced while ensuring stable discharges of the discharge cell 914.

Meanwhile, in the plasma display device 900 shown in FIG. 29, the plurality of discharge cells 914 in the PDF 970 have the function of a capacitor. The capacitance of the plurality of discharge cells 914 in the PDF 970 is hereinafter referred to as a panel capacitance.

In the above-mentioned write time period, a circuit loss (power loss) in the data driver 940 in a case where the data pulse Pda is applied to each of the address electrodes 911 is proportional to the product of the panel capacitance and the square of the driving voltage applied to each of the address electrodes 911. This relationship is expressed by the following equation:

$$P \propto Cp \times Vp^2 \quad (1)$$

In the foregoing equation (1), P denotes a circuit loss, Cp denotes a panel capacitance, and Vp denotes a driving voltage. In this case, the driving voltage Vp is a voltage of the data pulse Pda.

Consequently, power consumption in the entire plasma display device 900 in the write time period increases as the PDP 970 increases in size (the panel capacitance increases) and the driving voltage is raised. Therefore, a power recovery circuit is developed in order to reduce the power consumption in the plasma display device 900 (reduce the circuit loss).

FIG. 33 is a circuit diagram showing an example of a conventional power recovery circuit. In FIG. 33, a power recovery circuit 980 is connected to a data driver integration circuit contained in the data driver 940 shown in FIG. 29. Further, the data driver integration circuit is connected to the plurality of address electrodes 911 in the PDP 970.

In FIG. 33, the capacitances of a plurality of discharge cells 914 formed of the address electrodes 911 are respectively taken as address electrode capacitances Cp1 to Cpn, and the sum is represented as a panel capacitance Cp.

The power recovery circuit 980 comprises a recovery capacitor C1, a recovery coil L, N-channel field effect transistors (hereinafter abbreviated as transistors) Q1 to Q4, and diodes D1 and D2.

The recovery capacitor C1 is connected between a node N3 and a ground terminal. The transistor Q4 and the diode D2 are connected in series between the node N3 and a node N2, and the diode D1 and the transistor Q3 are connected in series between the node N2 and the node N3.

The recovery coil L is connected between the node N2 and a node N1. The transistor Q1 is connected between the node N1 and a power supply terminal V1, and the transistor Q2 is connected between the node N1 and the ground terminal.

A power supply voltage Vda is applied to the power supply terminal V1. Control signals S1 to S4 are respectively fed to the gates of the transistors Q1 to Q4. The transistors Q1 to Q4 respectively perform an ON/OFF switching operation on the basis of the control signals S1 to S4.

FIG. 34 is a timing chart showing the operations in a write time period of the power recovery circuit 980 shown in FIG. 33. FIG. 34 shows the respective waveforms of a voltage NV1 at the node N1 shown in FIG. 33 and the control signals S1 to S4 respectively applied to the transistors Q1 to Q4. The transistors Q1 to Q4 are turned on when the control signals S1 to S4 are at a high level, while being turned off when the control signals S1 to S4 are at a low level.

In a time period TA, the control signal S3 is at a high level, and the control signals S1, S2, and S4 are at a low level. Consequently, the transistor Q3 is turned on, and the transistors Q1, Q2, and Q4 are turned off. In this case, the recovery capacitor C1 is connected to the recovery coil L through the transistor Q3 and the diode D1, and the voltage NV1 at the node N1 is gently raised due to LC resonance of the recovery coil L and the panel capacitance Cp. At this time, charges in the recovery capacitor C1 are discharged into the panel capacitance Cp through the transistor Q3, the diode D1, and the recovery coil L.

In a time period TB, the control signal S1 is at a high level, and the control signals S2 to S4 are at a low level. Consequently, the transistor Q1 is turned on, and the transistors Q2 to Q4 are turned off. In this case, the voltage NV1 at the node N1 is rapidly raised and is fixed to a power supply voltage Vda.

In a time period TC, the control signal S4 is at a high level, and the control signals S1 to S3 are at a low level. Consequently, the transistor Q4 is turned on, and the transistors Q1 to Q3 are turned off. In this case, the recovery capacitor C1 is connected to the recovery coil L through the diode D2 and the transistor Q4, and the voltage NV1 at the node N1 is gently lowered due to LC resonance of the recovery coil L and the panel capacitance Cp. At this time, charges stored in the panel capacitance Cp are stored in the recovery capacitor C1 through the recovery coil L, the diode D2, and the transistor Q4. Consequently, power is recovered.

In a time period TD, the control signal S2 is at a high level, and the control signals S1, S3, and S4 are at a low level. Consequently, the transistor Q2 is turned on, and the transistors Q1, Q3, and Q4 are turned off. In this case, the node N1 is connected to the ground terminal, and the voltage NV1 at the node N1 is rapidly lowered and is fixed to a ground potential.

Thus, the power recovery circuit 980 causes the charges stored in the panel capacitance Cp to be recovered in the recovery capacitor C1 and causes the recovered charges to be fed to the panel capacitance Cp again. Power based on the charges recovered in the recovery capacitor C1 by the panel capacitance Cp is referred to as recovery power.

Consequently, the above-mentioned circuit loss can be reduced, so that the power consumption in the whole plasma display device 900 can be reduced. In FIG. 34, a voltage change indicated by an arrow RQ corresponds to the recovery power, and a voltage change indicated by an arrow LQ corresponds to the circuit loss.

According to the power recovery circuit 980, however, sufficient power recovery is not necessarily made. The reason for this will be described on the basis of FIGS. 35 and 36.

FIG. 35 is a schematic view showing an example of the display state of the PDP 7, and FIG. 36 is a waveform diagram of the data pulse applied to the address electrodes in order to obtain the display state shown in FIG. 35. In FIG. 35, only a part of the PDP 970 shown in FIG. 29 is illustrated.

FIG. 35(*a*) illustrates an example in which four pixels (discharge cells) provided in each of the address electrodes 911 display "black", "white", "black", and "black" in this order from above. That is, the example is an example in which only the pixel (discharge cell) on the second line from above in the PDF 970 induces address discharges.

When the power recovery circuit 980 shown in FIG. 33 is not used, the data pulse Pda is generated by power supplied from a power supply. An example of the waveform of the data pulse Pda in this case is illustrated in FIG. 36(*a*). In FIG. 36(*a*), a voltage change indicated by an arrow LQ corresponds to a circuit loss.

When the power recovery circuit 980 is used, the data pulse Pda is generated by power supplied from the power supply and power recovered from the above-mentioned panel capacitance Cp. An example of the waveform of the data pulse Pda in this case is illustrated in FIG. 36(*b*). In FIG. 36(*b*), a voltage change indicated by an arrow LQ corresponds to a circuit loss, and a voltage change indicated by an arrow RQ corresponds to recovery power.

According to FIGS. 36(*a*) and 36(*b*), the power recovery circuit 980 is used, so that the circuit loss in the data driver 940 in a case where the data pulse Pda is generated is reduced by the recovery power from the panel capacitance Cp.

On the other hand, FIG. 35(*b*) illustrates an example in which four pixels provided in each of the address electrodes 911 display "white", "white", "white", and "white" in this order from above. That is, the example is an example in which all the pixels on the PDP 970 induce address discharges. In this case, a plurality of data pulses Pda are continuously applied to each of the address electrodes 911.

Here, a case where the continuous data pulses Pda are applied as one set of data pulses SPd to each of the address electrodes 911 without using the power recovery circuit 980 is assumed.

An example of the waveforms of the data pulses Pda and SPa is illustrated in FIG. 36(*c*). In FIG. 36(*c*), an arrow LQ corresponds to a circuit loss. In this case, the circuit loss in the data driver 940 occurs when the data pulse SPda rises, while the circuit loss in the data driver 940 does not occur between the data pulses Pda.

A case where the continuous data pulses Pda are applied onto each of the address electrodes 911 using the power recovery circuit 980 is then assumed.

An example of the waveforms of the continuous data pulses Pda in this case is illustrated in FIG. 36(*d*). In FIG. 36(*d*), a voltage change indicated by an arrow LQ corresponds to a circuit loss, and a voltage change indicated by an arrow RQ corresponds to recovery power. When the power recovery circuit 980 is used, each of the continuous data pulses Pda is generated by power recovered from the panel capacitance Cp and power supplied from the power supply. Consequently, a circuit loss in the data driver 940 occurs every time each of the data pulses Pda rises.

The respective waveforms of the data pulses Pda shown in FIGS. 36(*c*) and 36(*d*) are compared with each other. In FIG. 36(*c*), a large circuit loss occurs one at a time when the data pulse SPda rises. On the other hand, in FIG. 36(*d*), a small circuit loss occurs one at a time when each of the data pulses Pda rises. When the number of data pulses Pda continuously generated is further increased, therefore, the circuit loss cannot be sufficiently reduced even if power is recovered by the power recovery circuit 980. In the conventional power recovery circuit 980, therefore, the circuit loss cannot, in some cases, be reduced.

JP 2002-156941 A discloses a driving method for reducing, when all pixels in the PDP 970 as shown in FIG. 35(*b*) induce address discharges, that is, a plurality of data pulses Pda are continuously applied to each of the address electrodes 911, a circuit loss by reducing the pulse amplitude of the data pulses Pda. However, further stabilization of address discharges and reduction of power consumption are required.

DISCLOSURE OF INVENTION

An object of the present invention is to provide a display device capable of inducing stable discharges while sufficiently reducing power consumption and a method of driving the same.

A display device according to an aspect of the present invention comprises first electrodes classified into a plurality of groups; second electrodes respectively provided so as to cross the first electrodes; a display panel comprising a plurality of capacitive light emitting elements respectively provided at intersections of the first electrodes and the second electrodes; and a drive circuit that applies a data pulse for light-emitting the selected capacitive light emitting element to the first electrodes in the plurality of groups such that phase differences respectively occur between the plurality of groups, the drive circuit comprising a recovering capacitive element, an application circuit that discharges charges to the first electrodes from the recovering capacitive element or recovers the charges from the first electrodes in the recovering capacitive element, to apply a driving pulse for applying the data pulse to the first electrodes, and a potential limiting circuit that limits the quantity of the charges recovered in the recovering capacitive element, to limit a potential of the recovering capacitive element so as not to exceed a predetermined value.

In the display device, the first electrodes in the display panel are classified into the plurality of groups. In an address time period during which the selected capacitive light emitting element in the display panel is to be light-emitted, the data pulse for light-emitting the selected capacitive light emitting element is applied to the first electrodes in the plurality of groups by the drive circuit.

In the application circuit, the charges are discharged into the first electrodes from the recovering capacitive element or are recovered in the recovering capacitive element from the first electrodes, so that the power consumption at the time of generating the driving pulse is reduced in the address time period.

The application circuit is operated such that a voltage generated in the recovering capacitive element varies depending on the number of times of switching between luminescence and non-luminescence of the plurality of capacitive light emitting elements in the display panel within a predetermined time period. In this case, the potential of the recovering capacitive element is limited so as not to exceed the predetermined value lower than the first power supply voltage by the potential limiting circuit, so that the waveforms of the continuous driving pulses are separated from one another.

Thus, the data pulse can be applied to the first electrodes in the plurality of groups from the drive circuit such that the phase differences respectively occur between the plurality of groups. In this case, the timings at which the capacitive light emitting elements respectively provided in the first electrodes in the plurality of groups are light-emitted differ for the plurality of groups. Consequently, a light-emitting current flowing in the second electrode is separated into a plurality of peaks, so that the value of the peak is reduced. As a result, a voltage drop produced by the light-emitting current is reduced in a driving voltage applied between the first electrode and the second electrode. Consequently, the capacitive light emitting element can be stably light-emitted at a low driving voltage.

As a result of these, the power consumption can be reduced without degrading a driving margin of the display panel.

Here, the driving margin means a range of a driving voltage allowed in order to obtain stable light emission of the capacitive light emitting element.

A display device according to another aspect of the present invention comprises first electrodes classified into a plurality of groups; second electrodes respectively provided so as to cross the first electrodes; a display panel comprising a plurality of capacitive light emitting elements respectively provided at intersections of the first electrodes and the second electrodes; and a drive circuit that applies a data pulse for light-emitting the selected capacitive light emitting element to the first electrodes in the plurality of groups such that phase differences respectively occur between the plurality of groups, the drive circuit comprising an inductive element, a recovering capacitive element, an application circuit that discharges charges to the first electrodes from the recovering capacitive element by a resonance operation of a capacitance of the display panel and the inductive element or recovers the charges in the recovering capacitive element from the first electrodes through the inductive element, to apply to the first node a driving pulse for applying the data pulse to the first electrodes in the plurality of groups, and a potential limiting circuit that limits the quantity of the charges recovered in the recovering capacitive element, to limit a potential of the recovering capacitive element so as not to exceed a predetermined value.

In the display device, the first electrodes in the display panel are classified into the plurality of groups. In an address time period during which the selected capacitive light emitting element in the display panel is to be light-emitted, the data pulse for light-emitting the selected capacitive light emitting element is applied to the first electrodes in the plurality of groups by the drive circuit.

In the application circuit, the charges are discharged into the first electrodes from the recovering capacitive element or are recovered in the recovering capacitive element from the first electrodes through the inductive element, so that the power consumption at the time of generating the driving pulse is reduced in the address time period.

The application circuit is operated such that a voltage generated in the recovering capacitive element varies depending on the number of times of switching between luminescence and non-luminescence of the plurality of capacitive light emitting elements in the display panel within a predetermined time period. In this case, the potential of the recovering capacitive element is limited so as not to exceed the predetermined value lower than the first power supply voltage by the potential limiting circuit, so that the waveforms of the continuous driving pulses are separated from one another.

Thus, the data pulse can be applied to the first electrodes in the plurality of groups from the drive circuit such that the phase differences respectively occur between the plurality of groups. In this case, the timings at which the capacitive light emitting elements respectively provided in the first electrodes in the plurality of groups are light-emitted differ for the plurality of groups. Consequently, a light-emitting current flowing in the second electrode is separated into a plurality of peaks, so that the value of the peak is reduced. As a result, a voltage drop produced by the light-emitting current is reduced in a driving voltage applied between the first electrode and the second electrode. Consequently, the capacitive light emitting element can be stably light-emitted at a low driving voltage.

As a result of these, the power consumption can be reduced without degrading a driving margin of the display panel.

Here, the driving margin means a range of a driving voltage allowed in order to obtain stable light emission of the capacitive light emitting element.

A display device according to still another aspect of the present invention comprises first electrodes classified into a plurality of groups; second electrodes respectively provided so as to cross the first electrodes; a display panel comprising a plurality of capacitive light emitting elements respectively provided at intersections of the first electrodes and the second electrodes; and a drive circuit that applies a data pulse for light-emitting the selected capacitive light emitting element to the first electrodes in the plurality of groups such that phase differences respectively occur between the plurality of groups, the drive circuit comprising a first power supply terminal receiving a first power supply voltage, an inductive element, a recovering capacitive element, an application circuit that discharges charges from the recovering capacitive element by a resonance operation of a capacitance of the display panel and the inductive element to raise a potential at a first node, connects the first node and the first power supply terminal to each other, then disconnects the first node and the first power supply terminal from each other, and recovers the charges in the recovering capacitive element from the first node through the inductive element by the resonance operation to lower the potential at the first node, to apply to the first node a driving pulse for applying the data pulse to the first electrodes in the plurality of groups, and a potential limiting circuit that limits the quantity of the charges recovered in the recovering capacitive element, to limit a potential of the recovering capacitive element so as not to exceed a predetermined value lower than the first power supply voltage.

In the display device, the first electrodes in the display panel are classified into the plurality of groups. In an address time period during which the selected capacitive light emitting element in the display panel is to be light-emitted, the data pulse for light-emitting the selected capacitive light emitting element is applied to the first electrodes in the plurality of groups by the drive circuit.

In the application circuit, the charges are discharged from the recovering capacitive element by the resonance operation of the capacitance of the display panel and the inductive element in the address time period so that the potential at the first node is raised. The first node and the first power supply terminal are connected to each other, so that the potential at the first node is raised to the first power supply voltage. Thereafter, the first node and the first power supply terminal are disconnected from each other, and the charges are recovered in the recovering capacitive element from the first node through the inductive element by the resonance operation so that the potential at the first node is lowered. Consequently, the driving pulse for applying the data pulse to the first electrodes in the plurality of groups is applied to the first node.

The charges are thus discharged into the first node from the recovering capacitive element by the resonance operation of the capacitance of the display panel and the inductive element, and the charges are recovered in the recovering capacitive element from the first node by the resonance operation of the capacitance of the display panel and the inductive element, so that the power consumption at the time of generating the driving pulse is reduced.

The application circuit is operated such that a voltage generated in the recovering capacitive element varies depending on the number of times of switching between luminescence and non-luminescence of the plurality of capacitive light emitting elements in the display panel within a predetermined time period. In this case, the potential of the recovering capacitive element is limited so as not to exceed the predetermined value lower than the first power supply voltage by the potential limiting circuit, so that the waveforms of the continuous driving pulses are separated from one another.

Thus, the data pulse can be applied to the first electrodes in the plurality of groups from the drive circuit such that phase differences respectively occur between the plurality of groups. In this case, the timings at which the capacitive light emitting elements respectively provided in the first electrodes in the plurality of groups are light-emitted differ for the plurality of groups. Consequently, a light-emitting current flowing in the second electrode is separated into a plurality of peaks, so that the value of the peak is reduced. As a result, a voltage drop produced by the light-emitting current is reduced in a driving voltage applied between the first electrode and the second electrode. Consequently, the capacitive light emitting element can be stably light-emitted at a low driving voltage.

As a result of these, the power consumption can be reduced without degrading a driving margin of the display panel.

Here, the driving margin means a range of a driving voltage allowed in order to obtain stable light emission of the capacitive light emitting element.

The inductive element may be provided between the first node and a second node, the recovering capacitive element may be connected to a third node, the potential limiting circuit may limit a potential at the third node, to limit the potential of the recovering capacitive element so as not to exceed the predetermined value, and the application circuit may comprise a first switching element provided between the first power supply terminal and the first node, a second switching element provided between a ground terminal receiving a ground potential and the first node, a third switching element provided between the second node and the third node, and a fourth switching element provided between the second node and the third node. In an address time period during which the selected capacitive light emitting element in the display panel is to be light-emitted, the third switching element may be turned on so that charges are discharged into the first node from the recovering capacitive element through the inductive element, the potential at the first node may be raised, the third switching element may be turned off and the first switching element may be turned on so that the potential at the first node is raised to the first power supply voltage, and the first switching element may be turned off and the fourth switching element may be turned on so that charges are recovered in the recovering capacitive element from the first node through the inductive element so that the potential at the first node is lowered, thereby generating the driving pulse.

In this case, in the application circuit, the third switching element is turned on in the address time period so that the resonance operation of the capacitance of the display panel and the inductive element is performed. Therefore, the charges are discharged into the first node from the recovering capacitive element through the inductive element. The third switching element is turned off and the first switching element is turned on, so that the potential at the first node is raised to the first power supply voltage. Thereafter, the first switching element is turned off and the fourth switching element is turned on so that the resonance operation of the capacitance of the display panel and the inductive element is performed. Therefore, the charges are recovered in the recovering capacitive element from the first node through the inductive element. As a result, the driving pulse is generated.

In the application circuit, the resonance operation of the capacitance of the display panel and the inductive element is performed by switching ON and OFF of each of the first switching element, the third switching element, and the fourth switching element, so that the generation of the driving pulse can be easily controlled by switching of each of the switches.

A potential at the third node connected to the recovering capacitive element is limited so as not to exceed a predetermined value lower than the first power supply voltage by the potential limiting circuit. Consequently, the waveforms of the continuous driving pulse can be separated from one another.

The drive circuit may further comprise first switching circuits respectively provided in correspondence with the first electrodes, and may be operated such that the first switching circuit is turned on so that the charges are recovered and discharged between the first node and the first electrode, and the first switching circuit may be turned off so that the corresponding first electrode is set to the ground potential.

Consequently, the switching between luminescence and non-luminescence of the plurality of capacitive light emitting elements in the display panel can be controlled by switching ON and OFF of each of the first switching circuits.

The smaller the total number of times of switching between On and OFF of each of the first switching circuits is, the higher the voltage generated in the recovering capacitive element becomes, and a voltage generated in the recovering capacitive element is limited so as not to exceed a predetermined value by the potential limiting circuit.

The potential limiting circuit may comprise a division circuit that divides a voltage between the first power supply voltage and the ground potential to produce a potential approximately equal to the predetermined value, and a second switching circuit connected between the third node and the ground terminal and receiving the potential produced by the division circuit as a control signal, and turned on when the potential at the third node exceeds the predetermined value.

In this case, the voltage between the first power supply voltage and the ground potential is divided by the division circuit, so that a potential approximately equal to the predetermined value is produced. Further, the second switching circuit connected between the third node and the ground terminal receives the potential produced by the division circuit as a control signal, and is turned on when the potential at the third node exceeds the predetermined value so that a current flows from the third node to the ground terminal. Consequently, the potential at the third node does not exceed the predetermined value, and a potential produced at one end of the recovering capacitive element does not exceed the predetermined value.

The potential limiting circuit may comprise a second power supply terminal receiving a second power supply voltage approximately equal to the predetermined value, and a second switching circuit connected between the third node and the ground terminal and receiving the second power supply voltage received by the second power supply terminal as a control signal, and turned on when the potential at the third node exceeds the predetermined value.

In this case, the second power supply voltage approximately equal to the predetermined value is fed to the second power supply terminal. Further, the second switching circuit connected between the third node and the ground terminal receives the second power supply voltage as a control signal, and is turned on when the potential at the third node exceeds the predetermined value so that a current flows from the third node to the ground terminal. Consequently, the potential at the third node does not exceed the predetermined value, and a voltage generated at one end of the recovering capacitive element does not exceed the predetermined value.

The second switching circuit may comprise a unidirectional conductive element provided between the third node and a fourth node and causing a current to flow from the third node to the fourth node, and a fifth switching element provided between the fourth node and the ground terminal, and having a control terminal receiving the control signal.

In this case, when the potential at the third node exceeds the predetermined value, the fifth switching element is turned on, so that a current flows from the third node to the ground terminal through the unidirectional conductive element and the fifth switching element. Consequently, the potential at the third node does not exceed the predetermined value, and a voltage generated at one end of the recovering capacitive element does not exceed the predetermined value.

The potential limiting circuit may comprise a unidirectional conductive element provided between the third node and the ground terminal and causing a current to flow from the third node to the ground terminal when the potential at the third node exceeds the predetermined value.

In this case, the current flows from the third node to the ground terminal when the potential at the third node exceeds the predetermined value by the unidirectional conductive element provided between the third node and the ground terminal. Consequently, the potential at the third node does not exceed the predetermined value, and a voltage generated at one end of the recovering capacitive element does not exceed the predetermined value. Therefore, the configuration becomes easy.

The unidirectional conductive element may be a zener diode. Consequently, the configuration becomes easy.

The display device may further comprise a charge pump circuit that produces a potential higher than the potential at the first node in order to turn the first switching element on. In this case, a potential higher than the potential at the first node is produced by the charge pump circuit, so that the first switching element is turned on.

The charge pump circuit may comprise a charging capacitive element provided between the first node and a fifth node, a unidirectional conductive element provided between a third power supply terminal receiving a third power supply voltage and the fifth node and causing a current to flow from the second power supply terminal to the fifth node, and a control signal output circuit that adds a potential at the fifth node to the potential at the first node, and outputting a potential obtained by the addition to the first switching element as a control signal.

In this case, the current flows from the second power supply terminal to the fifth node by the unidirectional conductive element, the potential at the fifth node is added to the potential at the first node by the control signal output circuit, and the potential obtained by the addition is outputted as the control signal to the first switching element.

The predetermined value may be more than one-second the first power supply voltage and may be not more than four-fifth the first power supply voltage. This allows stable light emission of the capacitive light emitting element to be ensured. Further, a sufficient driving margin can be obtained.

The phase difference may be not less than 200 ns. This allows stable light emission of the capacitive light emitting element to be ensured. Further, a sufficient driving margin can be obtained.

The display device may further comprise a plurality of drive circuits, the plurality of drive circuits may be respectively provided in correspondence with the plurality of groups, and the plurality of drive circuits may respectively apply the data pulses for light-emitting the selected capacitive light emitting element to the first electrodes in the plurality of groups such that phase differences respectively occur between the plurality of groups.

In this case, the data pulse for light-emitting the selected capacitive light emitting element is applied to the first electrodes in the plurality of groups such that phase differences respectively occur between the plurality of groups by the plurality of drive circuits respectively provided in correspondence with the plurality of groups. Thus, the timings at which the capacitive light emitting elements respectively provided in the first electrodes in the plurality of groups are light-emitted differ for the plurality of groups. Consequently, a light-emitting current flowing in the second electrode is separated into a plurality of peaks, so that the value of the peak is reduced. As a result, a voltage drop produced by the light-emitting current is reduced in a driving voltage applied between the first electrode and the second electrode. Consequently, the light emitting element can be stably light-emitted at a low driving voltage.

The display device may further comprise a number-of-times detector for detecting the number of times of rise or the number of times of fall of the data pulse applied to the first electrodes, and the drive circuit may further comprise a controller for calculating the ratio of the number of times detected by the number-of-times detector to the maximum number of times the data pulse can rise or the number of times the data pulse can fall, lowering, when the ratio is more than a predetermined ratio value, the potential at the first node to a predetermined voltage value, and then controlling the operation of the application circuit such that the first node is grounded.

In this case, the number of times of rise or the number of times of fall of the data pulse applied to the first electrodes classified into the plurality of groups are detected by the number-of-times detector. The ratio of the number of times detected by the number-of-times detector to the maximum number of times the data pulse can rise or the maximum number of times the data pulse can fall is calculated by the controller, and the calculated ratio and the predetermined ratio value are compared with each other.

Furthermore, when the calculated ratio is more than the predetermined ratio value, the potential at the first node is lowered to the predetermined voltage value, and the operation of the application circuit is then controlled such that the first node is grounded.

Here, in the application circuit, the power consumption varies depending on the ratio of the number of times detected by the number-of-times detector to the maximum number of times the data pulse can rise or the maximum number of times the data pulse can fall. That is, when the calculated ratio is more than the predetermined ratio value, the first node is grounded, so that the power consumption can be always reduced in the most suitable state irrespective of the state where the plurality of capacitive light emitting elements in the display panel are light-emitted.

The display device may further comprise a converter for converting, in order to divide one field into a plurality of sub-fields and discharge the capacitive light emitting element selected for each of the sub-fields to perform gray scale expression, image data corresponding to the one field into image data corresponding to the sub-field, the number-of-times detector may detect the number of times for each of the sub-fields on the basis of the image data fed from the converter, and the controller may calculate the ratio of the number of times obtained by the number-of-times detector to the maximum number of times the data pulse in each of the sub-fields can rise or the maximum number of times the data pulse can fall, lowering, when the ratio is more than the predetermined ratio value, the potential at the first node to the predetermined voltage value, and then controlling the operation of the application circuit such that the first node is grounded.

In this case, the image data corresponding to the one field is converted into the image data corresponding to the plurality of sub-fields by the converter. Consequently, gray scale expression can be performed by dividing the one field into the plurality of sub-fields and discharging the capacitive light emitting element selected for each of the sub-fields.

In each of the plurality of sub-fields, the number of times of rise or the number of times of fall of the data pulse applied to the first electrodes classified into the plurality of groups are detected by the number-of-times detector. The ratio of the number of times detected by the number-of-times detector to the maximum number of times the data pulse can rise or the maximum number of times the data pulse can fall in each of the sub-fields is calculated by the controller, and the calculated ratio and the predetermined ratio value are compared with each other.

Furthermore, when the calculated ratio is more than the predetermined ratio value, the potential at the first node is lowered to the predetermined voltage value, and the operation of the application circuit is then controlled such that the first node is grounded. Consequently, the power consumption can be always reduced in the most suitable state irrespective of the state where the plurality of capacitive light emitting elements in the display panel are light-emitted.

The predetermined ratio value may be not less than 95%. Consequently, the power consumption can be always reduced in the most suitable state irrespective of the state where the plurality of capacitive light emitting elements in the display panel are light-emitted.

A method of driving a display device according to still another aspect of the present invention is a method of driving a display device comprising first electrodes classified into a plurality of groups, second electrodes respectively provided so as to cross the first electrodes, and a display panel comprising a plurality of capacitive light emitting elements respectively provided at intersections of the first electrodes and the second electrodes, comprising the step of respectively applying a data pulse for light-emitting the selected capacitive light emitting element to the first electrodes in the plurality of groups such that phase differences respectively occur between the plurality of groups, the step of applying the data pulse comprising the steps of discharging charges from a recovering capacitive element by a resonance operation of a capacitance of the display panel and an inductive element to raise a potential at a first node, connecting the first node and a first power supply terminal to each other, then disconnecting the first node and the first power supply terminal from each other, and recovering the charges in the recovering capacitive element from the first node through the inductive element by the resonance operation to lower the potential at the first node, to apply to the first node a driving pulse for applying the data pulse to the first electrodes in the plurality of groups, and limiting the quantity of the charges recovered in the recovering capacitive element, to limit a potential of the recovering capacitive element so as not to exceed a predetermined value lower than the first power supply voltage.

In the method of driving the display device, in an address time period during which the selected capacitive light emitting element in the display panel is to be light-emitted, the data pulse for light-emitting the selected capacitive light emitting element is applied to the first electrodes in the plurality of groups.

When the data pulse is applied to the first electrodes in the plurality of groups, the charges are discharged from the recovering capacitive element by the resonance operation of the capacitance of the display panel and the inductive element in the address time period so that the potential at the first node is raised. The first node and the first power supply terminal are connected to each other, so that the potential at the first node is raised to the first power supply voltage. Thereafter, the first node and the first power supply terminal are disconnected from each other, and the charges are recovered in the recovering capacitive element from the first node through the inductive element by the resonance operation so that the potential at the first node is lowered. Consequently, the driving pulse for applying the data pulse to the first electrodes in the plurality of groups is applied to the first node.

The charges are thus discharged into the first node from the recovering capacitive element by the resonance operation of the capacitance of the display panel and the inductive element, and the charges are recovered in the recovering capacitive element from the first node by the resonance operation of the capacitance of the display panel and the inductive element, so that the power consumption at the time of generating the driving pulse is reduced.

The voltage generated in the recovering capacitive element is varied depending on the number of times of switching between luminescence and non-luminescence of the plurality of capacitive light emitting elements in the display panel within a predetermined time period, and the potential of the recovering capacitive element is limited so as not to exceed the predetermined value lower than the first power supply voltage so that the respective waveforms of the continuous driving pulses are separated from one another.

The data pulse is applied to the first electrodes in the plurality of groups such that the phase differences respectively occur between the plurality of groups, so that the timings at which the capacitive light emitting elements respectively provided in the first electrodes in the plurality of groups are light-emitted differ for the plurality of groups. Consequently, a light-emitting current flowing in the second electrode is separated into a plurality of peaks, so that the value of the peak is reduced. As a result, a voltage drop produced by the light-emitting current is reduced in a driving voltage applied between the first electrode and the second electrode. Consequently, the capacitive light emitting elements can be stably light-emitted at a low driving voltage.

As a result of these, the power consumption can be reduced without degrading a driving margin of the display panel.

Here, the driving margin means a range of a driving voltage allowed in order to obtain stable light emission of the capacitive light emitting elements.

The method of driving the display device may further comprise the steps of detecting the number of times of rise or the number of times of fall of the data pulse applied to the first electrodes, and calculating the ratio of the detected number of times to the maximum number of times the data pulse can rise or the number of times the data pulse can fall, lowering, when the ratio is more than a predetermined ratio value, the potential at the first node to a predetermined voltage value, and then controlling the operation of the application circuit such that the first node is grounded.

In this case, the number of times of rise or the number of times of fall of the data pulse applied to the first electrodes classified into the plurality of groups are detected. The ratio of the number of times detected by the number-of-times detector to the maximum number of times the data pulse can rise or the maximum number of times the data pulse can fall is calculated, and the calculated ratio and the predetermined ratio value are compared with each other.

Furthermore, when the calculated ratio is more than the predetermined ratio value, the potential at the first node is lowered to the predetermined voltage value, and the operation of the application circuit is then controlled such that the first node is grounded.

Here, in the display device, the power consumption varies depending on the ratio of the number of times detected by the number-of-times detector to the maximum number of times the data pulse can rise or the maximum number of times the data pulse can fall. That is, when the calculated ratio is more than the predetermined ratio value, the first node is grounded, so that the power consumption can be always reduced in the most suitable state irrespective of the state where the plurality of capacitive light emitting elements in the display panel are light-emitted.

The predetermined ratio value may be not less than 95%. Consequently, the power consumption can be always reduced in the most suitable state irrespective of the state where the plurality of capacitive light emitting elements in the display panel are light-emitted.

The predetermined value may be more than one-second the first power supply voltage and may be not more than four-fifth the first power supply voltage. This allows stable light emission of the capacitive light emitting elements to be ensured. Further, a sufficient driving margin can be obtained.

BEST MODE FOR CARRYING OUT THE INVENTION

A plasma display device and a method of driving the same will be described on the basis of FIGS. 1 to 28 as an example of a display device and a method of driving the same according to the present invention.

First Embodiment

Figure 1:
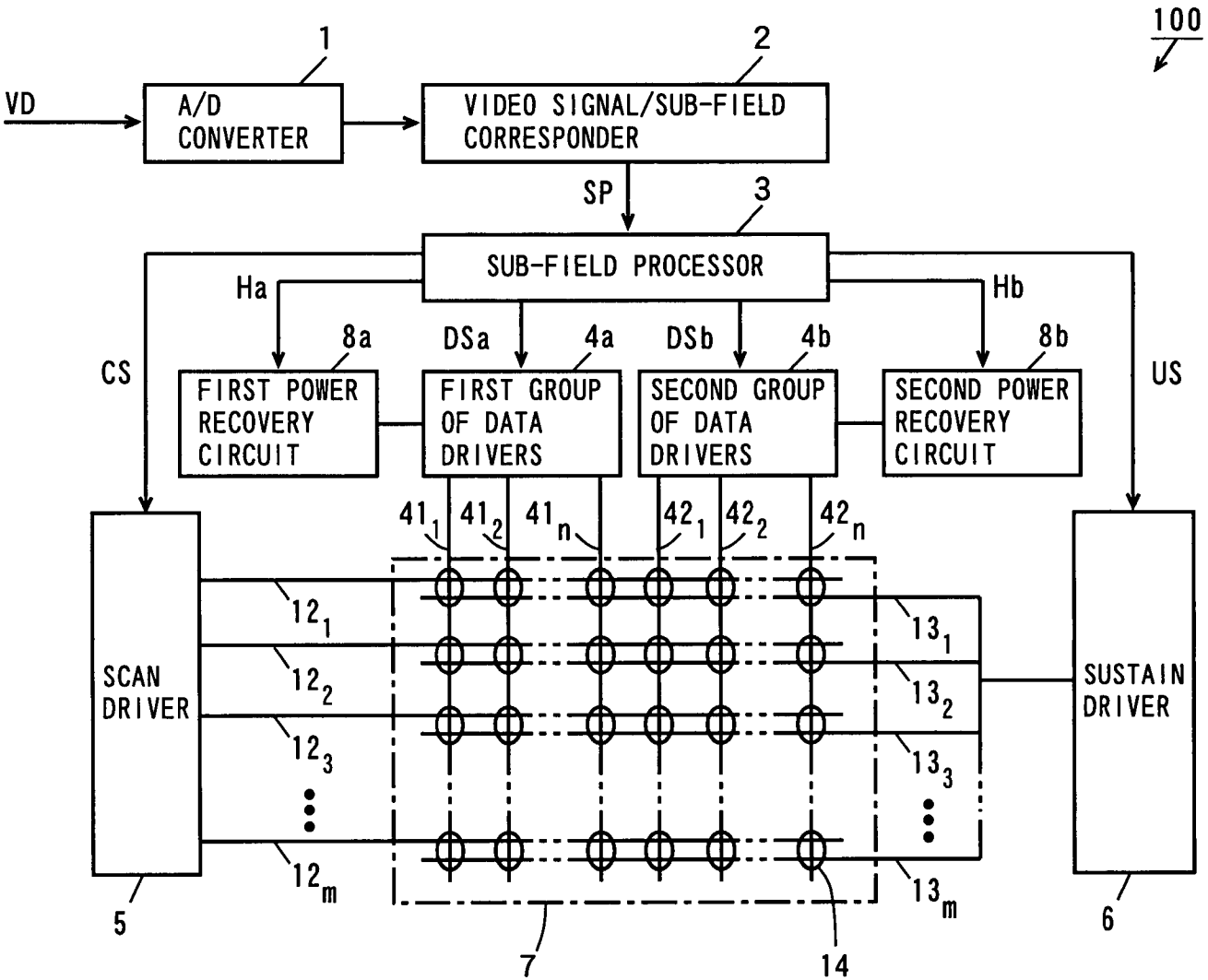
FIG. 1 is a block diagram showing the basic configuration of a plasma display device according to a first embodiment.

FIG. 1 is a block diagram showing the basic configuration of a plasma display device according to a first embodiment.

A plasma display device 100 shown in FIG. 1 comprises an analog-to-digital converter (hereinafter referred to as an A/D converter) 1, a video signal/sub-field corresponder 2, a sub-field processor 3, a first group of data drivers 4*a*, a second group of data drivers 4*b*, a scan driver 5, a sustain driver 6, a plasma display panel (hereinafter abbreviated as PDP) 7, a first power recovery circuit 8*a*, and a second power recovery circuit 8*b*.

A analog video signal VD is fed to the A/D converter 1. The A/D converter 1 converts the video signal VD into digital image data, and feeds the digital image data to the video signal/sub-field corresponder 2.

Since the video signal/sub-field corresponder 2 divides one field into a plurality of sub-fields to perform display, it generates image data SP corresponding to each of the sub-fields from image data corresponding to one field, and feeds the generated image data to the sub-field processor 3. In the plasma display device 100 according to the present embodiment, an address-display period separation system (hereinafter abbreviated as an ADS system) is used as a gray scale expression driving system. The details of the ADS system will be described later.

The sub-field processor 3 generates data driver control signals DSa and DSb, power recovery circuit control signals Ha and Hb, a scan driver control signal CS, and a sustain driver control signal US from the image data SP corresponding to the sub-field.

The data driver control signals DSa and DS are respectively fed to the first group of data drivers 4*a* and the second group of data drivers 4*b*. The power recovery circuit control signals Ha and Hb are respectively fed to the first power recovery circuit 8*a* and the second power recovery circuit 8*b*. The scan driver control signal CS is fed to the scan driver 5, and the sustain driver control signal US is fed to the sustain driver 6.

Each of the first group of data drivers 4*a* and the second group of data drivers 4*b* comprises a plurality of data driver integration circuits and a plurality of modules (not shown). The first group of data drivers 4*a* is connected to the sub-field processor 3, the first power recovery circuit 8*a*, and the PDP 7, and the second group of data drivers 4*b* is connected to the sub-field processor 3, the second power recovery circuit 8*b*, and the PDP 7. Each of the scan driver 5 and the sustain driver 6 is connected to the PDP 7.

The PDP 7 comprises a plurality of address electrodes (data electrodes) $\mathbf{41}_1$ to $\mathbf{41}_n$ and $\mathbf{42}_1$ to $\mathbf{42}_n$, a plurality of scan electrodes $\mathbf{12}_1$ to $\mathbf{12}_m$, and a plurality of sustain electrodes $\mathbf{13}_1$ to $\mathbf{13}_m$. m and n respectively denote arbitrary integers. The plurality of address electrodes $\mathbf{41}_1$ to $\mathbf{41}_n$ and $\mathbf{42}_1$ to $\mathbf{42}_n$ are arranged in the vertical direction on a screen, and the plurality of scan electrodes $\mathbf{12}_1$ to $\mathbf{12}_m$ and the plurality of sustain electrodes $\mathbf{13}_1$ to $\mathbf{13}_m$ are arranged in the horizontal direction on the screen. The plurality of sustain electrodes $\mathbf{13}_1$ to $\mathbf{13}_m$ are commonly connected to one another. In FIG. 1, the address electrodes $\mathbf{41}_1$ to $\mathbf{41}_n$ are arranged at the left on the screen, and the address electrodes $\mathbf{42}_1$ to $\mathbf{42}_n$ are arranged at the right on the screen.

A discharge cell 14 is formed at each of intersections of the address electrodes $\mathbf{41}_1$ to $\mathbf{41}_n$ and $\mathbf{42}_1$ to $\mathbf{42}_n$, the scan electrodes $\mathbf{12}_1$ to $\mathbf{12}_m$, and the sustain electrodes $\mathbf{13}_1$ to $\mathbf{13}_m$. Each of the discharge cells 14 composes a pixel on the screen. In FIG. 1, the discharge cells 14 on the screen are arranged so as to constitute a matrix with m rows and 2n columns.

The plurality of address electrodes $\mathbf{41}_1$ to $\mathbf{41}_n$ are connected to the first group of data drivers 4*a*, and the plurality of address electrodes $\mathbf{42}_1$ to $\mathbf{42}_n$ are connected to the second group of data drivers 4*b*. The plurality of scan electrodes $\mathbf{12}_1$ to $\mathbf{12}_m$ are connected to the scan driver 5, and the plurality of sustain electrodes $\mathbf{13}_1$ to $\mathbf{13}_m$ are connected to the sustain driver 6.

Here, the scan driver 5 comprises drive circuits respectively provided for the scan electrodes $\mathbf{12}_1$ to $\mathbf{12}_m$, and the drive circuits are respectively connected to the corresponding scan electrodes $\mathbf{12}_1$ to $\mathbf{12}_m$ in the PDP 7.

The first group of data drivers 4*a* applies a data pulse to the corresponding address electrodes $\mathbf{41}_1$ to $\mathbf{41}_n$ in the PDP 7 in response to the image data SP in a write time period in accordance with the data driver driving control signal DSa. An output of the first power recovery circuit 8*a* is supplied to power supply terminals of the plurality of data driver integration circuits in the first group of data drivers 4*a* in order to generate the data pulse. The first power recovery circuit 8*a* operates in accordance of the power recovery circuit control signal Ha. The details of the respective operations of the first group of data drivers 4*a* and the first power recovery circuit 8*a* in the write time period will be described later.

The second group of data drivers 4*b* applies a data pulse to any of the corresponding address electrodes $\mathbf{42}_1$ to $\mathbf{41}_n$ in the PDP 7 in response to the image data SP in the write time period in accordance with the data driver driving control signal DSb. An output of the second power recovery circuit 8*b* is supplied to power supply terminals of the plurality of data driver integration circuits in the second group of data drivers 4*b* in order to generate the data pulse. The second power recovery circuit 8*b* operates in accordance of the power recovery circuit control signal Hb. The details of the respective operations of the second group of data drivers 4*b* and the second power recovery circuit 8*b* in the write time period are the same as the details of the respective operations of the first group of data drivers 4*a* and the first power recovery circuit 8*a*, described later.

The scan driver 5 simultaneously applies an initial setup pulse to all the scan electrodes $\mathbf{12}_1$ to $\mathbf{12}_m$ in the PDP 7 in an initialization time period in accordance with the scan driver control signal CS. Thereafter, it successively applies a write pulse to the plurality of scan electrodes 12, to $\mathbf{12}_m$ in the PDP 7 while shifting a shift pulse in a vertical scanning direction in the write time period. Consequently, address discharges are induced in the selected discharge cell 14.

The scan driver 5 applies a periodical sustain pulse to the plurality of scan electrodes $\mathbf{12}_1$ to $\mathbf{12}_m$ in the PDP 7 in a sustain time period in accordance with the scan driver control signal CS. On the other hand, the sustain driver 6 simultaneously applies a sustain pulse whose phase is shifted by 180 degrees from the sustain pulse in the scan electrodes $\mathbf{12}_1$ to $\mathbf{12}_m$ to the plurality of sustain electrodes $\mathbf{13}_1$ to $\mathbf{13}_m$ in the PDP 7 in the sustain time period in accordance with the sustain driver control signal US. Consequently, sustain discharges are induced in the discharge cell 14 where the address discharges are induced.

Figure 2:
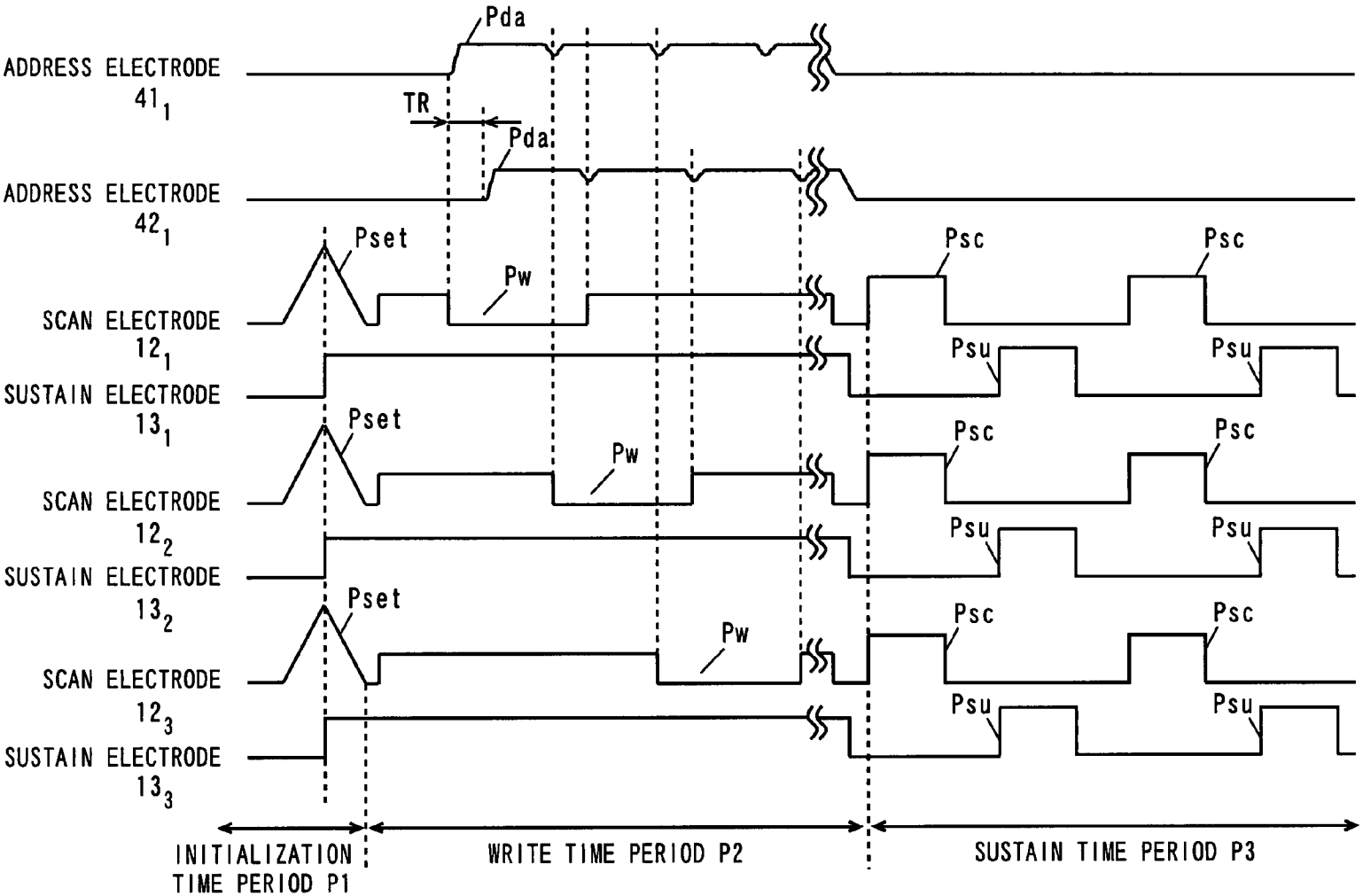
FIG. 2 is a timing chart showing an example of driving voltages respectively applied to address electrodes, scan electrodes, and sustain electrodes shown in FIG. 1.

FIG. 2 is a timing chart showing an example of driving voltages respectively applied to the address electrodes, the scan electrodes, and the sustain electrodes shown in FIG. 1.

In FIG. 2, in an initialization time period P1, an initial setup pulse Pset is simultaneously applied to the plurality of scan electrodes $\mathbf{12}_1$ to $\mathbf{12}_m$. Thereafter, in a write time period P2, a data pulse Pda that is turned on or off in response to a video signal is applied to each of the address electrodes $\mathbf{41}_n$ and $\mathbf{41}_n$ and $\mathbf{42}_1$ to $\mathbf{42}_n$, and a write pulse Pw is successively applied to the plurality of scan electrodes $\mathbf{12}_1$ to $\mathbf{12}_m$ in synchronization with the data pulse Pda. Thus, address discharges are induced successively in the selected discharge cell 14 in the PDP 1.

In the present embodiment, a shift TR occurs between timing at which the data pulse Pda is applied to the address electrodes $\mathbf{41}_1$ to $\mathbf{41}_n$ by the first group of data drivers 4*a* and timing at which the data pulse Pda is applied to the address electrodes $\mathbf{42}_1$ to $\mathbf{42}_n$ by the second group of data drivers 4*b*, as shown in FIG. 2. The details of the shift TR will be described later.

In a sustain time period P3, a sustain pulse Psc is then periodically applied to the plurality of scan electrodes $\mathbf{12}_1$ to $\mathbf{12}_m$, and a sustain pulse Psu is periodically applied to the plurality of sustain electrodes $\mathbf{13}_1$ to $\mathbf{13}_m$. The phase of the sustain pulse Psu is shifted by 180 degrees from the phase of the sustain pulse Psc. Consequently, sustain discharges are induced subsequently to the address discharges.

Figure 3:
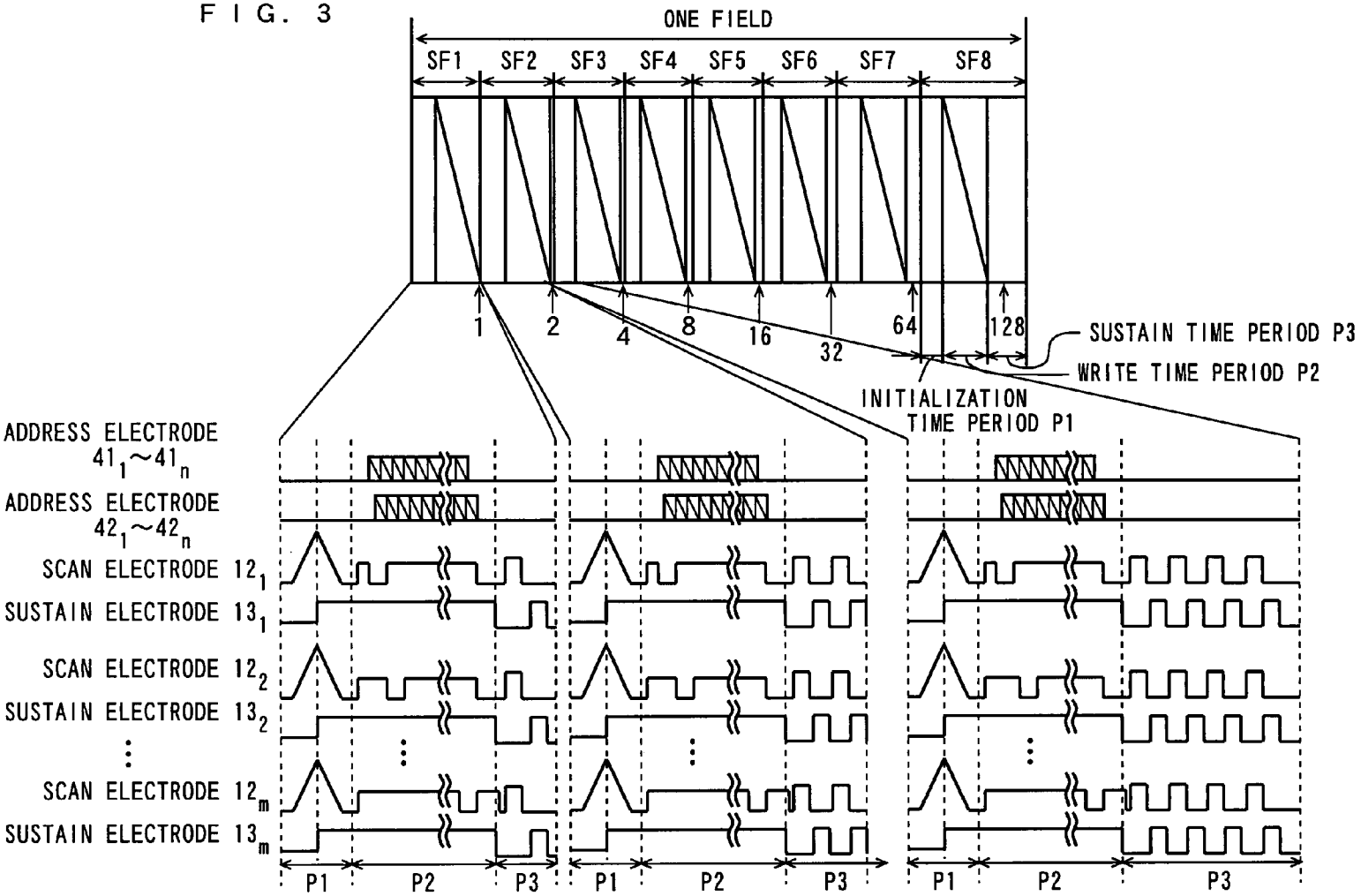
FIG. 3 is an explanatory view for explaining an ADS system used for the plasma display device shown in FIG. 1.

As described in the foregoing, in the plasma display device 100 according to the present embodiment, an ADS system is used as a gray scale expression driving system. Here, the ADS system will be described. FIG. 3 is an explanatory view for explaining the ADS system used for the plasma display device 100 shown in FIG. 1.

In the ADS system, one field (1/60 sec.=16.67 ms) is divided into a plurality of sub-fields on the time basis. When 256 gray scale expression is performed in units of eight bits, for example, one field is divided into eight sub-fields SF1 to SF8. Each of the sub-fields SF1 to SF8 is separated into an initialization time period P1, a write time period P2, and a sustain time period P3. In each of the sub-fields SF1 to SF8, setup processing in the sub-field is performed in the initialization time period P1, address discharges for selecting the discharge cell 14 that lights up are induced in the write time period P2, and sustain discharges for display are induced in the sustain time period P3, as in the example shown in FIG. 2.

Luminance (brightness) is weighted in the sustain time period P3 in each of the sub-fields SF1 to SF8. In the sustain time period P3 in each of the sub-fields SF1 to SF8, a sustain pulse is applied to the scan electrodes $\mathbf{12}_1$ to $\mathbf{12}_m$ and the sustain electrodes $\mathbf{13}_1$ to $\mathbf{13}_m$ a corresponding number of times to the weighted luminance. For example, in the sub-field SF1, the sustain pulse is applied once to the sustain electrodes $\mathbf{13}_1$ to $\mathbf{13}_m$, and the sustain pulse is applied once to the scan electrodes $\mathbf{12}_1$ to $\mathbf{12}_m$, so that the selected discharge cell 14 induces sustain discharges two times in the write time period P2. In the sub-field SF2, the sustain pulse is applied two times to the sustain electrodes $\mathbf{13}_1$ to $\mathbf{13}_m$, and the sustain pulse is applied two times to the scan electrodes $\mathbf{12}_1$ to $\mathbf{12}_m$, so that the selected discharge cell 14 induces sustain discharges four times in the write time period P2.

The sub-fields SF1 to SF8 are respectively weighted with luminances 1, 2, 4, 8, 16, 32, 64, and 128. The luminances can be adjusted at 256 gray scale levels from 0 to 255 by combining the sub-fields SF1 to SF8. The number of divisions into the sub-fields and the weighting values for the sub-fields, for example, are not particularly limited to those in the above-mentioned example and can be subjected to various changes. In order to reduce dynamic false contours, for example, the sub-field SF8 may be divided into two sub-fields, and the weighting values for the two sub-fields may be set to 64.

The shift TR between the timing at which the data pulse Pda shown in FIG. 2 is applied to the address electrode $\mathbf{41}_1$ to $\mathbf{41}_n$ and the timing at which the data pulse Pda is applied to the address electrode $\mathbf{42}_1$ to $\mathbf{42}_n$ will be described.

In the following description, the timing at which the data pulse Pda is applied to the address electrodes $\mathbf{41}_1$ to $\mathbf{41}_n$ and $\mathbf{42}_1$ to $\mathbf{42}_n$ is referred to as timing of data pulse application, and the shift TR between the timing of data pulse application to the address electrodes $\mathbf{41}_1$ to $\mathbf{41}_n$ and the timing of data pulse application to the address electrodes $\mathbf{42}_1$ to $\mathbf{42}_n$ is referred to as a data pulse phase difference TR.

Figure 4:
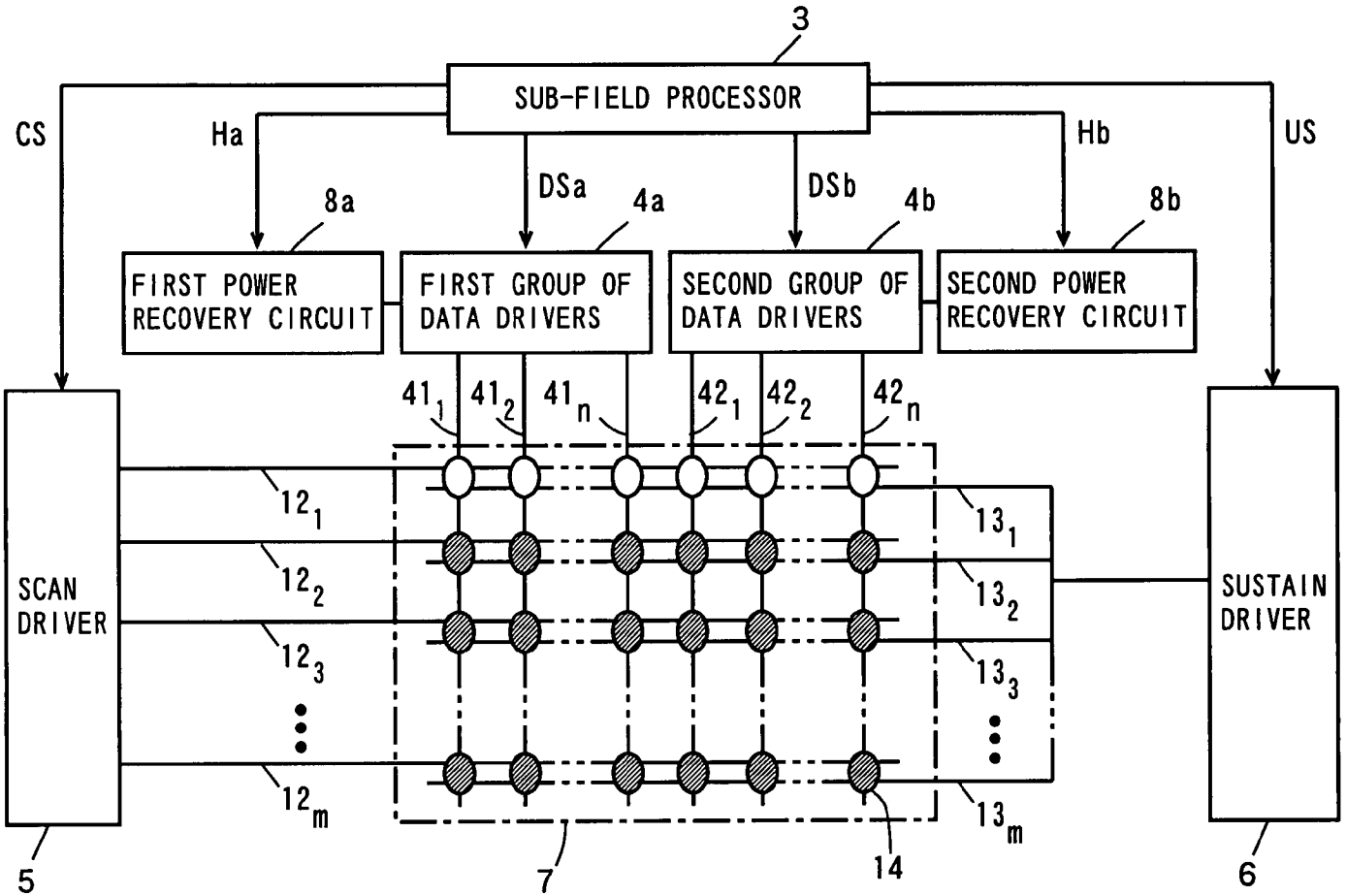
FIG. 4 is a schematic view showing an example of the display state of a PDP shown in FIG. 1.
Figure 5:
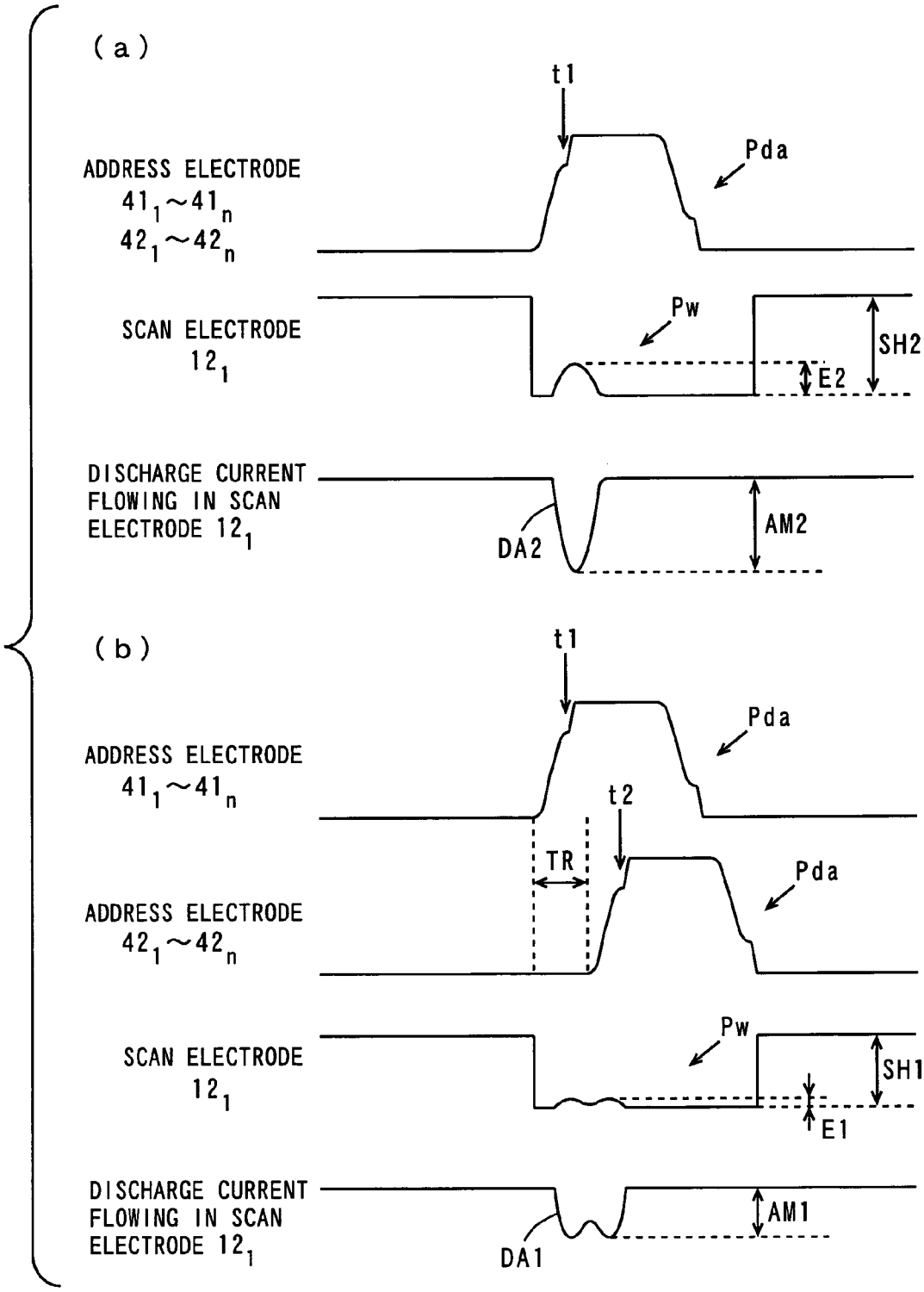
FIG. 5 is a diagram for explaining dependency of an address discharge current on a data pulse phase difference.

FIG. 4 is a schematic view showing an example of the display state of the PDP 7 shown in FIG. 1, and FIG. 5 is a diagram for explaining dependency of an address discharge current on a data pulse phase difference.

In FIG. 4, all the discharge cells 14 on the scan electrode $\mathbf{12}_1$ out of the discharge cells 14 on the PDP 7 are light-emitted.

Description is herein made of a case where the data pulse phase difference TR does not exist in realizing the display state of the PDP 7 shown in FIG. 4. In a case where the data pulse phase difference TR does not exist, as shown in FIG. 5(*a*), the discharge cells 14 on the address electrodes $\mathbf{41}_1$ to $\mathbf{41}_n$ and the discharge cells 14 on the address electrodes $\mathbf{42}_1$ to $42_n$ induce address discharges at the same timing t1. Thus, a discharge current DA2 having one peak is generated in the scan electrode $12_1$.

In this case, respective discharge currents of the discharge cells 14 on the address electrodes $41_1$ to $41_n$ and the discharge cells 14 on the address electrodes $42_1$ to $42_n$ simultaneously flow, so that the amplitude AM2 of the discharge current DA2 increases. Consequently, a large voltage drop E2 is produced in the write pulse Pw applied to the scan electrode $12_1$. As a result, address discharges become unstable. Consequently, a voltage SH2 of the write pulse Pw to be applied to the scan electrode $12_1$ must be set to a high voltage in order to induce stable address discharges.

Description is now made of a case where the data pulse phase difference TR exists in realizing the display state of the PDP 7 shown in FIG. 4. In a case where the data pulse phase difference TR exists, as shown in FIG. 5(*b*), the discharge cells 14 on the address electrodes $41_1$ to $41_n$ induce address discharges at the timing t1, and the discharge cells 14 on the address electrodes $42_1$ to $42_n$ induce address discharges at the timing t2. Thus, a discharge current DA1 having two peaks is generated in the scan electrode 121.

In this case, the respective discharge currents of the discharge cells 14 on the address electrodes $41_1$ to $41_n$ and the discharge cells 14 on the address electrodes $42_1$ to $42_n$ flow through the scan electrode $12_1$ at different timings, so that the amplitude AM1 of the discharge current DA1 decreases as the data pulse phase difference TR increases. Consequently, a voltage drop E1 produced in the write pulse Pw applied to the scan electrode $12_1$ decreases as the data pulse phase difference TR increases. Even in a case where a voltage SH1 of the write pulse Pw to be applied to the scan electrode $12_1$ is set to a low voltage, stable discharges can be ensured. In other words, a voltage (a driving voltage) of the write pulse Pw can be reduced while ensuring stable discharges of the discharge cells 14 by setting the data pulse phase difference TR to a large value, so that a driving margin, described later, is enlarged.

In the plasma display device 100 according to the present embodiment, the data pulse phase difference TR thus occurs at the time of application of the data pulses Pda to the address electrodes $41_1$ to $41_n$ and $42_1$ to $42_n$ by the first group of data driver 4*a* and the second group of data drivers 4*b*. Consequently, a voltage (a driving voltage) of the write pulse Pw can be reduced while ensuring stable discharges of the discharge cells 14, so that a driving margin, described later, is enlarged.

The details of the configurations and the operations of the first group of data drivers 4*a*, the first power recovery circuit 8*a*, and the PDP 7 shown in FIG. 1 in the write time period will be described on the basis of FIGS. 6 to 16.

Figure 6:
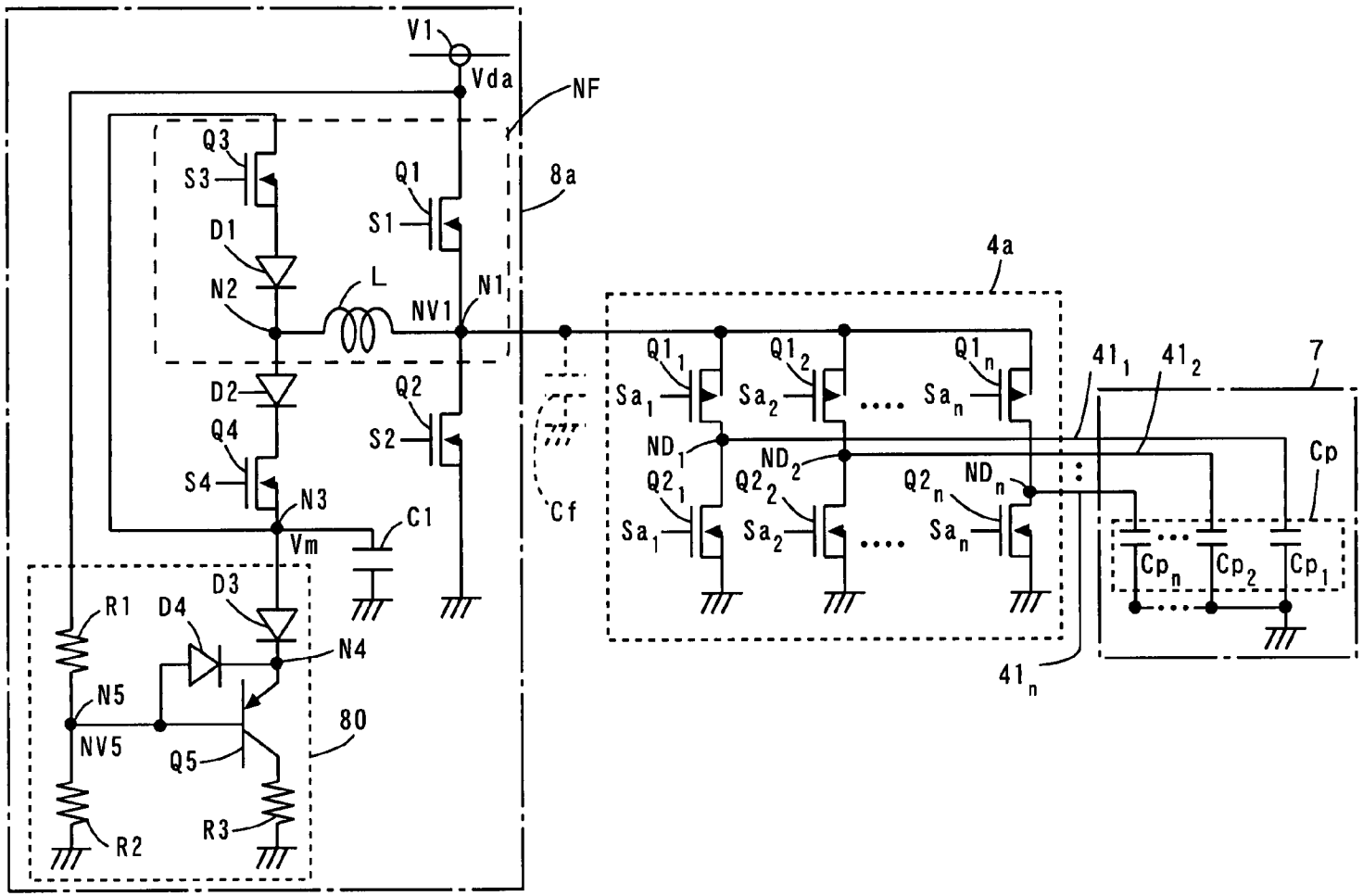
FIG. 6 is a circuit diagram of a first group of data drivers, a first power recovery circuit, and a PDP shown in FIG. 1.

FIG. 6 is a circuit diagram of the first group of data drivers 4*a*, the first power recovery circuit 8*a*, and the PDP 7 shown in FIG. 1. The first power recovery circuit 8*a* is connected to the plurality of address electrodes $41_1$ to $41_n$ in the PDP 7 through the first group of data drivers 4*a*, as described above. In FIG. 6, the capacitances of the plurality of discharge cells 14 provided in the address electrodes $41_1$ to $41_n$ in the PDP 7 are respectively taken as address electrode capacitances $Cp_1$ to $Cp_n$, and the sum is represented as a panel capacitance Cp.

According to FIG. 6, the first power recovery circuit 8*a* comprises a recovery capacitor C1, a recovery coil L, N-channel field effect transistors (hereinafter abbreviated as transistors) Q1 to Q4, diodes D1 and D2, and a recovery potential clamping circuit 80. The recovery potential clamping circuit 80 comprises resistors R1, R2, and R3, diodes D3 and D4, and a bipolar transistor (hereinafter abbreviated as a transistor) Q5.

The recovery capacitor C1 is connected between a node N3 and a ground terminal. The transistor Q3 and the diode D1 are connected in series between the node N3 and a node N2, and the diode D2 and the transistor Q4 are connected in series between the node N2 and the node N3.

The recovery coil L is connected between the node N2 and a node N1. The transistor Q1 is connected between the node N1 and a power supply terminal V1, and the transistor Q2 is connected between the node N1 and the ground terminal.

In the recovery potential clamping circuit 80, the diode D3 is connected between the node N3 and a node N4, the node N4 is connected to the emitter of the transistor Q5, and the collector of the transistor Q5 is connected to the ground terminal through the resistor R3. The resistor R1 is connected between the power supply terminal V1 and a node N5, and the resistor R2 is connected between the node N5 and the ground terminal. The node N5 is connected to the base of the transistor Q5. The diode D4 is connected between the node N5 and the node N4.

The first group of data drivers 4*a* comprises a plurality of P-channel field effect transistors (hereinafter abbreviated as transistors) $Q1_1$ to $Q1_n$ and a plurality of N-channel field effect transistors (hereinafter abbreviated as transistors) $Q2_1$ to $Q2_n$. The transistors $Q1_1$ to $Q1_n$ are respectively connected between the node N1 in the first power recovery circuit 8*a* and nodes $ND_1$ to $ND_n$. The transistors $Q2_1$ to $Q2_n$ are respectively connected between the nodes $ND_1$ to $ND_n$ and the ground terminal. Control pulses $Sa_1$ to $Sa_n$ generated on the basis of the data driver control signal DSa of the sub-field processor 3 shown in FIG. 1 are fed to the gates of the plurality of transistors $Q1_1$ to $Q1_n$ and $Q2_1$ to $Q2_n$.

The address electrodes $41_1$ to $41_n$ in the PDP 7 are respectively connected to the nodes $ND_1$ to $ND_n$ in the first group of data drivers 4*a*. The address electrode capacitances $Cp_1$ to $CP_n$ are respectively formed between the address electrodes $41_1$ to $41_n$ and the ground terminal. A stray capacitance Cf exists between the node N1 in the first power recovery circuit 8*a* and the ground terminal.

The configurations of the second group of data drivers 4*b* and the second power recovery circuit 8*b* are respectively the same as the configurations of the first group of data drivers 4*a* and the first power recovery circuit 8*a*. Control pulses $Sa_1$ to $Sa_n$ generated on the basis of the data driver control signal DSb of the sub-field processor 3 shown in FIG. 1 are fed to the gates of the plurality of transistors $Q1_1$ to $Q1_n$ and $Q2_1$ to $Q2_n$ in the second group of data drivers 4*b*.

A power supply voltage Vda is applied to the power supply terminal V1. Control signals S1 to S4 are respectively fed to the gates of the transistors Q1 to Q4. The transistors Q1 to Q4 perform an ON/OFF switching operation, respectively, on the basis of the control signals S1 to S4. The control signals S1 to S4 are generated on the basis of the power recovery circuit control signal Ha fed from the sub-field processor 3 shown in FIG. 1. The control signals S1 to S4 generated on the basis of the power recovery circuit control signal Hb are respectively fed to the transistors Q1 to Q4 in the second power recovery circuit 8*b* shown in FIG. 1.

Figure 7:
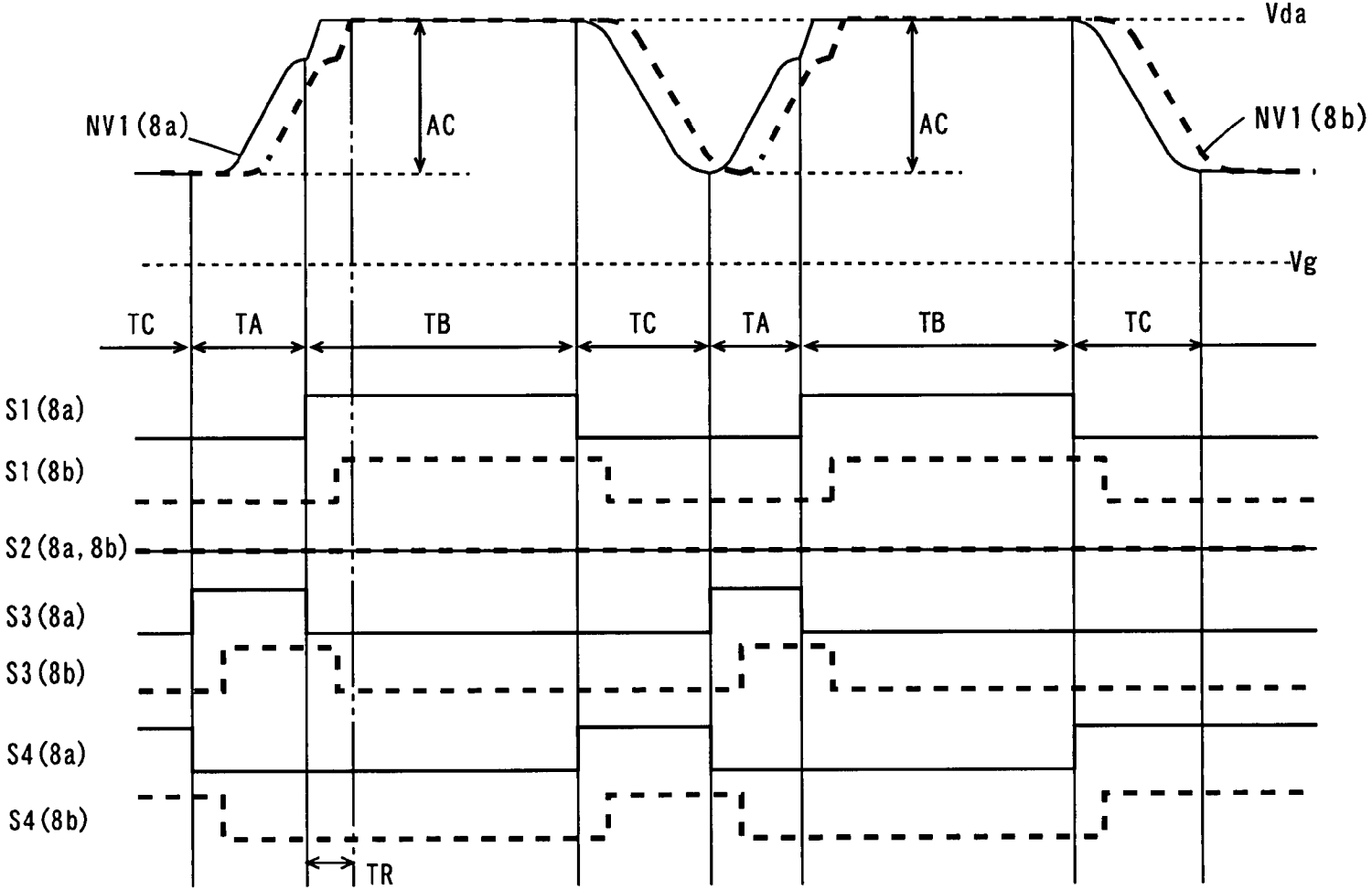
FIG. 7 is a timing chart showing the operations in a write time period of first and second power recovery circuits shown in FIG. 1.

FIG. 7 is a timing chart showing the respective operations in the write time period of first and second power recovery circuits 8*a* and 8*b* shown in FIG. 1. FIG. 7 shows the respective waveforms of the voltage NV1 at the node N1 and the control signals S1 to S4 respectively fed to the transistors Q1 to Q4, as shown in FIG. 6. The respective signal waveforms of the voltage NV1 at the node N1 and the control signals S1 to S4 respectively fed to the transistors Q1 to Q4 in the second group of data drivers 4*b* are indicated by broken lines.

In FIG. 7, reference numeral 8*a* is attached, enclosed in parentheses, after the voltage NV1 and the control signals S1 to S4 in the first power recovery circuit 8*a*, and reference numeral 8*b* is attached, enclosed in parentheses, after the voltage NV1 and the control signals S1 to S4 in the second power recovery circuit 8*b*.

The transistors Q1 to Q4 are turned on when the control signals S1 to S4 are at a high level, while being turned off when the control signals S1 to S4 are at a low level.

In a time period TA, the control signal S3 is at a high level, and the control signals S1, S2, and S4 are at a low level. Consequently, the transistor Q3 is turned on, and the transistors Q1, Q2, and Q4 are turned off. In this case, the recovery capacitor C1 is connected to the recovery coil L through the transistor Q3 and the diode D1, and the voltage NV1 at the node N1 is gently raised due to LC resonance of the recovery coil L, the stray capacitance Cf, and the panel capacitance Cp.

At this time, charges in the recovery capacitor C1 are discharged into the stray capacitance Cf through the transistor Q3, the diode D1, and the recovery coil L, and are further discharged into the panel capacitance Cp in the PDP 7 through the first group of data drivers 4*a*.

In a time period TB, the control signal S1 is at a high level, and the control signals S2 to S4 are at a low level. Consequently, the transistor Q1 is turned on, and the transistors Q2 to Q4 are turned off. In this case, the node N1 is connected to the power supply terminal V1 through the transistor Q1. Consequently, the voltage NV1 at the node N1 is rapidly raised and is fixed to the power supply voltage Vda fed to the power supply terminal V1.

In a time period TC, the control signal S4 is at a high level, and the control signals S1 to S3 are at a low level. Consequently, the transistor Q4 is turned on, and the transistors Q1 to Q3 are turned off. In this case, the recovery capacitor C1 is connected to the recovery coil L through the transistor Q4 and the diode D2, and the voltage NV1 at the node N1 is gently lowered due to LC resonance of the recovery coil L, the stray capacitance Cf, and the panel capacitance Cp. At this time, charges stored in the stray capacitance Cf and the panel capacitance Cp are recovered in the recovery capacitor C1 through the recovery coil L, the diode D2, and the transistor Q4.

The power recovery circuit 8*a* repeats the operations in the time periods TA to TC, so that the charges stored in the panel capacitance Cp and the stray capacitance Cf are recovered in the recovery capacitor C1, and the recovered charges are fed to the panel capacitance Cp and the stray capacitance Cf again. Power based on the charges recovered in the recovery capacitor C1 by the panel capacitance Cp and the stray capacitance Cf is referred to as recovery power.

A voltage based on the charges recovered in the recovery capacitor C1 is the same as the voltage at the node N3 shown in FIG. 6. The voltage at the node N3 is hereinafter referred to as a recovery potential Vm. The recovery capacitor C1 and the recovery coil L shown in FIG. 6 perform LC resonance based on the recovery potential Vm. Thus, a change AC occurs in the voltage NV1 at the node N1 shown in FIG. 6, as shown in FIG. 7. The change AC in the voltage NV1 varies depending on the recovery potential Vm.

In the above-mentioned description, during the time periods TA to TC, the control signal S2 is always at a low level, and the transistor Q2 is always turned off. However, the control signal S2 enters a high level when the write time period P2 (FIG. 2) is terminated, while entering a low level when the write time period P2 is started again. Consequently, the transistor Q2 is always turned on in a time period other than the write time period P2, and the node N1 is connected to the ground terminal. This operation is performed in order to store the predetermined quantity of charges in a charge-pump circuit, described later.

In the time periods TA to TC, the following operations are performed in the recovery potential clamping circuit 80 in the first power recovery circuit 8*a* shown in FIG. 6.

In the recovery potential clamping circuit 80, the resistors R1 and R2 are connected in series between the power supply terminal V1 and the ground terminal. Consequently, a predetermined voltage NV5 is generated at the node N5 between the resistors R1 and R2. On the other hand, the recovery potential Vm at the node N3 is fed to the node N4. Here, a voltage drop (e.g., 0.7 V) produced by the diode D3 is ignored in order to simplify the description. The recovery potential Vm varies on the basis of the operation of the first group of data drivers 4*a*, described later.

The transistor Q5 is turned off when the voltage NV5 at the node N5 is not less than the voltage at the node N4, while being turned on when the voltage NV5 at the node N5 is lower than the voltage at the node N4. That is, the transistor Q5 is turned off when the recovery potential Vm at the node N3 is not more than the voltage NV5, while being turned on when the recovery potential Vm at the node N3 is higher than the voltage NV5.

When the recovery potential Vm is not more than the voltage NV5, therefore, the transistor Q5 is turned off, so that the charges stored in the recovery capacitor C1 are stored without being discharged into the ground terminal.

On the other hand, when the recovery potential Vm is higher than the voltage NV5, the transistor Q5 is turned on, so that the charges stored in the recovery capacitor C1 are discharged into the ground terminal through the node N3, the diode D3, the node N4, the transistor Q5, and the resistor R3. As a result, the recovery potential Vm at the node N3 does not exceed the voltage NV5.

The upper limit value of the recovery potential Vm limited on the basis of the voltage NV5 set by the resistors R1 and R2 and the power supply voltage Vda applied to the power supply terminal V1 in FIG. 6 will be referred to as a limit voltage Vr.

When the voltage drop produced by the diode D3 is considered in the foregoing description, the voltage NV5 at the node N5 is set to a voltage lower by the voltage drop produced by the diode D3 than the limit voltage Vr.

The recovery potential clamping circuit 80 thus performs a clamping operation when the recovery potential Vm at the node N3 exceeds the limit voltage Vr. Consequently, the recovery potential Vm does not exceed the limit voltage Vr. The reason why the plasma display device 100 according to the present embodiment is provided with the recovery potential clamping circuit 80 will be described later.

Although In FIG. 7, the waveforms of the voltage NV1 at the node N1 and the control signals S1 to S4 in the second power recovery circuit 8*b* are respectively the same as the waveforms of the voltage NV1 at the node N1 and the control signals S1 to S4 in the first power recovery circuit 8*a*, a phase shift TR occurs. The shift TR in timing corresponds to the data pulse phase difference TR shown in FIG. 5.

Description is then made of the recovery potential Vm that varies every time the voltage NV1 shown in FIG. 7 is raised on the basis of the operations of the first power recovery circuit 8*a* and the first group of data drivers 4*a*.

Figure 8:
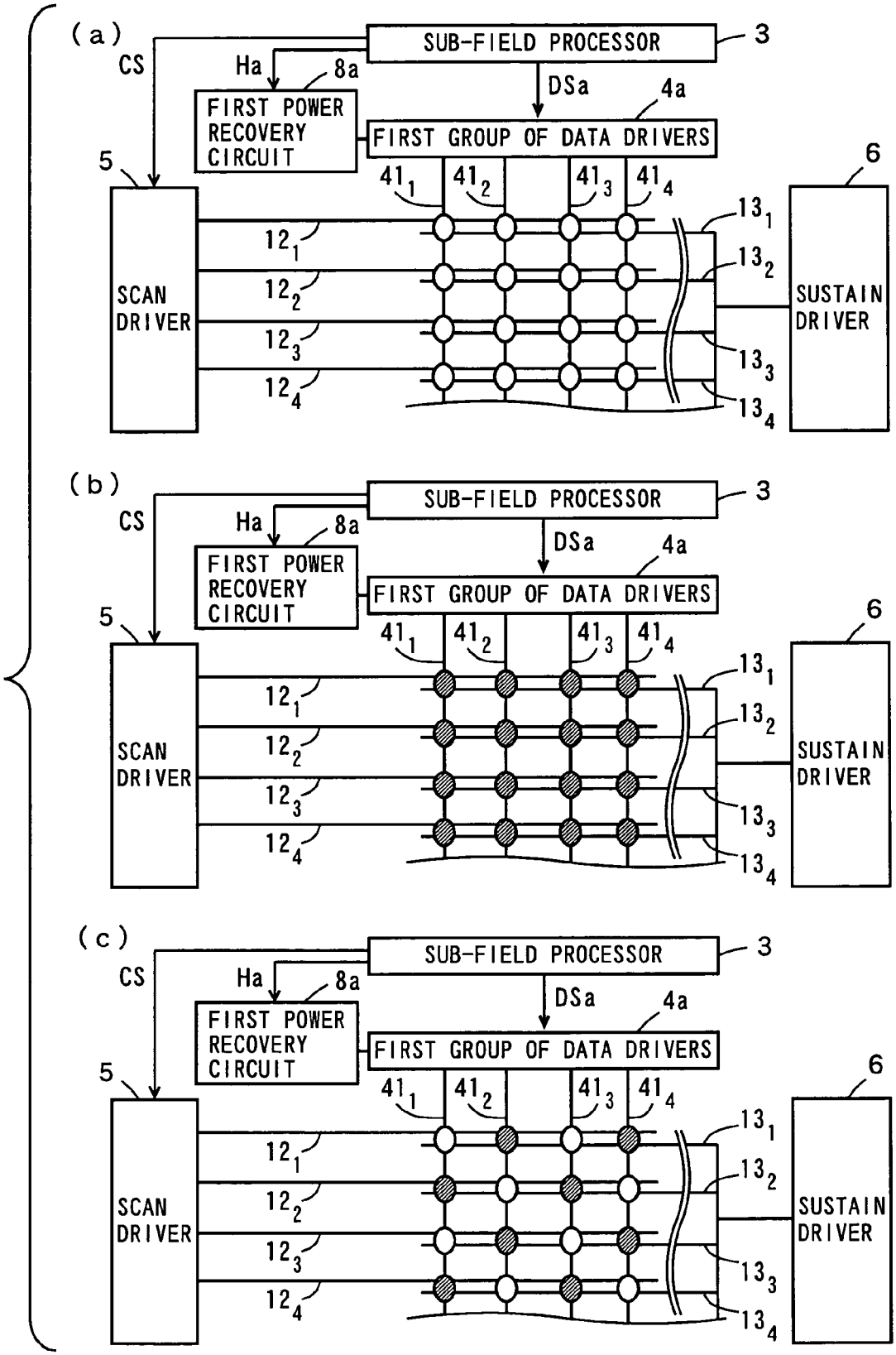
FIG. 8 is a schematic view showing an example of the display state of a PDP.
Figure 9:
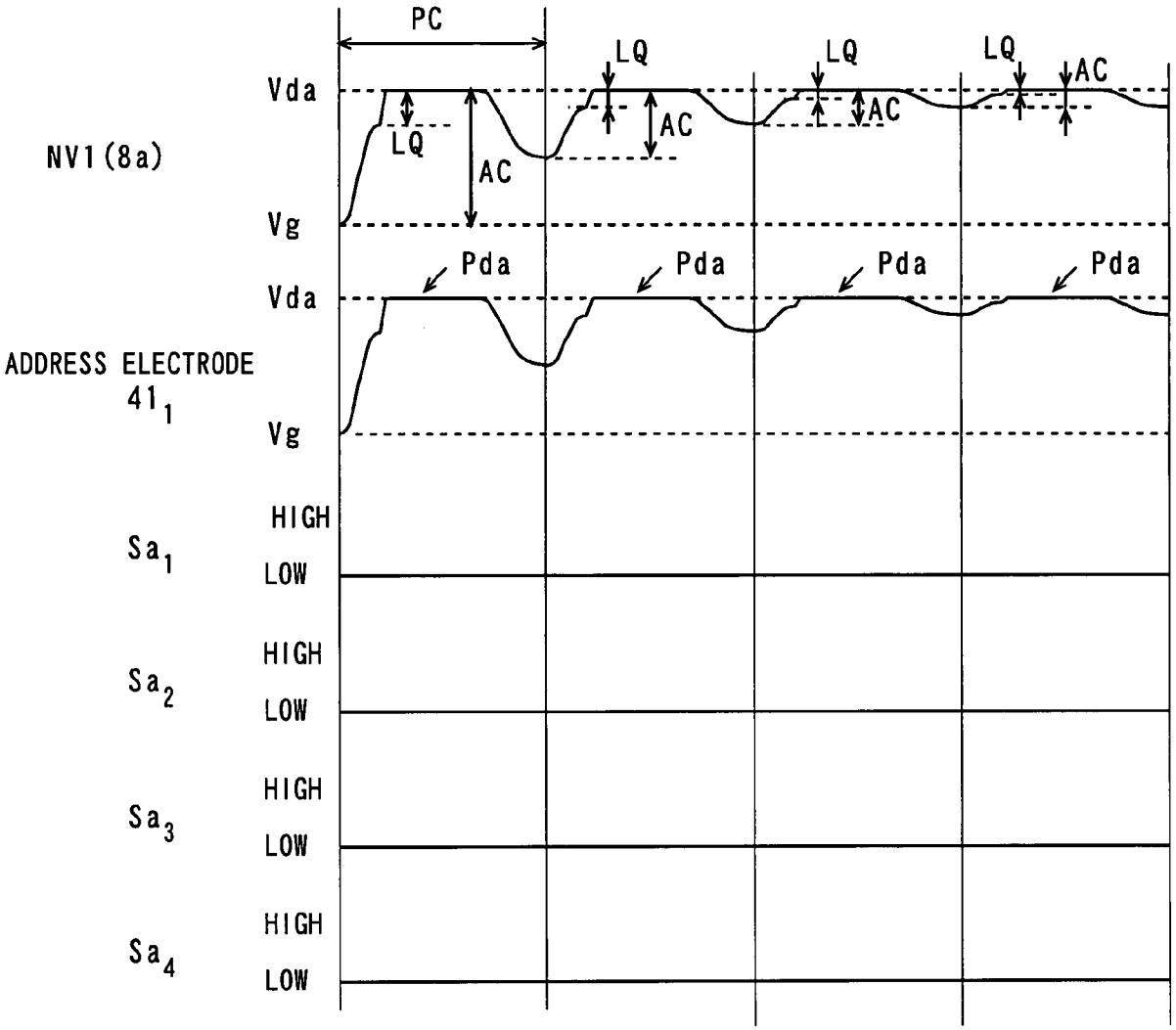
FIG. 9 is a diagram showing timings of a voltage at a node N1 shown in FIG. 6, a data pulse applied to address electrodes, and a control pulse applied to a first group of data drivers in a case where the display state shown in FIG. 8 is obtained.
Figure 10:
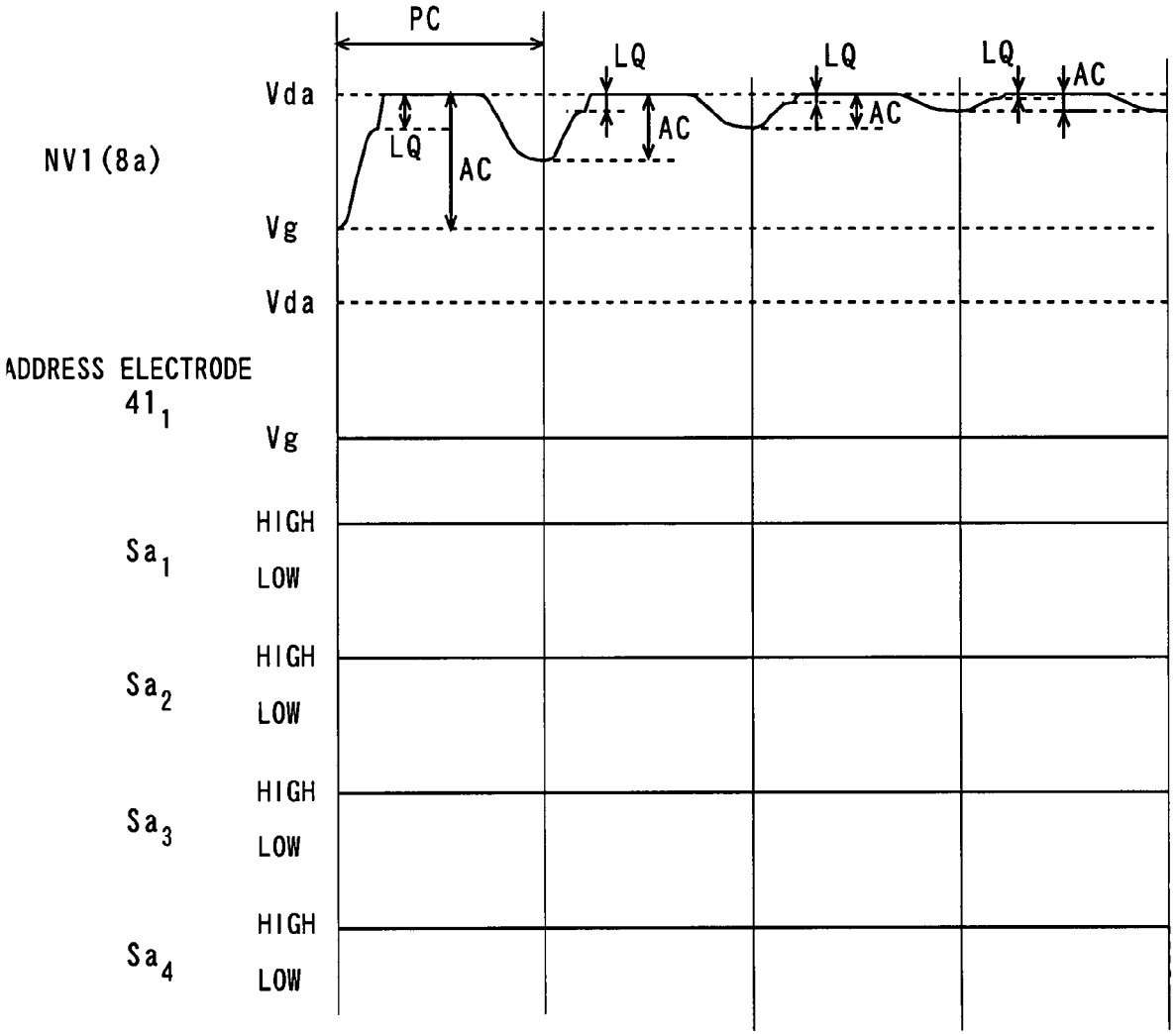
FIG. 10 is a diagram showing timings of a voltage at a node N1 shown in FIG. 6, a data pulse applied to an address electrode, and a control pulse applied to a first group of data drivers in a case where the display state shown in FIG. 8 is obtained.
Figure 11:
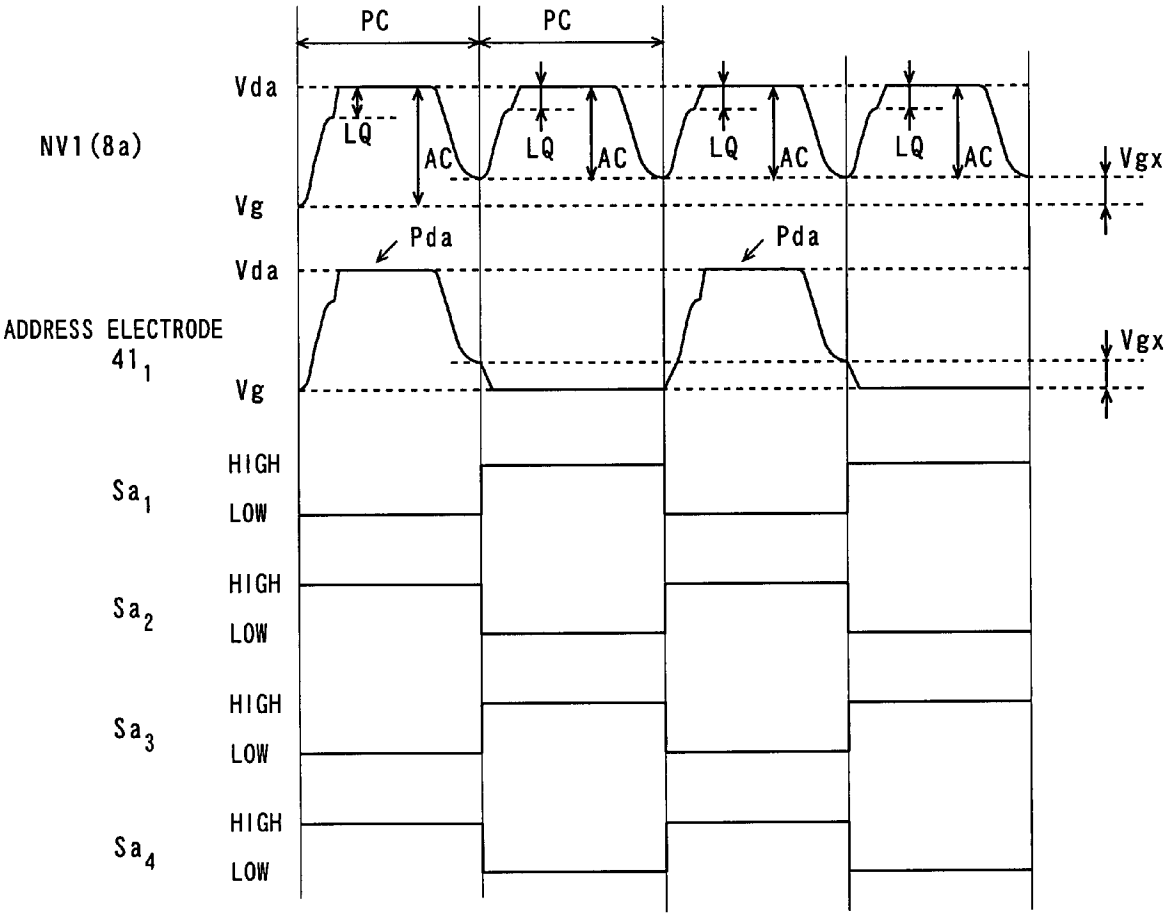
FIG. 11 is a diagram showing timings of a voltage at a node N1 shown in FIG. 6, a data pulse applied to an address electrode, and a control pulse applied to a first group of data drivers in a case where the display state shown in FIG. 8 is obtained.

FIG. 8 is a schematic view showing an example of the display state of the PDP 7, and FIGS. 9 to 11 are diagrams showing the timings of the voltage NV1 at the node N1, the data pulse Pda applied to the address electrode $\mathbf{41}_1$, and the control pulses $Sa_1$ to $Sa_4$ applied to the first group of data drivers 4*a*, as shown in FIG. 6, in a case where the display state shown in FIG. 8 is obtained. In FIG. 8, only a part of the PDP 7 shown in FIG. 1 is illustrated.

FIG. 8(*a*) illustrates an example in which all pixels in the PDP 7 shown in FIG. 1 display "white". A display state where all the pixels in the PDP 7 thus display "white" will be hereinafter referred to as "solid white". In this case, all the discharge cells 14 respectively composing the pixels in the PDP 7 are discharged.

FIG. 8(*b*) illustrates an example in which all pixels in the PDP 7 shown in FIG. 1 display "black". A display state where all the pixels in the PDP 7 thus display "black" will be hereinafter referred to as "solid black". In this case, all the discharge cells 14 respectively composing the pixels in the PDP 7 are not discharged.

FIG. 8(*c*) illustrates an example in which pixels alternately display "white" and "black" in the vertical direction and the horizontal direction in the PDP 7 shown in FIG. 1. In FIG. 8(*c*), the pixels respectively formed by the discharge cells 14 on the address electrode $\mathbf{41}_n$ display "white", "black", "white", and "black" in this order from above, and the pixels respectively formed by the discharge cells 14 on the address electrode $\mathbf{41}_2$ display "black", "white", "black", and "white" in this order from above. A state where the pixels in the PDP 7 alternately display "white" and "black" in the vertical direction and the horizontal direction will be referred to as a trio-checkerboard. In this case, the discharge cells 14 respectively composing alternate pixels in the vertical direction and the horizontal direction in the PDP 7 are discharged, and the discharge cells 14 there among are not discharged.

In the display state of the PDP 7 shown in FIG. 8(*a*), the voltage NV1 at the node N1, the data pulse Pda applied to the address electrode $\mathbf{41}_1$, and the control pulses $Sa_1$ to $Sa_4$ fed to the first group of data drivers 4*a*, as shown in FIG. 6, are changed, as shown in FIG. 9.

When the PDP 7 is "solid white", as shown in FIG. 9, a change AC in the voltage NV1 at the node N1 shown in FIG. 6 varies in response to the recovery potential Vm at the node N3 shown in FIG. 6. The recovery potential Vm varies every time the voltage NV1 shown in FIG. 7 is raised.

According to FIG. 9, the change AC in the voltage NV1 successively decreases every time the voltage NV1 is raised. In this case, the control pulses $Sa_1$ to $Sa_4$ are always at a low level in the write time period P2. When the PDP 7 is "solid white", therefore, the transistors $Q\mathbf{1}_1$ to $Q\mathbf{1}_4$ are always turned on, and the transistors $Q\mathbf{2}_1$ to $Q\mathbf{2}_4$ are always turned off. As a result, the voltage NV1 is applied as the data pulse Pda to the address electrode $\mathbf{41}_1$, so that the voltage at the address electrode $\mathbf{41}_n$ varies similarly to the voltage NV1.

In a time period PC shown in FIG. 9, the voltage NV1 at the node N1 is raised due to LC resonance of the recovery coil L, the stray capacitance Cf, and the panel capacitance Cp shown in FIG. 6, as described above, is fixed at the voltage Vda applied to the power supply terminal V1, and is then lowered due to LC resonance of the recovery coil L, the stray capacitance Cf, and the panel capacitance Cp.

The transistors $Q\mathbf{1}_1$ to $Q\mathbf{1}_4$ are always turned on, and the transistors $Q\mathbf{2}_1$ to $Q\mathbf{2}_4$ are always turned off, so that charges stored in the recovery capacitor C1 are discharged into the stray capacitance Cf and the panel capacitance Cp when the voltage NV1 is raised. On the other hand, the charges stored in the stray capacitance Cf and the panel capacitance Cp are recovered in the recovery capacitor C1 when the voltage NV1 is lowered.

When the PDP 7 is "solid white", the above-mentioned time period PC is repeated, so that the charges stored in the recovery capacitor C1 are gradually raised. Consequently, the recovery potential Vm at the node N3 shown in FIG. 6 is successively raised as the data pulse Pda is applied to each of the address electrodes $\mathbf{41}_1$ to $\mathbf{41}_4$. Consequently, a circuit loss (an arrow LQ in FIG. 9) in the first group of data drivers 4*a* is reduced. A circuit loss in the second group of data drivers 4*b* is also similarly reduced.

However, the recovery potential Vm is not raised in excess of the limit voltage Vr shown in FIG. 7 by the recovery potential clamping circuit 80 shown in FIG. 6. As a result, the above-mentioned change AC in the voltage NV1 becomes constant by fixing the recovery potential Vm to the limit voltage Vr. The details of the change in the recovery potential Vm will be described later.

When the PDP 7 is "solid black", as shown in FIG. 10, a change AC in the voltage NV1 at the node N1 shown in FIG. 6 varies in response to the recovery potential Vm at the node N3 shown in FIG. 6. The recovery potential Vm varies every time the voltage NV1 shown in FIG. 7 is raised.

According to FIG. 10, the change AC in the voltage NV1 successively decreases every time the voltage NV1 is raised. In this case, the control pulses $Sa_1$ to $Sa_4$ are always at a high level in the write time period P2. When the PDP 7 is "solid black", therefore, the transistors $Q\mathbf{1}_1$ to $Q\mathbf{1}_4$ are always turned off, and the transistors $Q\mathbf{2}_1$ to $Q\mathbf{2}_4$ are always turned on. As a result, the voltage NV1 is not applied as the data pulse Pda to the address electrode $\mathbf{41}_1$, so that the voltage at the address electrode $\mathbf{41}_1$ is always the ground potential Vg.

In a time period PC shown in FIG. 10, the voltage NV1 at the node N1 is raised due to LC resonance of the recovery coil L and the stray capacitance Cf shown in FIG. 6, as described above, is fixed at the voltage Vda applied to the power supply terminal V1, and is then lowered due to LC resonance of the recovery coil L and the stray capacitance Cf.

The transistors $Q\mathbf{1}_1$ to $Q\mathbf{1}_4$ are always turned off, and the transistors $Q\mathbf{2}_1$ to $Q\mathbf{2}_4$ are always turned on, so that charges stored in the recovery capacitor C1 are discharged into the stray capacitance Cf when the voltage NV1 is raised. On the other hand, the charges stored in the stray capacitance Cf are recovered in the recovery capacitor C1 when the voltage NV1 is lowered.

When the PDP 7 is "solid black", the above-mentioned time period PC is repeated, so that the charges stored in the recovery capacitor C1 are gradually raised. Consequently, the recovery potential Vm at the node N3 shown in FIG. 6 is successively raised every time the voltage NV1 is raised. Thus, a circuit loss (an arrow LQ in FIG. 10) in the first group of data drivers 4*a* is reduced. A circuit loss in the second group of data drivers 4*b* is also similarly reduced.

However, the recovery potential Vm is not raised in excess of the limit voltage Vr shown in FIG. 7 by the recovery potential clamping circuit 80 shown in FIG. 6. As a result, the above-mentioned change AC in the voltage NV1 becomes constant by fixing the recovery potential Vm to the limit voltage Vr.

When the PDP 7 is a "trio-checkerboard", as shown in FIG. 11, a change AC in the voltage NV1 at the node N1 shown in FIG. 6 becomes constant except for the time when the voltage NV1 is first raised. The reason for this is that the recovery potential Vm at the node N3 shown in FIG. 6 becomes constant except for the time when the voltage NV1 is first raised.

In this case, the control pulses $Sa_1$ and $Sa_3$ repeat a low level and a high level every time the voltage NV1 is raised in the write time period P2. The control pulses $Sa_2$ and $Sa_4$ repeat a high level and a low level, contrary to the control pulses $Sa_1$ and $Sa_3$, every time the voltage NV1 is raised. On and OFF of each of the transistors $Q\mathbf{1}_1$ to $Q\mathbf{1}_4$ and On and OFF of each of the transistors $Q\mathbf{2}_1$ to $Q\mathbf{2}_4$ are respectively switched for each time period PC. As a result, when the voltage at the address electrode $41_1$ is raised to the voltage Vda shown in FIG. 7 when the control pulses $Sa_1$ and $Sa_3$ are at a low level, while reaching the ground potential Vg when the control pulses $Sa_2$ and $Sa_4$ are at a low level.

In a time period PC shown in FIG. 11, the voltage NV1 at the node N1 is raised due to LC resonance of the recovery coil L, the stray capacitance Cf, and the panel capacitance Cp shown in FIG. 6, as described above, is fixed to the voltage Vda applied to the power supply terminal V1, and is then lowered due to LC resonance of the recovery coil L, the stray capacitance Cf, and the panel capacitance Cp.

The recovery potential Vm is changed to the minimum recovery potential Vs, described later, in the second time period PC from the first time period PC, and is not then changed from the minimum recovery potential Vs.

In the first time period PC, the transistor $Q1_1$ is turned on and the transistor $Q2_1$ is turned off when the voltage NV1 is raised, so that charges stored in the recovery capacitor C1 are discharged into the stray capacitance Cf and the address electrode capacitance $Cp_1$. The address electrode capacitance $Cp_1$ is connected to the transistor $Q1_1$ that is in an ON state. On the other hand, the transistor $Q1_2$ is turned off and the transistor $Q2_2$ is turned on, so that the charges stored in the recovery capacitor C1 are recovered in the stray capacitance Cf.

When the voltage NV1 is lowered, the charges stored in the stray capacitance Cf and the address electrode capacitance $Cp_1$ are recovered in the recovery capacitor C1. Here, the voltage NV1 is lowered to a predetermined voltage Vgx without being lowered to the ground potential Vg by the charges stored in the stray capacitance Cf and the address electrode capacitance $Cp_1$. The recovery potential Vm at the node N3 at this time is the minimum recovery potential Vs, described later.

In the initial time period PC, a data pulse Pda is applied, as shown in FIG. 11, to the address electrode $41_1$. The data pulse Pda is not applied to the address electrode $41_2$.

In the second time period PC, when the voltage NV1 is raised, the transistor $Q1_1$ is turned off and the transistor $Q2_1$ is turned on, so that the charges stored in the recovery capacitor C1 are discharged into the stray capacitance Cf. On the other hand, the transistor $Q1_2$ is turned on and the transistor $Q2_2$ is turned off, so that the charges stored in the recovery capacitor C1 are discharged into the stray capacitance Cf and the address electrode capacitance $Cp_2$. Here, the address electrode capacitance $Cp_1$ is connected to the transistor $Q1_1$ that is in an ON state.

When the voltage NV1 is lowered, the charges stored in the stray capacitance Cf and the address electrode capacitance $Cp_2$ are recovered in the recovery capacitor C1. Here, the voltage NV1 is lowered to a predetermined voltage Vgx without being lowered to the ground potential Vg by the charges stored in the stray capacitance Cf and the panel capacitance $Cp_2$. In the same manner as described above, the recovery potential Vm at this time is the minimum recovery potential Vs, described later. The charges stored in the address electrode capacitance $Cp_2$ are discharged into the ground terminal through the address electrode $41_1$ and the transistor $Q1_1$ in the initial time period PC.

In the time period PC2, the data pulse Pda is applied, as shown in FIG. 11, to the address electrode $41_2$. The data pulse Pda is not applied to the address electrode $41_1$.

Although description was made of the change in the voltage NV1 shown in FIG. 7 on the basis of the changes in voltages of the two address electrodes $41_n$ and $41_2$, the same charges in voltages as those of the address electrodes $41_1$ and $41_2$ also occur at the other address electrodes $41_3$ to $41_n$, so that the voltage NV1 varies with the charges stored in the stray capacitance Cf and the address electrode capacitances $Cp_1$ to $Cp_n$.

When the PDP 7 is thus a "trio-checkerboard", the above-mentioned operations in the time period PC are alternately repeated for each of the address electrodes $41_1$ to $41_n$, so that the maximum charges are not stored in the address electrode capacitances $Cp_1$ to $CP_n$ respectively connected to all the address electrodes $41_1$ to $41_n$. As a result, the recovery potential Vm is not raised, to reach the minimum recovery potential Vs, described later. A circuit loss in the first group of data drivers 4*a* in this case is indicated by an arrow LQ shown in FIG. 11. The circuit loss is also similarly consumed in the second group of data drivers 4*b*.

Figure 12:
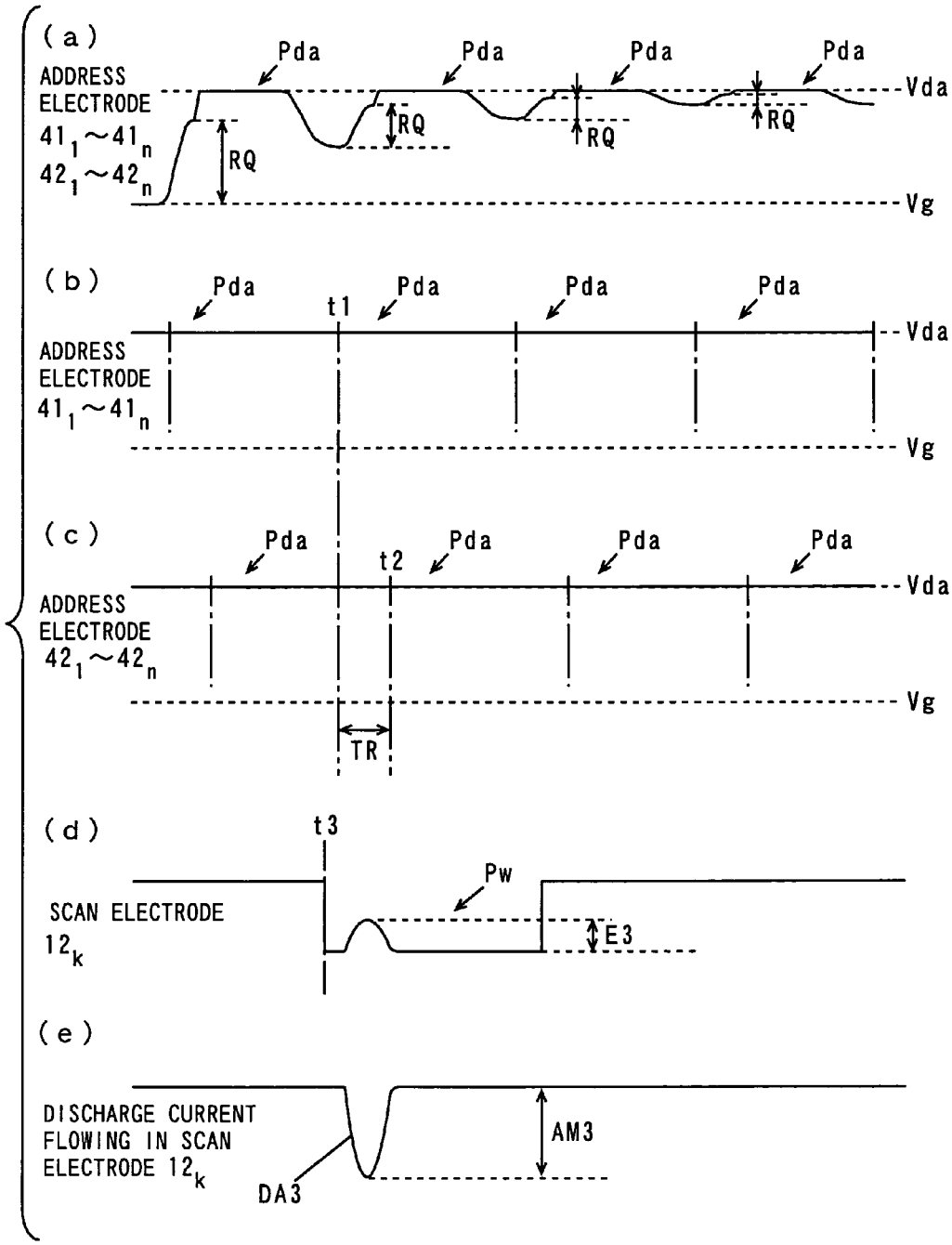
FIG. 12 is a diagram for explaining the function of a recovery potential clamping circuit shown in FIG. 6.
Figure 13:
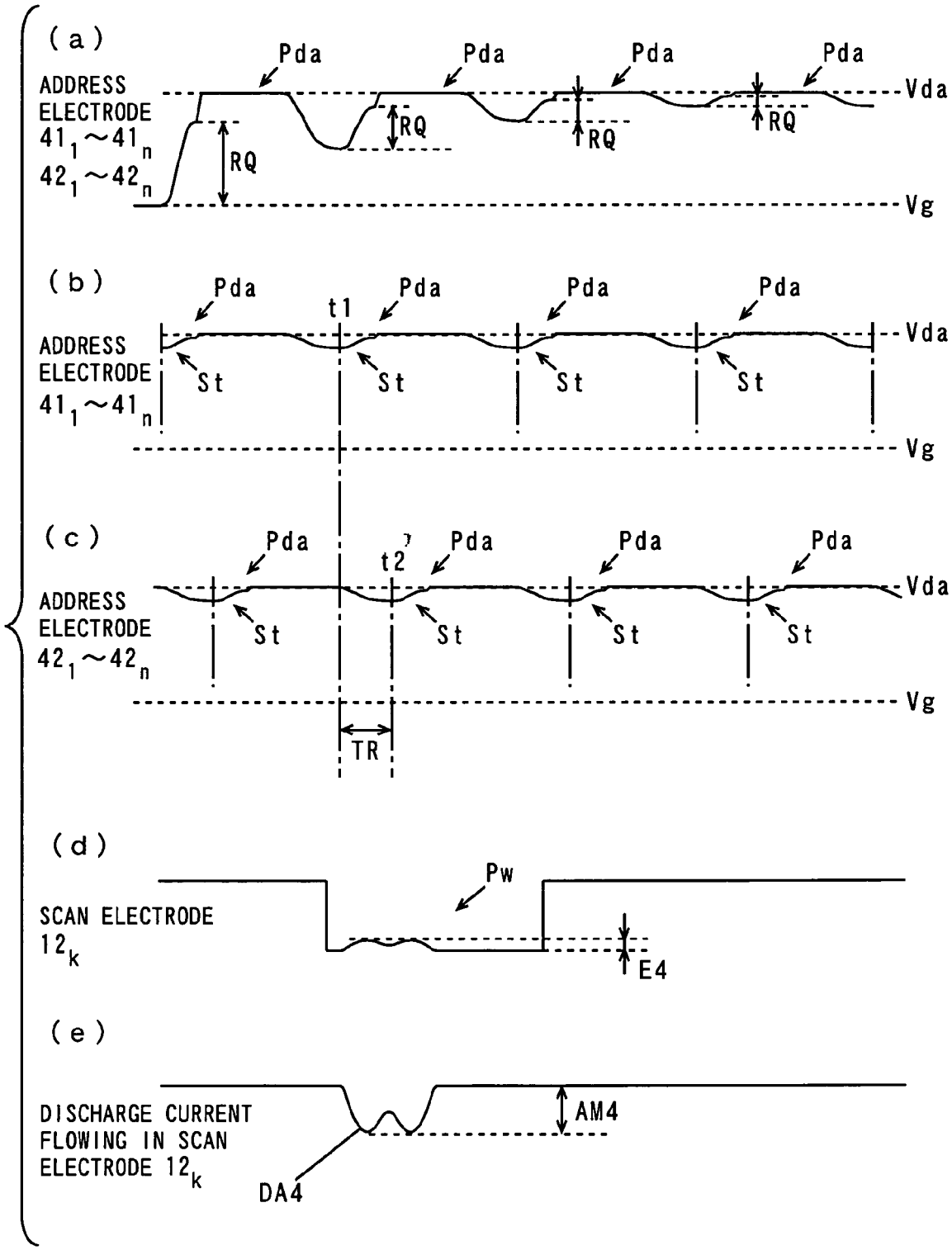
FIG. 13 is a diagram for explaining the function of the recovery potential clamping circuit shown in FIG. 6.

The reason why the plasma display device 100 according to the present embodiment is provided with the recovery potential clamping circuit 80 will be then described on the basis of FIGS. 12 and 13.

FIGS. 12 and 13 are diagrams for explaining the function of the recovery potential clamping circuit 80 shown in FIG. 6. In the plasma display device 100 according to the present embodiment, the circuit loss is reduced by the first power recovery circuit 8*a* and the second power recovery circuit 8*b* shown in FIG. 6.

When the PDP 7 is "solid white", for example, the voltage of each of the address electrodes $41_1$ to $41_n$ and $42_1$ to $42_n$ is successively raised as the data pulse Pda is applied (FIGS. 12(*a*) and 13(*a*)). As a result, recovery power (an arrow RQ) based on the charges recovered in the recovery capacitor C1 from the panel capacitance Cp shown in FIG. 6 is successively reduced as the data pulse Pda is applied to each of the address electrodes $41_1$ to $41_n$ and $42_1$ to $42_n$.

A case where the first power recovery circuit 8*a* and the second power recovery circuit 8*b* shown in FIG. 6 are not provided with the recovery potential clamping circuit 80 will be herein described for comparison. In this case, when application of the data pulses Pda to the address electrodes $41_1$ to $41_n$ and $42_1$ to $42_n$ is continued, the voltage of each of the address electrodes $41_1$ to $41_n$ and $42_1$ to $42_n$ is fixed to the voltage Vda applied to the power supply terminal V1 shown in FIG. 6, as shown in FIGS. 12(*b*) and 12(*c*).

In the plasma display device 100 according to the present embodiment, timing t1 at which the data pulse Pda is applied to the address electrodes $41_1$ to $41_n$ and timing t2 at which the data pulse Pda is applied to the address electrodes $42_1$ to $42_n$ are shifted in order to produce the data pulse phase difference TR when the data pulse Pda is applied to each of the address electrodes $41_1$ to $41_n$ and $42_1$ to $42_n$ (FIG. 12(*b*) and 12(*c*)).

However, the voltage of each of the address electrodes $41_1$ to $41_n$ and $42_1$ to $42_n$ is fixed to the voltage Vda, a rise portion of the data pulse Pda is not specified, so that the data pulse phase difference TR cannot be reliably obtained. That is, a difference between the voltage of each of the address electrodes $41_1$ to $41_n$ and $42_1$ to $42_n$ and the voltage of the write pulse Pw shown in FIG. 2 applied to the scan electrodes $12_1$ to $12_m$ exceeds a voltage value always required for address discharges.

Consequently, respective discharge currents of the discharge cells 14 on the address electrodes $41_1$ to $41_n$ and the discharge cells 14 on the address electrodes $42_1$ to $42_n$ simultaneously flow in the scan electrode $12_k$ (k is an arbitrary integer of 1 to m) to which the write pulse Pw is applied in correspondence with the data pulse Pda applied to the address electrodes $41_1$ to $41_n$ at the timing t1, as shown in FIGS. 12(*b*) and 12(*c*).

That is, the rise of the data pulse Pda to each of the address electrodes $41_1$ to $41_n$ and $42_1$ to $42_n$ is not specified, so that the discharge cells 14 on the address electrodes $\mathbf{41}_1$ to $\mathbf{41}_n$ and the discharge cells on the address electrodes $\mathbf{42}_1$ to $\mathbf{42}_n$ induce address discharges at the same timing in correspondence with timing t3 of application of the write pulse Pw to the scan electrode $\mathbf{12}_k$. Thus, a discharge current DA3 having one peak is generated in the scan electrode $\mathbf{12}_k$.

In this case, the respective discharge currents of the discharge cells 14 on the address electrodes $\mathbf{41}_1$ to $\mathbf{41}_n$ and the discharge cells 14 on the address electrodes $\mathbf{42}_1$ to $\mathbf{42}_n$ simultaneously flow, so that the amplitude AM3 of the discharge current DA3 is increased (FIG. 12(*e*)). Consequently, a large voltage drop E3 is produced in the write pulse Pw applied to the scan electrode $\mathbf{12}_k$ (12(*d*)). As a result, address discharges become unstable, as described above.

In a case where each of the first power recovery circuit 8*a* and the second power recovery circuit 8*b* shown in FIG. 6 is not provided with the recovery potential clamping circuit 80, the data pulse phase difference TR cannot be obtained, so that stable address discharges cannot be ensured.

On the other hand, in the plasma display device 100 according to the present embodiment, each of the first power recovery circuit 8*a* and the second power recovery circuit 8*b* shown in FIG. 6 is provided with the recovery potential clamping circuit 80.

The recovery potential clamping circuit 80 maintains the decrease in the recovery power (the arrow RQ) at a predetermined value. Even in a case where application of the data pulses Pda to the address electrodes $\mathbf{41}_1$ to $\mathbf{41}_n$ and $\mathbf{42}_1$ to $\mathbf{42}_n$ is continued, therefore, the voltage of each of the address electrodes $\mathbf{41}_1$ to $\mathbf{41}_n$ and $\mathbf{42}_1$ to $\mathbf{42}_n$ has a rise portion St for each of the data pulses Pda, as shown in FIGS. 13(*b*) and 13(*c*).

In the same manner as described above, in the plasma display device 100 according to the present embodiment, the timing t1 at which the data pulse Pda is applied to the address electrodes $\mathbf{41}_1$ to $\mathbf{41}_n$ and the timing at which the data pulse Pda is applied to the address electrodes $\mathbf{42}_1$ to $\mathbf{42}_n$ are shifted (FIGS. 13(*b*) and 13(*c*)).

Te voltage of each of the address electrodes $\mathbf{41}_1$ to $\mathbf{41}_n$ and $\mathbf{42}_1$ to $\mathbf{42}_n$ has the rise portion St for each of the data pulses Pda, so that the data pulse phase difference TR can be obtained. That is, a difference between the voltage of each of the address electrodes $\mathbf{41}_1$ to $\mathbf{41}_n$ and $\mathbf{42}_1$ to $\mathbf{42}_n$ and the voltage of the write pulse Pw shown in FIG. 2 applied to the scan electrodes $\mathbf{12}_1$ to $\mathbf{12}_m$ exceeds a voltage value required for address discharges for each rise portion St.

Consequently, the respective discharge currents of the discharge cells 14 on the address electrodes $\mathbf{41}_1$ to $\mathbf{41}_n$ and the discharge cells 14 on the address electrodes $\mathbf{42}_1$ to $\mathbf{42}_n$ flow at timings shifted by the data pulse phase difference TR in the scan electrode $\mathbf{12}_k$ (k is an arbitrary integer of 1 to m) to which the write pulse Pw is applied in correspondence with the data pulse Pda applied to the address electrodes $\mathbf{41}_1$ to $\mathbf{41}_n$ at the timing t1, as shown in FIGS. 13(*b*) and 13(*c*).

Consequently, the discharge cells 14 on the address electrodes $\mathbf{41}_1$ to $\mathbf{41}_n$ induce address discharges at the timing t1, and the discharge cells 14 on the address electrodes $\mathbf{42}_1$ to $\mathbf{42}_n$ induce address discharges at the timing t2. Thus, a discharge current DA4 having two peaks is generated in the scan electrode $\mathbf{12}_k$.

In this case, the respective discharge currents of the discharge cells 14 on the address electrodes $\mathbf{41}_1$ to $\mathbf{41}_n$ and the discharge cells 14 on the address electrodes $\mathbf{42}_1$ to $\mathbf{42}_n$ flow at timings shifted by the data pulse phase difference TR in the scan electrode $\mathbf{12}_k$, so that the amplitude AM4 of the discharge current DA4 is reduced (FIG. 13(*e*)). Consequently, a voltage drop E4 produced in the write pulse Pw applied to the scan electrode $\mathbf{12}_k$ is reduced (13(*d*)). As a result, address discharges become stable.

In the plasma display device 100 according to the present embodiment, each of the first power recovery circuit 8*a* and the second power recovery circuit 8*b* is provided with the recovery potential clamping circuit 80, so that the data pulses Pda each having the rise portion St can be applied to the address electrodes $\mathbf{41}_1$ to $\mathbf{41}_n$ and $\mathbf{42}_1$ to $\mathbf{42}_n$. As a result, the data pulse phase difference TR can be obtained, so that stable address discharges can be ensured.

Figure 14:
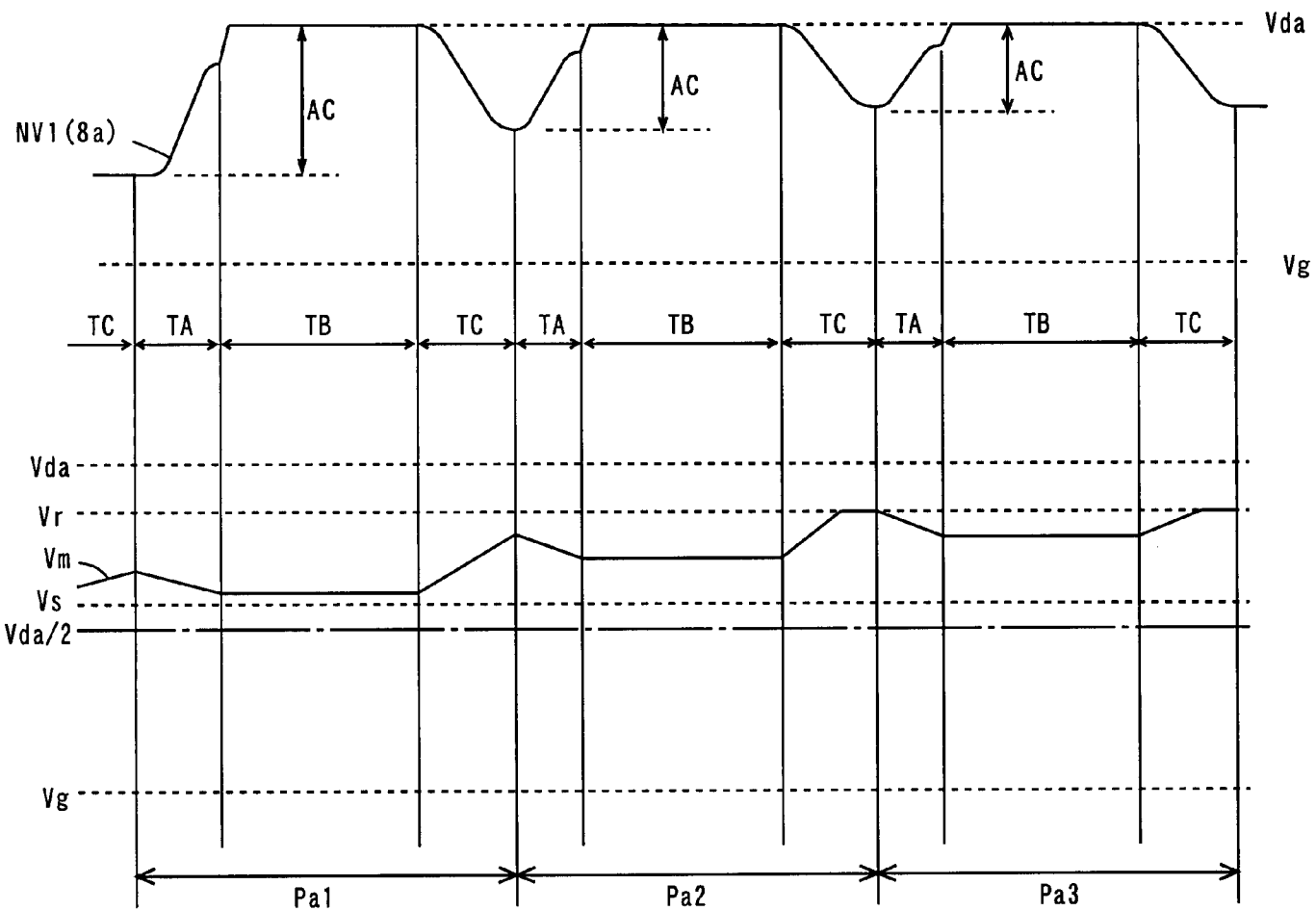
FIG. 14 is a diagram showing the change in a recovery potential at a node N3 shown in FIG. 6 in a write time period.

The change in the recovery potential Vm at the node N3 shown in FIG. 6 will be then described. FIG. 14 is a waveform diagram showing the change in the recovery potential Vm at the node N3 shown in FIG. 6 in the write time period.

FIG. 14 shows the change in the recovery potential Vm, together with the change in the voltage NV1 at the node N1 shown in FIG. 6. In the following description, pulse time periods Pa1, Pa2, and Pa3 indicated by arrows Pa1, Pa2, and Pa3 respectively include time periods TA, TB, and TC.

In the time period TA in the pulse time period Pal, the recovery potential Vm is lowered by discharging the charges into the stray capacitance Cf and the panel capacitance Cp from the recovery capacitor C1. In the time period TB, the recovery potential Vm is maintained at a predetermined value. Thereafter, in the time period TC, the charges stored in the stray capacitance Cf and the panel capacitance Cp are recovered in the recovery capacitor C1, so that the value of the recovery potential Vm is raised.

The rise in the recovery potential Vm varies with the quantity of the charges recovered from the stray capacitance Cf and the panel capacitance Cp.

In the time period TA in the pulse time period Pa2, the recovery potential Vm is lowered again by discharging the charges to the stray capacitance Cf and the panel capacitance Cp from the recovery capacitor C1. In the time period TB, the recovery potential Vm is maintained at a predetermined value. Thereafter, in the time period TC, the charges stored in the stray capacitance Cf and the panel capacitance Cp are recovered again in the recovery capacitor C1, so that the value of the recovery potential Vm is raised.

Here, when the rise in the recovery potential Vm exceeds a limit voltage Vt, the recovery potential Vm is fixed to the limit voltage Vr by the function of the recovery potential clamping circuit 80 shown in FIG. 6. The change in the recovery potential Vm in the pulse time period Pa2 is carried out similarly in the pulse time period Pa3.

In each of the pulse time periods, when a state where the charges recovered in the recovery capacitor C1 in the time period TC are smaller than the charges discharged from the recovery capacitor C1 in the time period TA is continued, the recovery potential Vm is successively lowered for each of the pulse time periods. The minimum value of the recovery potential Vm in this case is taken as the minimum recovery potential Vs. The minimum recovery potential Vs becomes a value larger by one-second the power supply voltage Vda applied to the power supply terminal V1 shown in FIG. 6.

Figure 15:
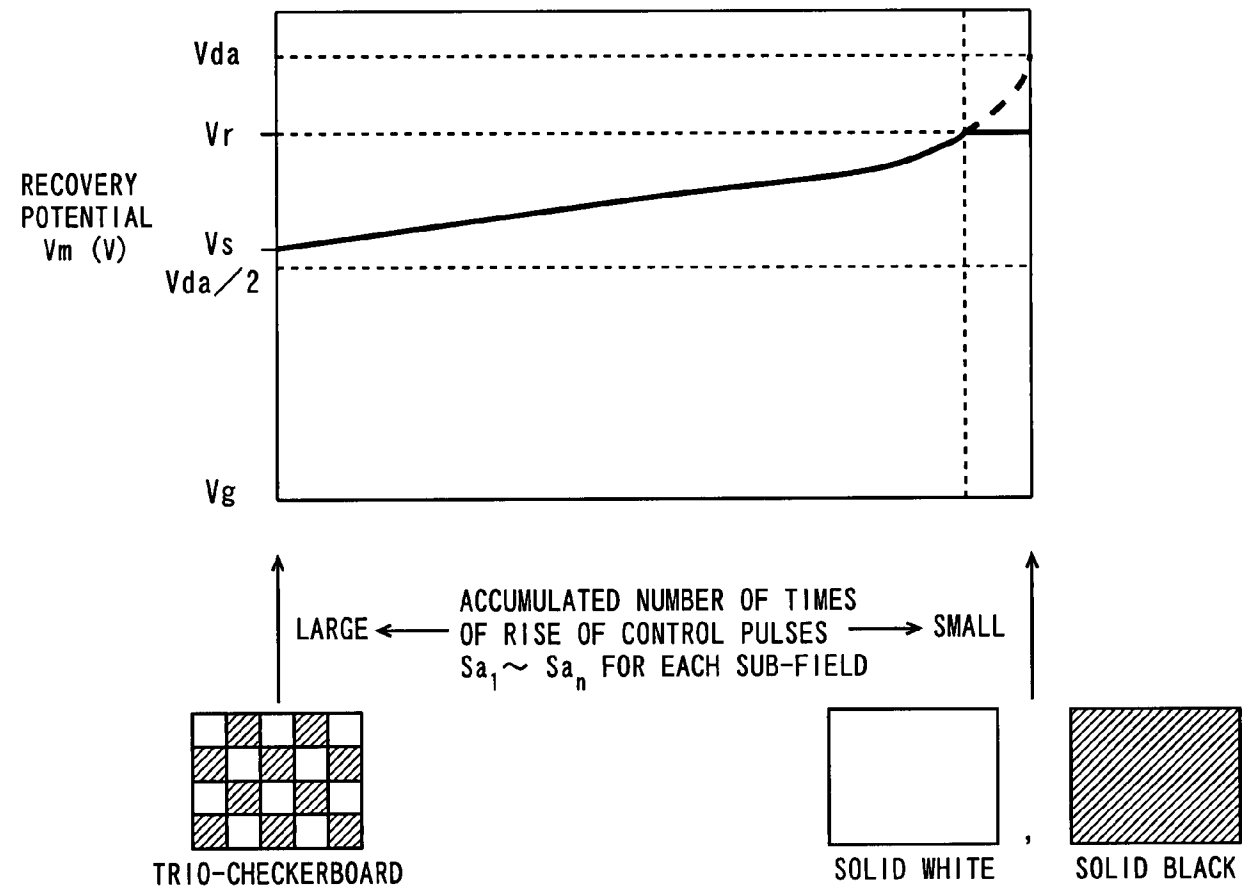
FIG. 15 is a graph showing the relationship between the recovery potential shown in FIG. 14 and the accumulated number of times of rise of control pulses for each sub-field.

FIG. 15 is a graph showing the relationship between the recovery potential Vm shown in FIG. 14 and the accumulated number of times of rise of the control pulses $Sa_1$ to $Sa_n$ for each sub-field. In FIG. 15, the vertical axis indicates the recovery potential Vm for each sub-field, and the horizontal axis indicates the accumulated number of times of rise of the control pulses $Sa_1$ to $Sa_n$ for each sub-field.

Here, the accumulated number of times of rise means the accumulated number of times of rise of the control pulses $Sa_1$ to $Sa_n$. In other words, the accumulated number of times of rise indicates the number of times of switching between discharges and non-discharges of the plurality of discharge cells 14 in the PDP 7 shown in FIG. 1. The recovery potential Vm varies depending on the accumulated number of times of rise of the control pulses $Sa_1$ to $Sa_n$.

When the PDP 7 displays "solid white" or "solid black", the accumulated number of times of rise of the control pulses $Sa_1$ to $Sa_n$ reaches its minimum because discharges or non-discharges of the discharge cells 14 are continued without being switched. When the accumulated number of times of rise of the control pulses $Sa_1$ to $Sa_n$ is thus small, the recovery potential Vm is converged on the power supply voltage Vda. Consequently, the recovery potential Vm is raised, so that circuit losses in the first and second groups of data drivers 4*a* and 4*b* are reduced depending on the accumulated number of times of rise.

In the present embodiment, the recovery potential Vm does not exceed the limit voltage Vr by the function of the recovery potential clamping circuit 80 shown in FIG. 6. When the recovery potential Vm becomes the limit voltage Vr, a change AC, centered at the limit voltage Vr, occurs in the voltage NV1, as described above.

The recovery potential clamping circuit 80 limits the recovery potential Vm to the limit voltage Vr, so that the data pulse phase difference TR, as described in FIGS. 12 and 13, can be obtained. The peak of the discharge current flowing in the scan electrode 12 is reduced by the effect of the data pulse phase difference TR, so that the discharges of each of the discharge cells 14 in a case where the data pulse Pda is continuously applied to the address electrodes $\mathbf{41}_1$ to $\mathbf{41}_n$ are stably induced.

When the PDP 7 displays a "trio-checkerboard", the accumulated number of times of rise of the control pulses $Sa_1$ to $Sa_n$ reaches its maximum because discharges and non-discharges are switched among all the discharge cells 14. When the accumulated number of times of rise is large, the recovery potential Vm is converged on the minimum recovery potential Vs having a predetermined value. As shown in FIG. 15, the minimum recovery potential Vs assumes a value slightly higher than one-second the power supply potential Vda.

When the write time period P2 in each of the sub-fields shown in FIG. 3 is terminated, power recovered in the first power recovery circuit 8*a* and the second power recovery circuit 8*b* is used for a write time period in the subsequent sub-field without being reset. Thus, the recovery potential Vm produced by the recovery capacitor C1 is gradually discharged in a time period other than the write time period P2.

A charge pump circuit contained in the first power recovery circuit 8*a* shown in FIG. 6 will be described. As described in the foregoing, the charge pump circuit is contained in the first power recovery circuit 8*a* shown in FIG. 6.

Figure 16:
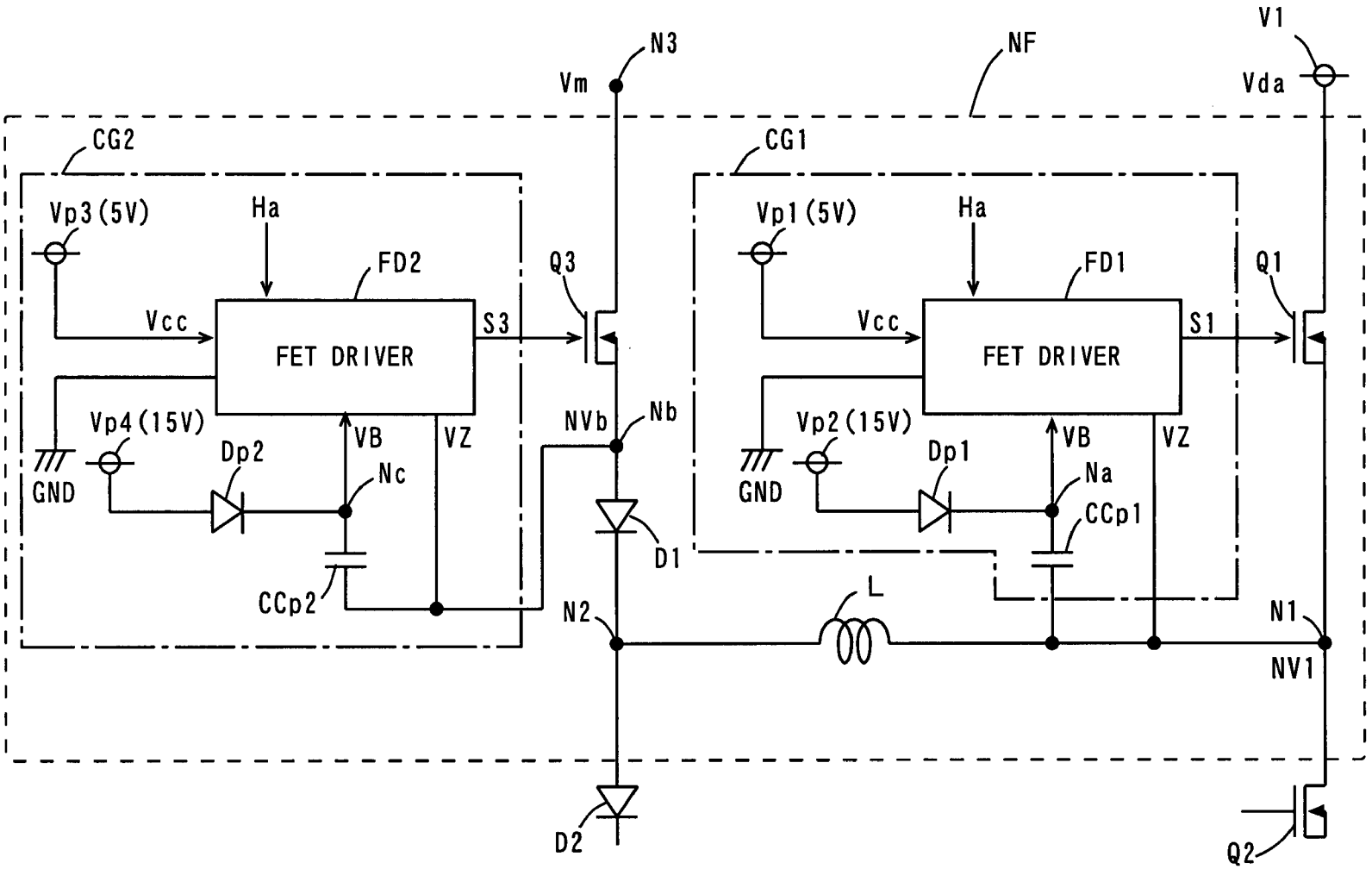
FIG. 16 is a circuit diagram showing an example of a charge pump circuit provided in a first power recovery circuit shown in FIG. 6.

FIG. 16 is a circuit diagram showing an example of the charge pump circuit provided in the first power recovery circuit 8*a* shown in FIG. 6. FIG. 16 shows the detailed configurations of charge pump circuits CG1 and CG2 provided in a range indicated by a broken line NF shown in FIG. 6. The charge pump circuits CG1 and CG2 are used for controlling control signals S1 and S3 to be applied to the respective gates of transistors Q1 and Q3.

In FIG. 16, the charge pump circuit CG1 comprises a diode Dp1, a capacitor CCp1, and a field effect transistor (hereinafter abbreviated as FET) driver FD1. The charge pump circuit CG2 comprises a diode Dp2, a capacitor CCp2, and an FET driver FD2.

In FIG. 16, the FET driver FD1 is connected to the sub-field processor 3 shown in FIG. 1, a power supply terminal Vp1, a ground terminal, nodes N1 and Na, and the transistor Q1. The diode Dp1 is connected between a power supply terminal Vp2 and a node Na, and the capacitor CCp1 is connected between a node N1 and the node Na.

The FET driver FD2 is connected to the sub-field processor 3 shown in FIG. 1, a power supply terminal Vp3, a ground terminal, nodes Nb and Nc, and the transistor Q3. The diode Dp2 is connected between a power supply terminal Vp4 and the node Nc, and the capacitor CCp2 is connected between the node Nb and the node Nc.

The operations of the charge pump circuit CG1 will be then described. In the following description, the transistor Q1 shall be turned on when a voltage higher by about 15 V than a voltage at its source is applied to the gate thereof. A voltage of 5 V is applied to the power supply terminal Vp1, and a voltage of 15 V is applied to the power supply terminal Vp2.

To the FET driver FD1, the voltage at the power supply terminal Vp1 is applied as a power supply voltage Vcc, a voltage at the node N1 is applied as a reference voltage VZ, and a voltage at the node Na is applied to a bias voltage VB. Further, a power recovery circuit control signal Ha is fed from the sub-field processor 3 shown in FIG. 1 to the FET driver FD1.

The operations of the charge pump circuit CG1 in a time period other than the write time period P2 shown in FIG. 2 will be described. In this case, the transistor Q2 shown in FIG. 6 is turned on. Thus, the node N1 is connected to the ground terminal, so that a voltage NV1 at the node N1 becomes a ground potential. Consequently, the voltage at the node Na becomes higher than the voltage NV1 at the node N1, so that charges are stored in the capacitor CCp1 by a power supply voltage of 15 V applied to the power supply terminal Vp2. As a result, the bias voltage VB of about 15 V is generated at the node Na.

The operations of the charge pump circuit CG1 in the write time period P2 will be described. In the write time period P2, the voltage NV1 at the node N1 is changed, as shown in FIG. 7.

In this case, to the FET driver FD1, the voltage NV1 is applied as the reference voltage VZ from the node N1, and the bias voltage VB of about 15 V based on the charges stored in the capacitor CCp1 is applied in a time period other than the write time period P2.

The FET driver FD1 raises the control signal S1 to a level higher by the bias voltage VB than the reference voltage VZ (a high level) on the basis of the power recovery circuit control signal Ha in the time period TB shown in FIG. 7. As a result, a voltage at the gate of the transistor Q1 becomes higher by about 15 V than a voltage at the source thereof, so that the transistor Q1 is turned on.

The operations of the charge pump circuit CG2 will be then described. In the following description, the transistor Q3 shall be turned on when a voltage higher by about 15 V than the voltage at its source is applied to the gate thereof. A voltage of 5 V is applied to the power supply terminal Vp3, and a voltage of 15 V is applied to the power supply terminal Vp4.

To the FET driver FD2, the voltage at the power supply terminal Vp3 is applied as a power supply voltage Vcc, a voltage at the node Nb is applied as a reference voltage VZ, and a voltage at the node Nc is applied to the bias voltage VB. Further, a power recovery circuit control signal Ha is fed from the sub-field processor 3 shown in FIG. 1 to the FET driver FD2.

The operations of the charge pump circuit CG2 in a time period other than the write time period P2 shown in FIG. 2 will be described. In this case, the transistor Q2 shown in FIG. 6 is turned on. Thus, the node N1 is connected to the ground terminal, so that the voltage NV1 at the node N1 becomes a ground potential. Consequently, the voltage NV2 at the node N2 becomes a ground potential, and a potential NVb at the node Nb becomes a ground potential. Since the voltage at the node Nc is higher than the voltage NVb at the node Nb, so that charges are stored in the capacitor CCp2 by a power supply voltage of 15 V applied to the power supply terminal Vp4. As a result, the bias voltage VB of about 15 V is generated at the node Nc.

The operations of the charge pump circuit CG2 in the write time period P2 will be described. In the write time period P2, the voltage NVb at the node Nb is changed.

In this case, to the FET driver FD2, the voltage NVb is applied as the reference voltage VZ from the node Nb, and the bias voltage VB of about 15 V based on the charges stored in the capacitor CCp2 is applied in the time period other than the write time period P2.

The FET driver FD2 raises the control signal S3 to a level higher by the bias voltage VB than the reference voltage VZ (a high level) on the basis of the power recovery circuit control signal Ha in the time period TA shown in FIG. 7. As a result, a voltage at the gate of the transistor Q3 becomes higher by about 15 V than the voltage NVb at the source thereof, so that the transistor Q3 is turned on.

The charge pump circuits CG1 and CG2 are thus used, thereby allowing the transistors Q1 and Q3 to be reliably turned on even if the voltages at the nodes N1 and N2 are changed.

Conditions under which the discharge cells 14 shown in FIG. 1 are stably discharged are determined on the basis of the relationship between a write voltage and a sustain voltage. The write voltage means a voltage applied between an address electrode and a scan electrode that are selected for address discharges, and a difference between a voltage of the data pulse Pda shown in FIG. 2 applied to the address electrodes $41_1$ to $41_n$ and $42_1$ to $42_n$ shown in FIG. 1 and a voltage of the write pulse Pw shown in FIG. 2 applied to the scan electrodes $12_1$ to $12_m$ in the write time period P2 shown in FIG. 2.

The sustain voltage means a voltage applied between each of scan electrodes and each of sustain electrodes for sustain discharges, and a difference between a voltage of the sustain pulse Psc shown in FIG. 2 applied to the sustain electrodes $12_1$ to $12_m$ and a voltage of the sustain pulse Psu shown in FIG. 2 applied to the sustain electrodes $13_1$ to $13_m$, and a difference between a voltage of the sustain pulse Psu shown in FIG. 2 applied to the sustain electrodes $13_1$ to $13_m$ and a voltage of each of the scan electrodes $12_1$ to $12_m$.

The respective ranges of the write voltage and the sustain voltage that are allowed in order to stably discharge the discharge cells 14 on the PDP 7 shown in FIG. 1 are referred to as a driving margin. When a voltage drop E2 of the write pulse Pw is reduced by the data pulse phase difference TR, as described in FIG. 5, the driving margin is enlarged. The relationship between the enlargement of the driving margin and the magnitude of the data pulse phase difference TR will be described.

Figure 17:
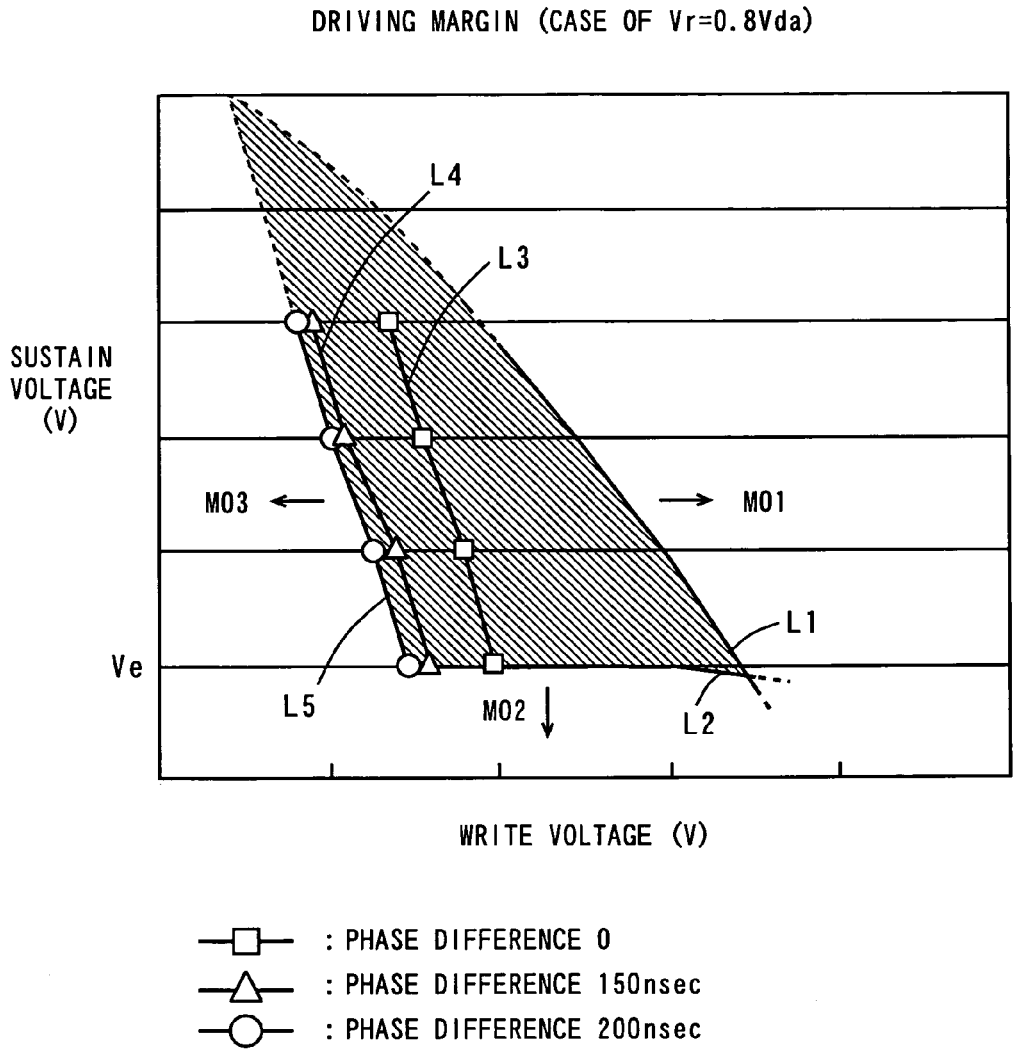
FIG. 17 is a graph for explaining the relationship between a driving margin of the plasma display device shown in FIG. 1 and a data pulse phase difference.

FIG. 17 is a graph for explaining the relationship between a driving margin of the plasma display device shown in FIG. 1 and a data pulse phase difference. In the graph shown in FIG. 17, the horizontal axis indicates a write voltage, and the vertical axis indicates a sustain voltage. The driving margin shown in FIG. 17 is one in a case where the limit voltage Vr shown in FIG. 15 is set to 0.8 times the power supply voltage Vda.

In FIG. 17, when a write voltage and a sustain voltage that exceed a curve L1 are applied to the PDP 7 shown in FIG. 1, the discharge cell that is not selected may be erroneously discharged only by the sustain voltage. The respective ranges of the write voltage and the sustain voltage that exceed the curve L1 are ranges indicated by an arrow MO1. When the write voltage and the sustain voltage that exceed the curve L1 displays an image in "solid black", parts of the discharge cells 14 are erroneously discharged, so that an image is degraded.

In FIG. 17, when a sustain voltage lower than a curve L2 is applied to the PDP 7 shown in FIG. 1, the selected discharge cell 14 may not be sufficiently discharged. The respective ranges of a write voltage and the sustain voltage that are lower than the curve L2 are ranges indicated by an arrow MO2. When the sustain voltage lower than the curve L2 displays an image in "solid white", parts of the discharge cells 14 are not discharged, so that an image flickers.

The driving margin of the plasma display device 100 shown in FIG. 1 is determined by the curves L1 and L2 and the data pulse phase difference TR shown in FIG. 5.

The result of measuring for each particular sustain voltage a write voltage that is minimum required to stably discharge the discharge cells 14 in a case where the data pulse phase difference TR is zero is indicated by a curve L3.

The result of measuring for each particular sustain voltage a write voltage that is minimum required to stably discharge the discharge cells 14 in a case where the data pulse phase difference TR is 150 ns is indicated by a curve L4.

Furthermore, the result of measuring for each particular sustain voltage a write voltage that is minimum required to stably discharge the discharge cells 14 in a case where the data pulse phase difference TR is 200 ns is indicated by a curve L5.

As shown in FIG. 17, the write voltage that is minimum required to stably discharge the discharge cells 14 is lowered as the data pulse phase difference TR increases. That is, the peak of the discharge current flowing in the scan electrode can be reduced, as shown in FIG. 5, by increasing the data pulse phase difference TR, so that the lower limit value of the write voltage required to induce discharges can be reduced. Consequently, the range of the write voltage that is allowed in order to stably discharge the discharge cells 14 is widened.

From the results shown in FIG. 17, when the data pulse phase difference TR is set to zero, the driving margin is a range surrounded by the curves L1, L2, and L3. When the data pulse phase difference TR is set to 150 ns, the driving margin is a range surrounded by the curves L1, L2, and L4. Further, when the data pulse phase difference TR is set to 200 ns, the driving margin is a range surrounded by the curves L1, L2, and L5. This proves that the larger the data pulse phase difference TR is, the more the driving margin is enlarged. In the present embodiment, it is desirable that the data pulse phase difference TR is not less than about 200 ns. However, this will be described later.

In FIG. 17, in a range indicated by an arrow MO3, there is a case where a sufficient write voltage cannot be obtained with respect to the sustain voltage, so that the discharge cell 14 may not, in some cases, be sufficiently discharged. In a case where an image in "solid white" is displayed at a write voltage lower than the curve L5, parts of the discharge cells 14 are not discharged, so that an image flickers.

In the present embodiment, it is desirable that the data pulse phase difference TR shown in FIG. 5 is set in the following manner.

Figure 18:
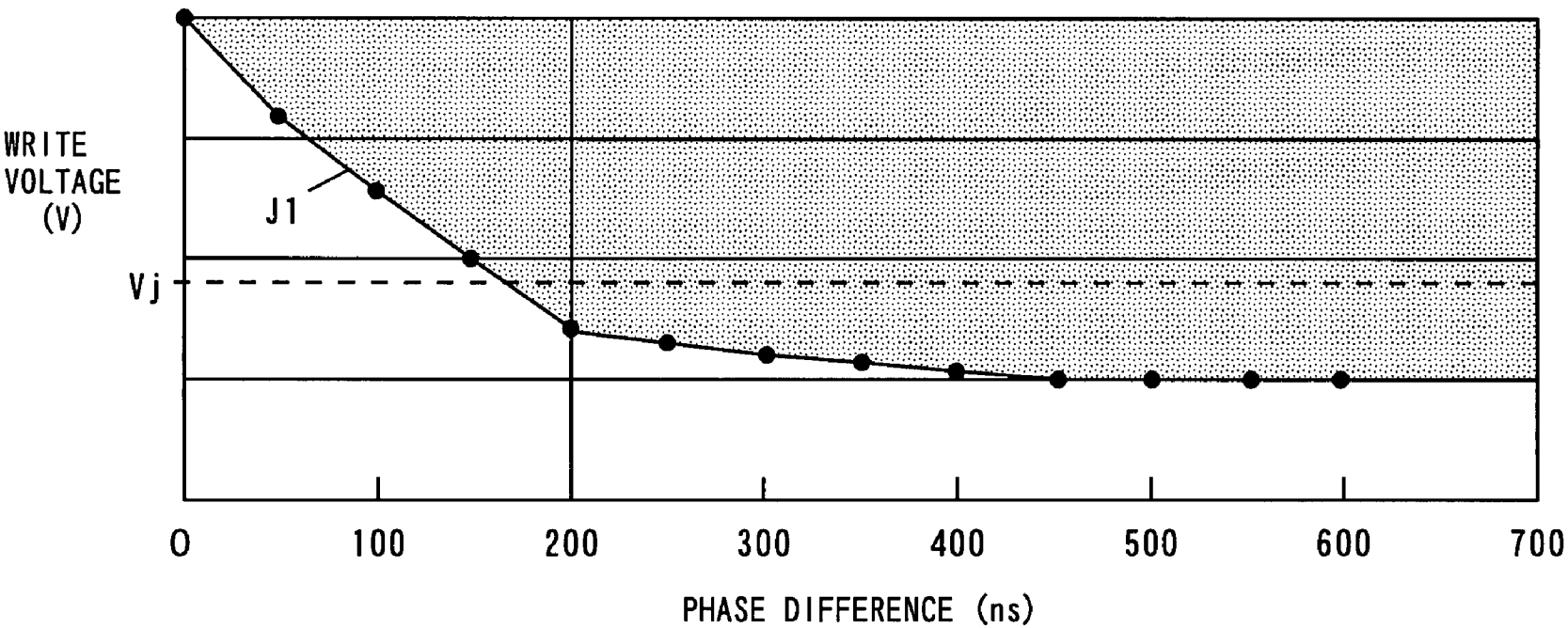
FIG. 18 is a graph showing the relationship between a write voltage and a phase difference in a case where an image in "solid white" is displayed.

FIG. 18 is a graph showing the relationship between a write voltage and a phase difference in a case where an image in "solid white" is displayed. The vertical axis indicates a write voltage, and the horizontal axis indicates a data pulse phase difference TR.

In FIG. 18, a solid line J1 indicates a lower limit value of a write voltage at which stable discharges of the discharge cells 14 shown in FIG. 1 can be obtained in a case where a sustain voltage is taken as a predetermined voltage value Ve (see FIG. 17) and the limit voltage Vr is taken as 0.8 Vda (Vda is the same as the power supply voltage Vda shown in FIG. 6). Consequently, stable discharges of the discharge cells 14 can be obtained within a range indicated by hatching shown in FIG. 18.

When the data pulse phase difference TR indicated by the horizontal axis is paid attention to, the lower limit value of the write voltage is much lower than a write voltage having a voltage value Vj (indicted by a broken line in FIG. 18) conventionally generally used. In the plasma display device 100 according to the present embodiment, therefore, it is desirable that the data pulse phase difference TR is not less than about 200 ns.

Figure 19:
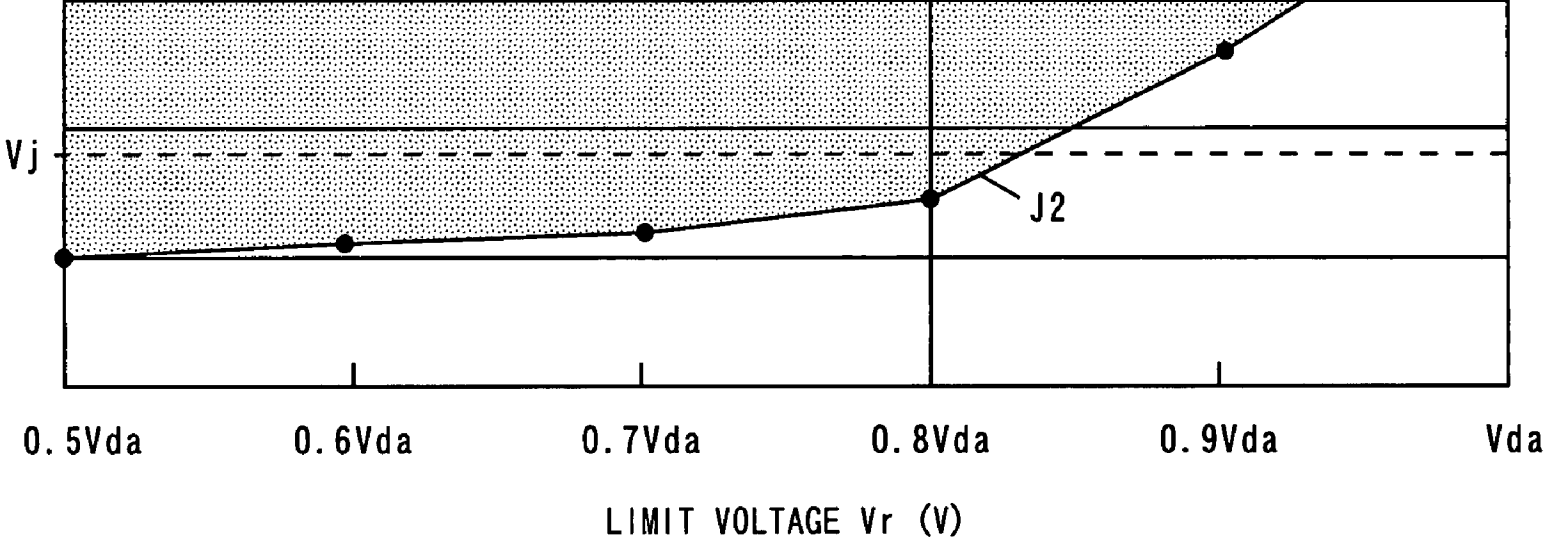
FIG. 19 is a graph showing the relationship between a write voltage and a limit voltage in a case where an image in "solid white" is displayed.

FIG. 19 is a graph showing the relationship between a write voltage and a limit voltage Vr in a case where an image in "solid white" is displayed. The vertical axis indicates a write voltage, and the horizontal axis indicates a limit value Vr.

In FIG. 19, a solid line J2 indicates a lower limit value of a write voltage at which stable discharges of the discharge cells 14 shown in FIG. 1 can be obtained in a case where a sustain voltage is taken as a predetermined voltage value Ve (see FIG. 17) and the data pulse phase difference TR shown in FIG. 5 is taken as 200 ns. Consequently, stable discharges of the discharge cells 14 can be obtained within a range indicated by hatching shown in FIG. 19.

When the limit voltage Vr indicated by the horizontal axis is paid attention to, the lower limit value of the write voltage is much lower than a write voltage having a voltage value Vj (indicted by a broken line in FIG. 18) conventionally generally used in a case where the limit voltage Vr is set to a voltage lower than about 0.8 Vda.

Consequently, in the plasma display device 100 according to the present embodiment, it is desirable that the limit voltage Vr is not more than about 0.8 Vda. It is desirable that the limit voltage Vr is set to a voltage from about 0.5 Vda to about 0.8 Vda, and it is more desirable that the limit value Vr is set to about 0.8 Vda.

Since the lower limit value of the write voltage required to stably discharge the discharge cells 14 is enlarged by thus setting the data pulse phase difference TR and the limit voltage Vr, the write voltage can be reduced while ensuring the stable discharges of the discharge cells 14.

Description is made of power consumption in the address time period of the plasma display device 100 according to the present embodiment. Here, the power consumption in this example is power consumed by applying the data pulse Pda to the address electrodes $41_1$ to $41_n$ and $42_1$ to $42_n$. The power consumption corresponds to a circuit loss indicated by an arrow LQ shown in FIGS. 9 to 11.

Figure 20:
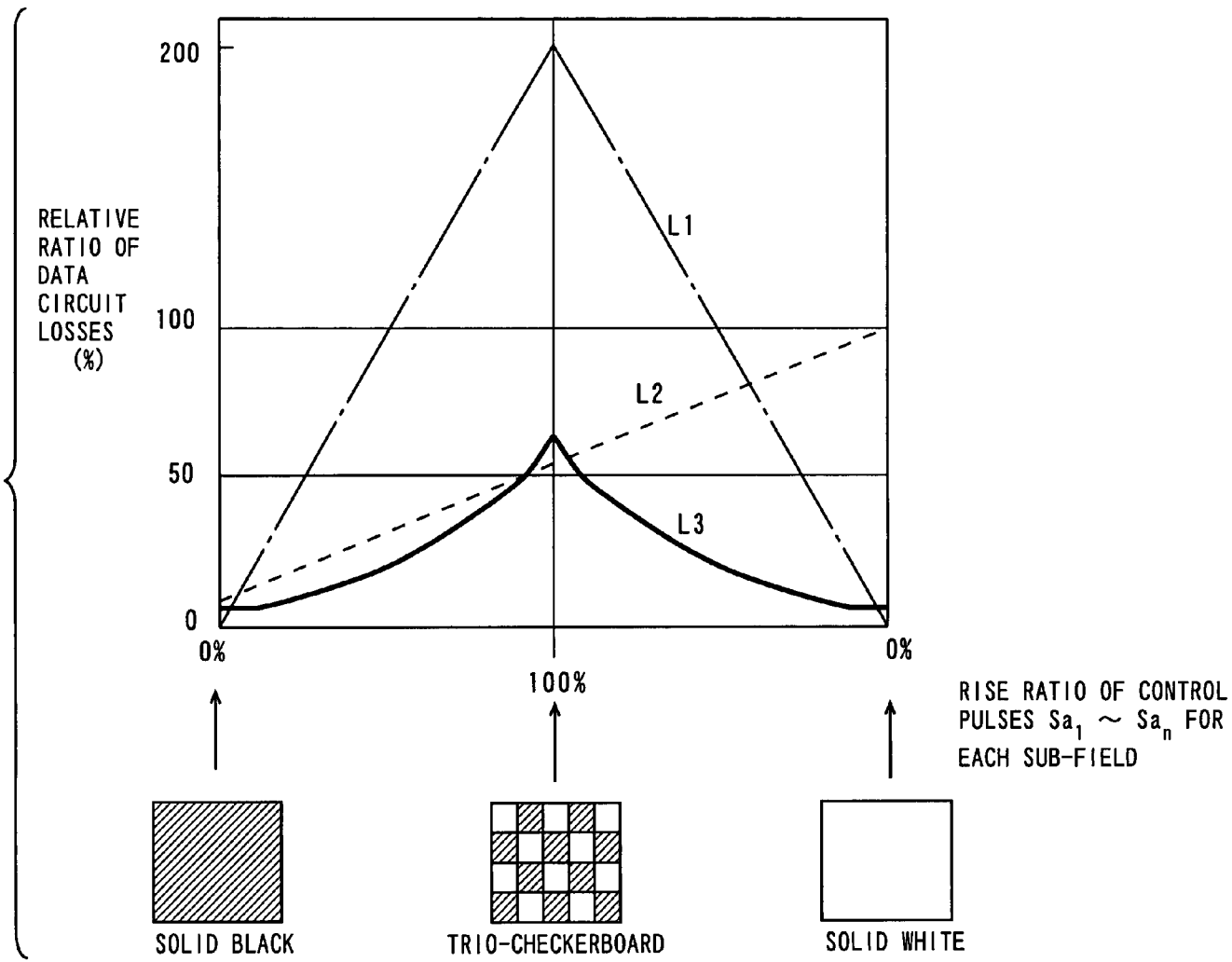
FIG. 20 is a graph for comparing power consumption in the plasma display device according to the first embodiment with power consumption in a plasma display device having another configuration.

FIG. 20 is a graph for comparing power consumption in the plasma display device 100 according to the first embodiment with power consumption in a plasma display device having another configuration.

Figure 33:
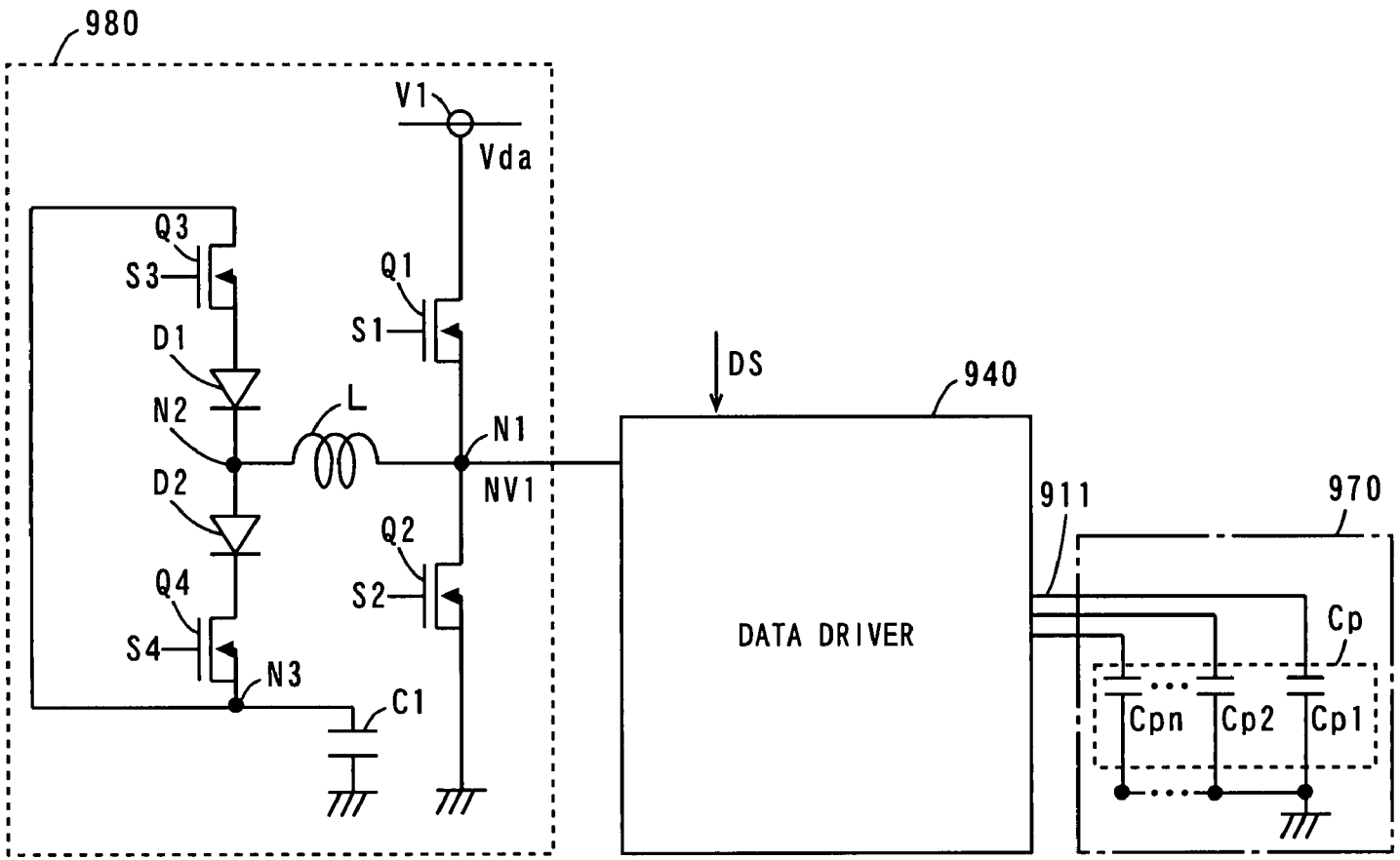
FIG. 33 PRIOR ART
FIG. 33 is a circuit diagram showing an example of a conventional power recovery circuit.
Figure 34:
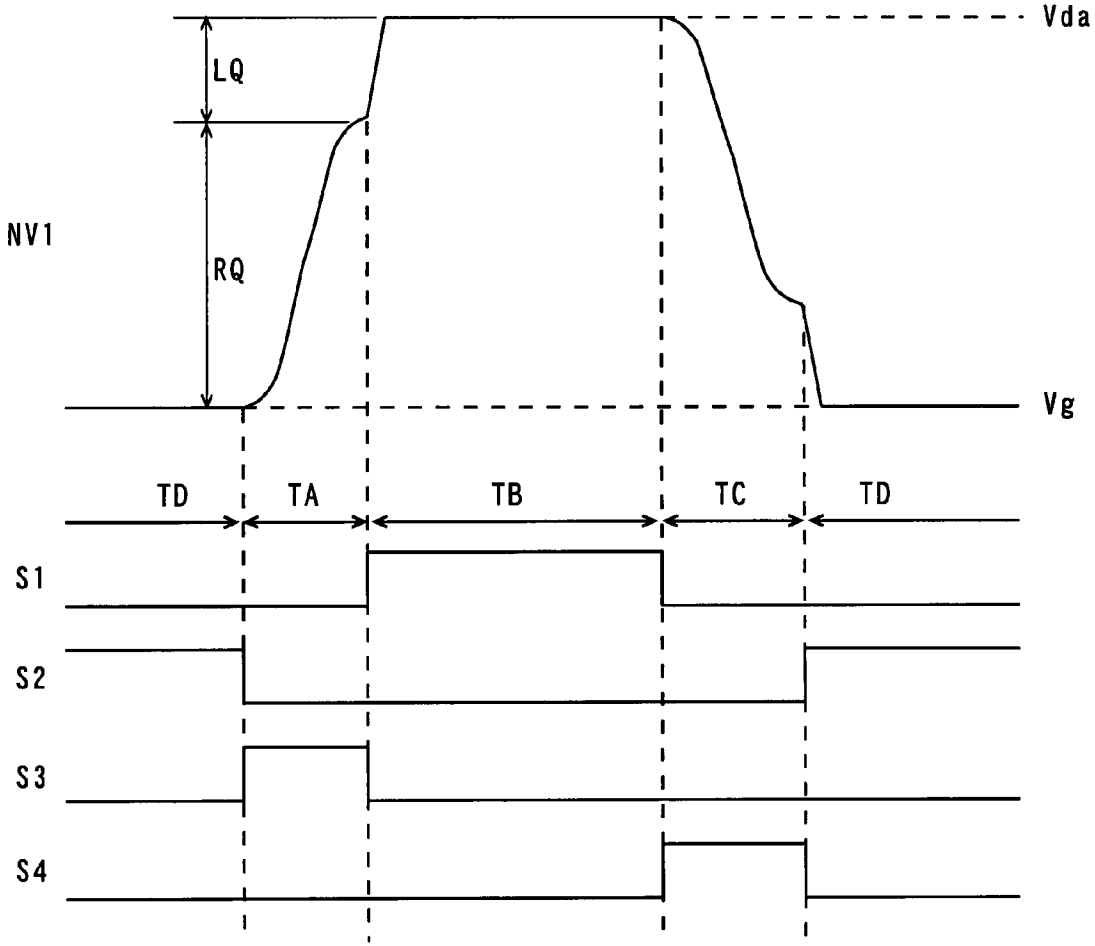
FIG. 34 PRIOR ART
FIG. 34 is a timing chart showing the operations in a write time period of the power recovery circuit shown in FIG. 33.
Figure 35:
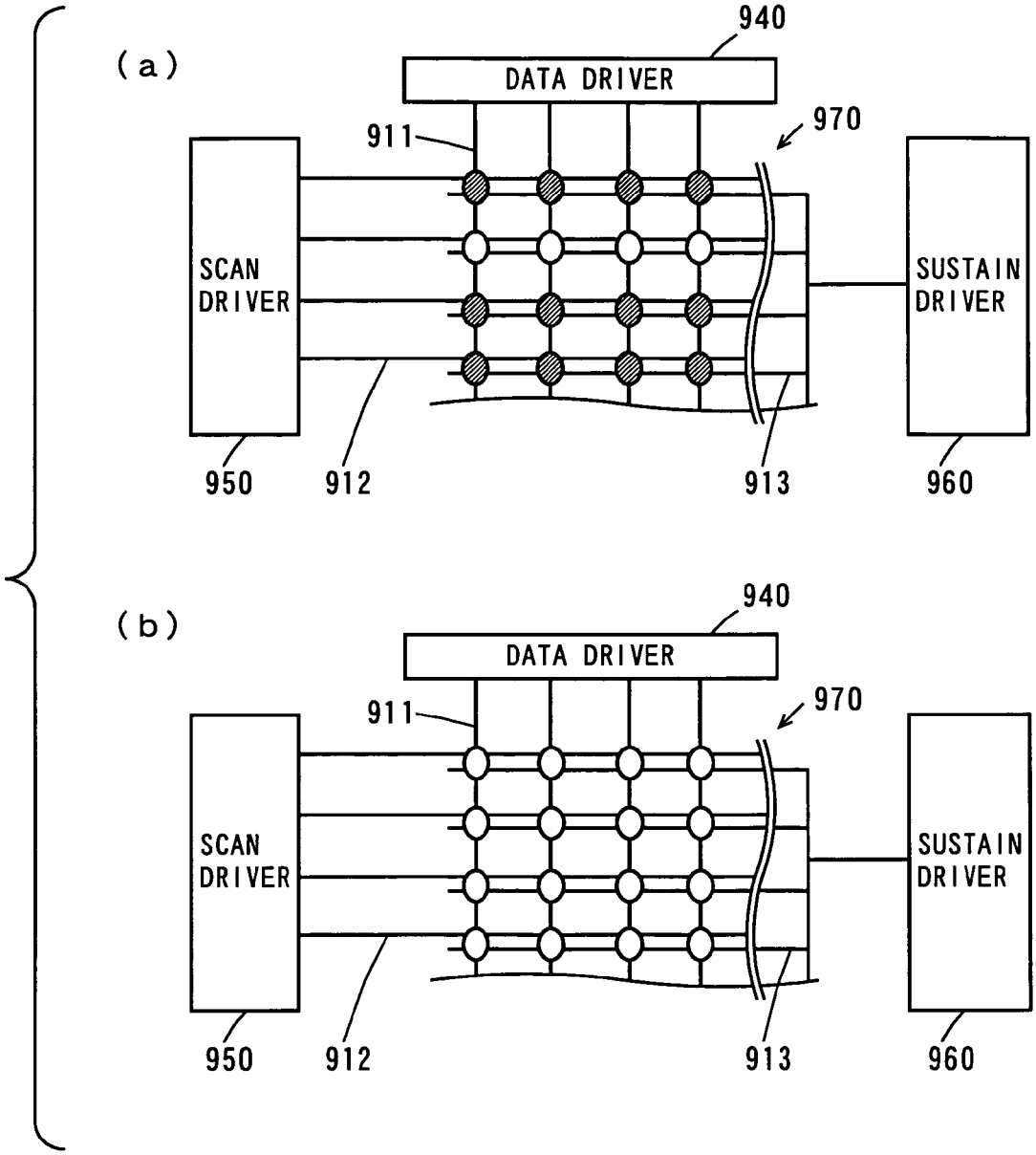
FIG. 35 PRIOR ART
FIG. 35 is a schematic view showing an example of the display state of a PDP.
Figure 36:
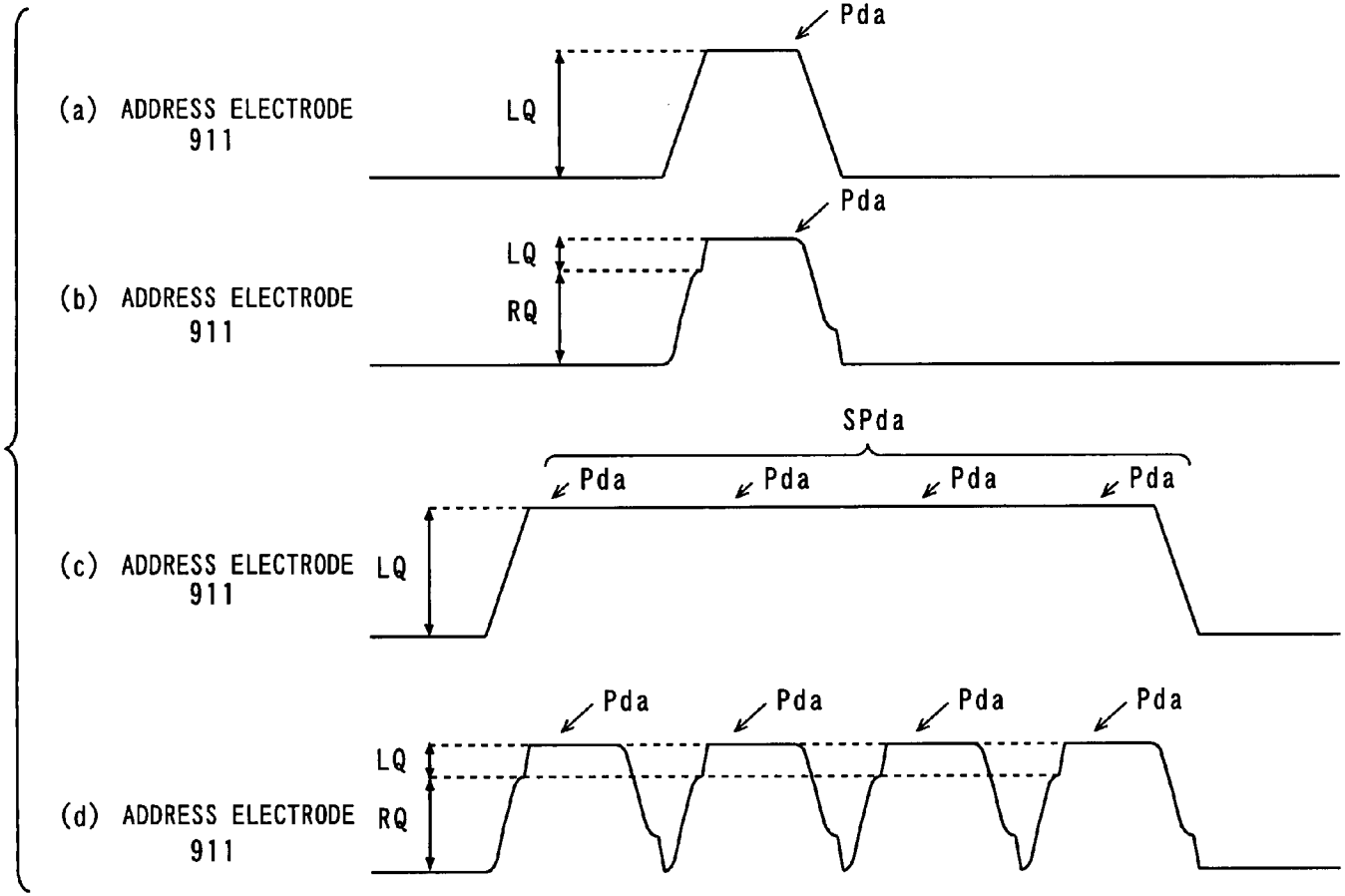
FIG. 36 PRIOR ART
FIG. 36 is a waveform diagram of a data pulse applied to an address electrode in order to obtain the display state shown in FIG. 35.

In this example, as an object to be compared with the plasma display device 100 according to the present embodiment, a conventional plasma display device (referred to as a non-recovery type plasma display device) that does not recover power and a plasma display device (referred to as a conventional recovery type plasma display device) comprising a power recovery circuit 980 shown in FIG. 33 described in the prior art are used. In the following description, the plasma display device 100 according to the first embodiment, the non-recovery type plasma display device, and the conventional recovery type plasma display device have substantially the same configurations except for their parts.

In FIG. 20, the vertical axis indicates a relative ratio of data circuit losses in the group of data drivers 4 and the power recovery circuit 8 in each of the plasma display device 100 according to the first embodiment, the non-recovery type plasma display device, and the conventional recovery type plasma display device. The relative ratio of data circuit losses is the ratio of data circuit losses in the plasma display device 100 according to the first embodiment, the non-recovery type plasma display device, and the conventional recovery type plasma display device in a case where "solid white" display in which the data circuit loss in the conventional recovery type plasma display device reaches its maximum is taken as 100%. The horizontal axis indicates a rise ratio of the control pulses $Sa_1$ to $Sa_n$ for each sub-field. The rise ratio indicates the ratio of the accumulated number of times of rise of the control pulses $Sa_1$ to $Sa_n$ for each sub-field to the maximum number of times the data pulse can rise for the sub-field. In a case where a "trio-checkerboard" is displayed, the accumulated number of times of rise is the largest, so that the ratio of the accumulated numbers of times of rise is 100%.

According to FIG. 20, the maximum value of the relative ratio of data circuit losses in the non-recovery type plasma display device indicated by a one-dot and dash line L1 is 200% (the rise ratio is 100%:"trio-checkerboard" display), assuming that the maximum value of the relative ratio of data circuit losses in the conventional recovery type plasma display devices indicated by a broken line L2 is 100% (the rise ratio is 0%:"solid white" display). On the other hand, the maximum value of the relative ratio of data circuit losses in the plasma display device 100 according to the present embodiment indicated by a thick line L3 is not more than approximately two-third the relative ratio of data circuit losses 100% in the conventional recovery type plasma display device, so that the maximum data circuit loss is significantly reduced.

Even in a case where the data pulse Pda is continuously applied to the address electrodes, for example, in a case of "solid white" display that has been the problem of the data circuit loss in the conventional recovery type plasma display device, the data circuit loss is significantly reduced in the plasma display device 100 according to the present embodiment.

In the plasma display device 100 according to the present embodiment, a data pulse phase difference TR is produced using the first and second groups of data drivers 4*a* and 4*b* and the first and second power recovery circuits 8*a* and 8*b*. Consequently, a voltage (a driving voltage) of the write pulse Pw can be reduced while ensuring the stable discharges of the discharge cells 14, so that a driving margin is enlarged.

Although in the present embodiment, the two groups of data drivers and the two power recovery circuits are used to produce the data pulse phase difference TR, the present invention is not limited to the same. If a plurality of data pulse phase differences TR can be produced, a plurality of groups of data drives and a plurality of power recovery circuits may be further provided.

As described above, the recovery potential Vm at the node N3 shown in FIG. 6 varies depending on the number of times of switching of discharges or non-discharges of the discharge cells 14 every time the voltage NV1 at the node N1 is raised (the data pulse rises). Particularly when the accumulated number of times of rise decreases, the recovery potential Vm is raised. Consequently, the circuit loss is reduced, so that power consumption in the plasma display device 100 can be sufficiently reduced.

The plasma display device 100 according to the present embodiment is provided with the recovery potential clamping circuit 80 shown in FIG. 6. Consequently, the recovery potential Vm at the node N3 shown in FIG. 6 varies every time the voltage NV1 at the node N1 rises (the data pulse rises). However, the recovery potential Vm is controlled so as not to be higher than the limit voltage Vr by the recovery potential clamping circuit 80. Consequently, the recovery potential Vm is not raised to the power supply voltage Vda shown in FIG. 6. Therefore, the data pulse phase difference TR can be produced between the timing at which the data pulse Pda shown in FIG. 2 is applied to the address electrode $\mathbf{41}_1$ to $\mathbf{41}_n$ and the timing at which the data pulse Pda is applied to the address electrode $\mathbf{42}_1$ to $\mathbf{42}_n$.

As a result, the power consumption in the plasma display device 100 can be reduced by the first and second power recovery circuits 8*a* and 8*b*, and a voltage (a driving voltage) of the write pulse Pw can be reduced while ensuring stable discharges of the discharge cells 14 shown in FIG. 1, so that a driving margin is enlarged.

As described in the foregoing, in the present embodiment, the first and second groups of data drivers 4*a* and 4*b* respectively shift the timings at which the data pulses Pda applied to the address electrodes $\mathbf{41}_1$ to $\mathbf{41}_n$ and the address electrodes $\mathbf{42}_1$ to $\mathbf{42}_n$ are outputted so that the data pulse phase difference TR occurs.

If the data pulse phase difference TR can be obtained, however, the sub-field processor 3 may produce the data pulse phase difference TR by shifting the respective timings of the data driver control signal DSa fed to the first group of data drivers 4*a* and the power recovery circuit control signal Ha fed to the first power recovery circuit 8*a* and the respective timings of the data driver control signal DSb fed to the second group of data drivers 4*b* and the power recovery circuit control signal Hb fed to the second power recovery circuit 8*b*.

In addition to that, in order to obtain the data pulse phase difference TR, the first and second groups of data drivers 4*a* and 4*b* may be respectively provided with delay circuits such that the timings at which the data pulses Pda applied to the address electrodes $\mathbf{41}_1$ to $\mathbf{41}_n$ and the address electrodes $\mathbf{42}_1$ to $\mathbf{42}_n$ are outputted differ.

Furthermore, in order to obtain the data pulse phase difference TR, the first and second power recovery circuits 8*a* and 8*b* may be respectively provided with delay circuits that delay power to be fed to the first and second groups of data drivers 4*a* and 4*b*.

The number of the address electrodes $\mathbf{41}_1$ to $\mathbf{41}_n$ connected to the first group of data drivers 4*a* need not be necessarily plural. The number may be one. Similarly with respect to the address electrodes $\mathbf{42}_1$ to $\mathbf{42}_n$ connected to the second group of data drivers 4*b*, the number of the address electrodes $\mathbf{42}_1$ to $\mathbf{41}_n$ connected to the second group of data drivers 4*b* need not be necessarily plural. The number may be one.

Furthermore, although in the present embodiment, the number of address electrodes $\mathbf{41}_1$ to $\mathbf{41}_n$ connected to the first group of data drivers 4*a* and the number of address electrodes $\mathbf{42}_1$ to $\mathbf{42}_n$ connected to the second group of data drivers 4*b* are the same, the present invention is not limited to the same. For example, the respective numbers of address electrodes provided in the first and second groups of data drivers 4*a* and 4*b* may differ from each other.

Second Embodiment

A plasma display device 100 according to a second embodiment has the same configuration and operations as those of the plasma display device 100 according to the first embodiment except for the following points.

In the plasma display device 100 according to the second embodiment, recovery potential clamping circuits 81 respectively provided in a first power recovery circuit 8*a* and a second power recovery circuit 8*b* differ from the configuration of the recovery potential clamping circuit 80 shown in FIG. 6.

Figure 21:
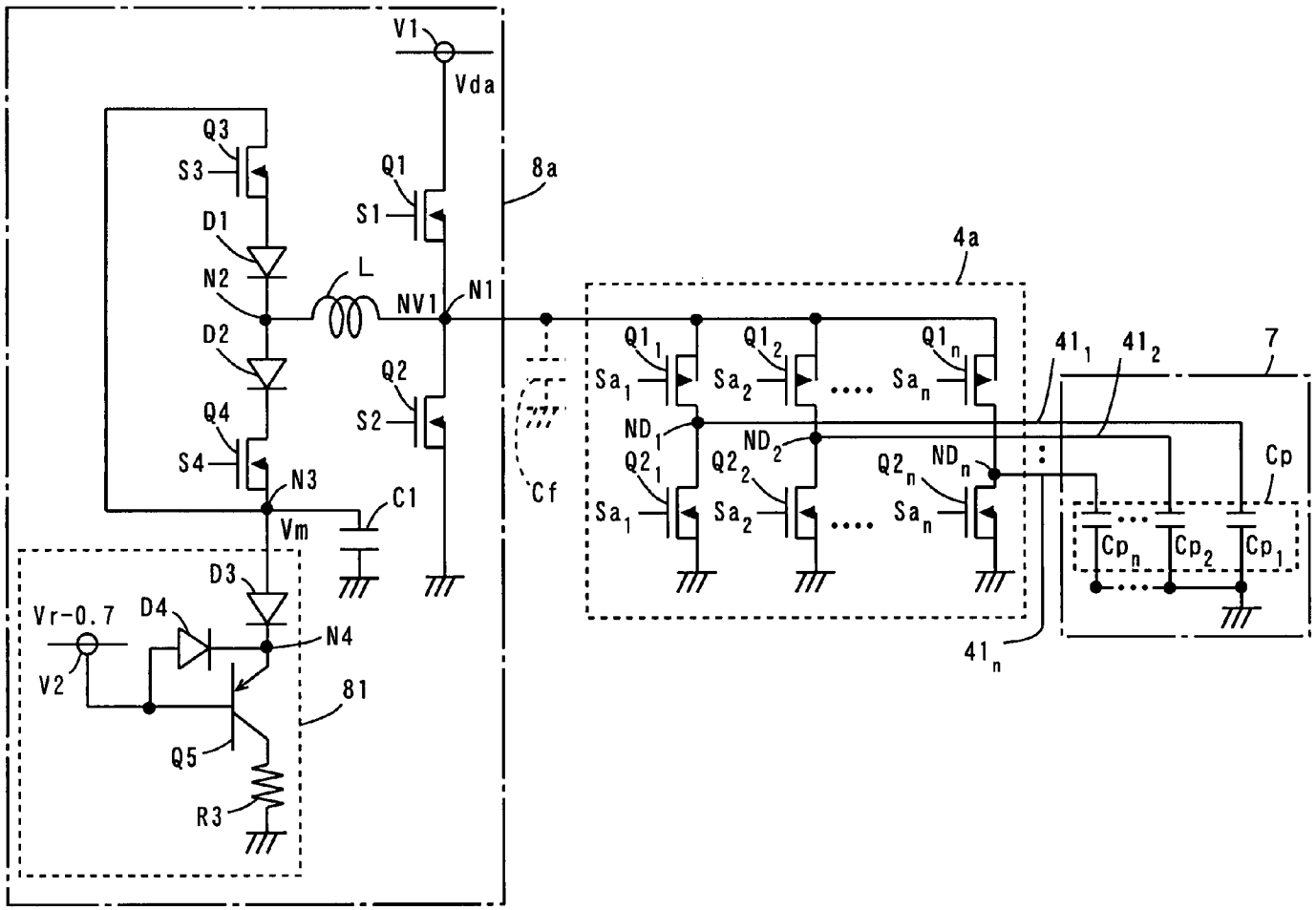
FIG. 21 is a circuit diagram of a first group of data drivers, a first power recovery circuit, and a PDP in a second embodiment.

FIG. 21 is a circuit diagram of a first group of data drivers 4*a*, a first power recovery circuit 8*a*, and a PDP 7 in the second embodiment. In FIG. 21, the recovery potential clamping circuit 81 comprises a resistor R3, diodes D3 and D4, and a bipolar transistor (hereinafter abbreviated as a transistor) Q5.

In the recovery potential clamping circuit 81, the diode D3 is connected between a node N3 and a node N4, the node N4 is connected to the emitter of the transistor Q5, and the collector of the transistor Q5 is connected to a ground terminal through the resistor R3. A power supply terminal V2 is connected to the base of the transistor Q5. The diode D4 is connected between the power supply terminal V2 and the diode D4.

In the time periods TA to TC shown in FIG. 7, the following operations are performed in the recovery potential clamping circuit 81 in the first power recovery circuit 8*a*.

In the recovery potential clamping circuit 81, the limit voltage Vr in the first embodiment is previously applied to the power supply terminal V2. On the other hand, a recovery potential Vm at the node N3 is fed to the node N4. The recovery potential Vm is changed on the basis of the operation of the first group of data drivers 4*a*, described later. Here, a voltage drop produced by the diode D3 is ignored in order to simplify the description.

The transistor Q5 is turned off when the limit voltage Vr at the power supply terminal V2 is not less than a voltage at the node N4, while being turned on when the limit voltage Vr at the power supply terminal V2 is lower than the voltage at the node N4. That is, the transistor Q5 is turned off when the recovery potential Vm at the node N3 is not more than the limit voltage Vr, while being turned on when the recovery potential Vm at the node N3 is more than the limit voltage Vr.

When the recovery potential Vm is not more than the limit voltage Vr, therefore, the transistor Q5 is turned off, so that charges stored in a recovery capacitor C1 are stored without being discharged into the ground terminal.

When the recovery potential Vm at the node N3 is higher than the limit voltage Vr, the transistor Q5 is turned on, so that the charges stored in the recovery capacitor C1 are discharged into the ground terminal through the node N3, the diode D3, the node N4, the transistor Q5, and the resistor R3. As a result, the recovery potential Vm at the node N3 does not exceed the voltage Vr.

When the voltage drop produced by the diode D3 is considered in the foregoing description, the voltage applied to the power supply terminal V2 is set to a voltage lower by a voltage drop produced by the diode D3 than the limit voltage Vr. The voltage drop produced by the diode D3 is 0.7 V, for example.

The recovery potential clamping circuit 81 thus performs a clamping operation when the recovery potential Vm at the node N3 exceeds the limit voltage Vr. Consequently, the recovery potential Vm does not exceed the limit voltage Vr.

In the recovery potential clamping circuits 81 in the first and second power recovery circuits 8*a* and 8*b* in the plasma display device 100 according to the second embodiment, the limit voltage Vr is directly applied to the power supply terminal V2 so that a voltage applied to the base of the transistor Q5 becomes easy to adjust.

Third Embodiment

A plasma display device 100 according to a third embodiment has the same configuration and operations as those of the plasma display device 100 according to the first embodiment except for the following points.

In the plasma display device 100 according to the third embodiment, recovery potential clamping circuits 82 respectively provided in a first power recovery circuit 8*a* and a second power recovery circuit 8*b* differ from the configuration of the recovery potential clamping circuit 80 shown in FIG. 6.

Figure 22:
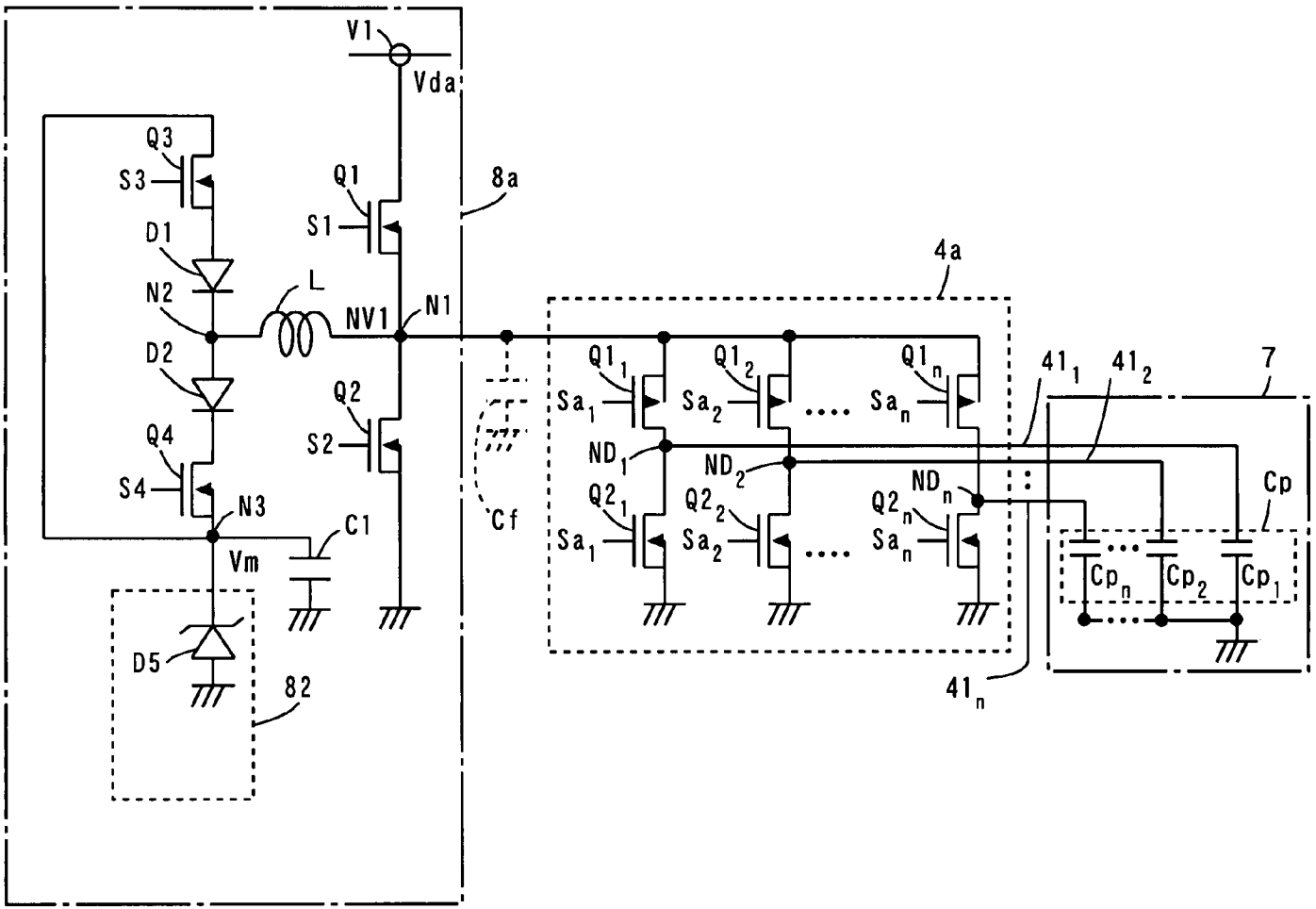
FIG. 22 is a circuit diagram of a first group of data drivers, a first power recovery circuit, and a PDP in a third embodiment.

FIG. 22 is a circuit diagram of a first group of data drivers 4*a*, a first power recovery circuit 8*a*, and a PDP 7 in a third embodiment. In FIG. 22, the recovery potential clamping circuit 82 comprises a zener diode D5.

In the recovery potential clamping circuit 82, the zener diode D5 is connected between a node N3 and a ground terminal. The node N3 is connected to the cathode of the zener diode D5. In the zener diode D5, a voltage exceeding the limit voltage Vr in the first embodiment is applied to the cathode so that a current in the opposite direction flows.

In the time periods TA to TC shown in FIG. 7, the following operations are performed in the recovery potential clamping circuit 82 in the first power recovery circuit 8*a*.

In the recovery potential clamping circuit 82, a recovery potential Vm at the node N3 is fed to the cathode of the zener diode D5. The recovery potential Vm varies on the basis of the operations of the first group of data drivers 4*a*, described later. The zener diode D5 causes a current in the opposite direction to flow by application of a voltage exceeding the limit voltage Vr to the cathode. Consequently, the zener diode D5 does not cause a current to flow in a case where the recovery potential Vm at the node N3 is not more than the limit voltage Vr, while causing a current in the opposite direction to flow in a case where the recovery potential Vm at the node N3 is more than the limit voltage Vr.

When the recovery potential Vm is not more than the limit voltage Vr, therefore, charges stored in a recovery capacitor C1 are stored without being discharged into the ground terminal.

When the recovery potential Vm at the node N3 is higher than the limit voltage Vr, the charges stored in the recovery capacitor C1 are discharged into the ground terminal through the zener diode D5. As a result, the recovery potential Vm at the node N3 does not exceed the limit voltage Vr.

The recovery potential clamping circuit 82 thus performs a clamping operation when the recovery potential Vm at the node N3 exceeds the limit voltage Vr. Consequently, the recovery potential Vm does not exceed the limit voltage Vr.

In the respective recovery potential clamping circuits 82 in the first and second power recovery circuits 8*a* and 8*b* in the plasma display device 100 according to the third embodiment, the recovery potential Vm at the node N3 is controlled by only the zener diode D5. Consequently, the configuration becomes easy.

Fourth Embodiment

A plasma display device 100 according to a fourth embodiment has the same configuration and operations as those of the plasma display device 100 according to the first embodiment except for the following points.

Figure 23:
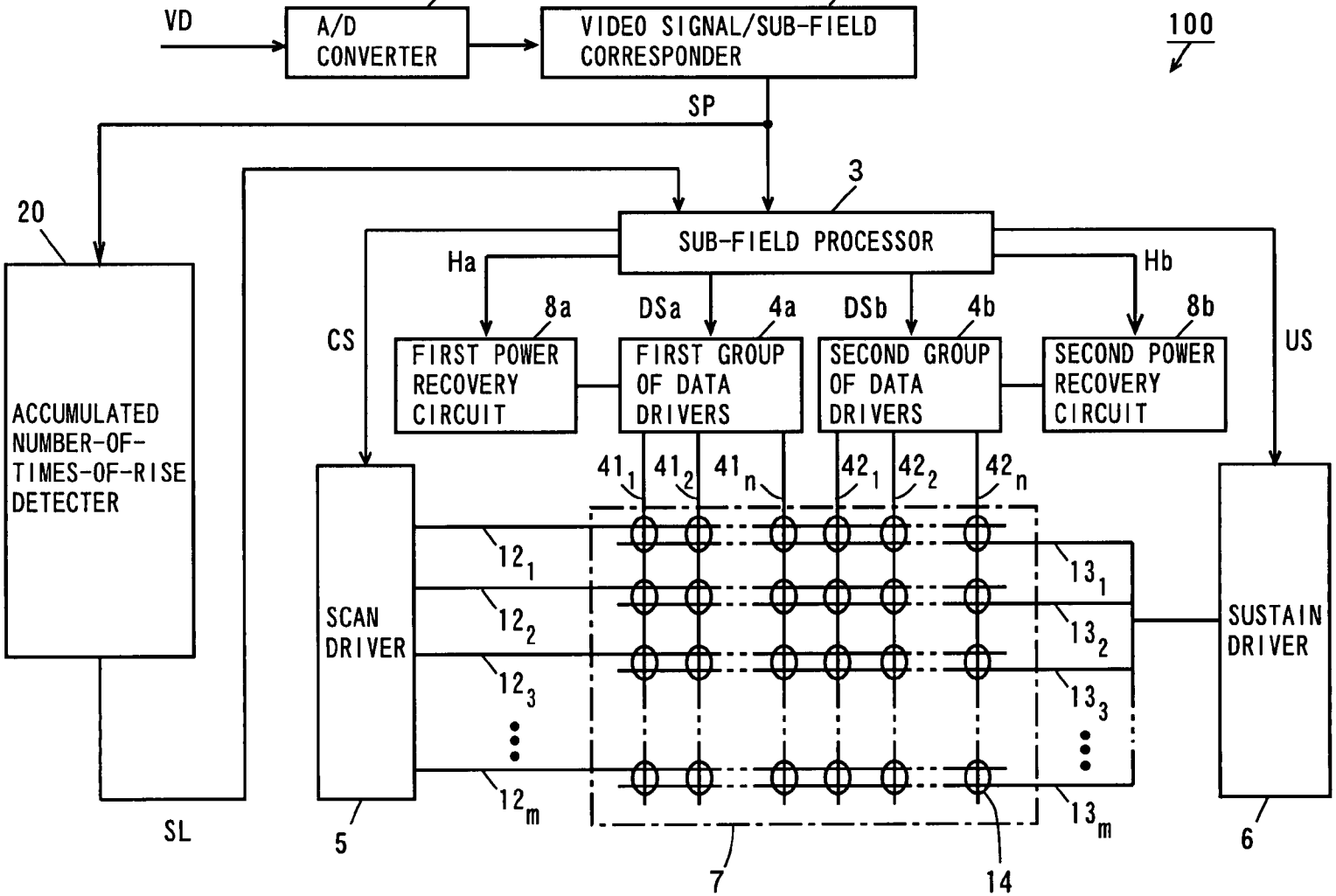
FIG. 23 is a block diagram showing the basic configuration of a plasma display device according to a fourth embodiment.

FIG. 23 is a block diagram showing the basic configuration of the plasma display device 100 according to the fourth embodiment.

In the plasma display device 100 according to the fourth embodiment comprises an accumulated number-of-times-of-rise detector 20 in addition to the configuration of the plasma display device 100 according to the first embodiment.

The accumulated number-of-times-of-rise detector 20 is connected to a video signal/sub-field corresponder 2 and is connected to a sub-field processor 3. The accumulated number-of-times-of-rise detector 20 counts the number of times of rise of a data pulse Pda applied to a plurality of address electrodes $\mathbf{41}_1$ to $\mathbf{41}_n$ and $\mathbf{42}_1$ to $\mathbf{42}_n$ that is, the number of times of rise of control pulses $Sa_1$ to $Sa_n$ on the basis of image data SP fed from the video signal/sub-field corresponder 2, and feeds a count signal SL representing the number of times to the sub-field processor 3.

Figure 24:
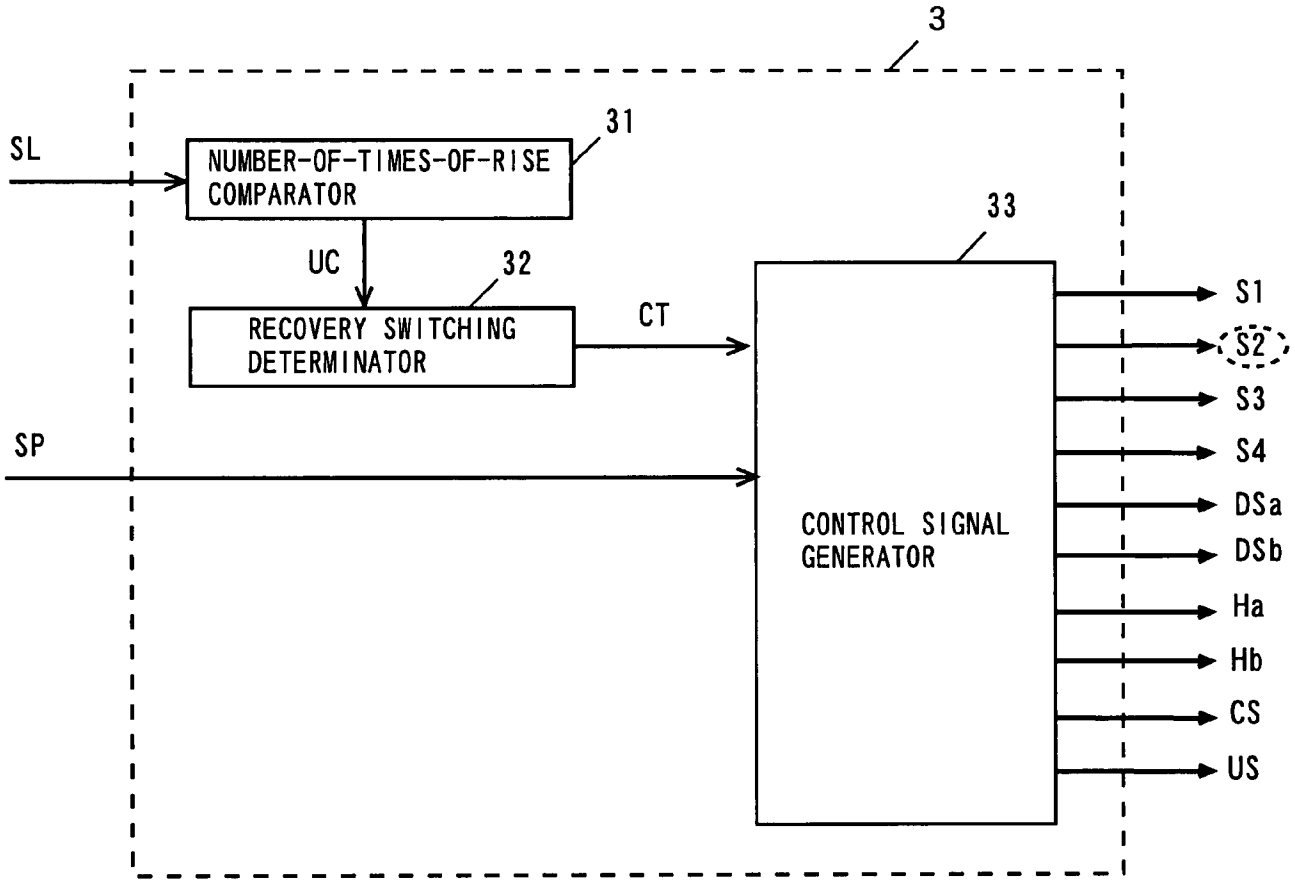
FIG. 24 is a block diagram for explaining the configuration of a sub-field processor according to the fourth embodiment.

FIG. 24 is a block diagram for explaining the configuration of the sub-field processor 3 according to the fourth embodiment.

As shown in FIG. 24, the sub-field processor 3 according to the fourth embodiment comprises a number-of-times-of-rise comparator 31, a recovery switching determinator 32, and a control signal generator 33.

In the sub-field processor 3, the count signal SL from the accumulated number-of-times-of-rise detector 20 is fed to the number-of-times-of-rise comparator 31.

The respective maximum numbers the control pulses $Sa_1$ to $Sa_n$ can be raised for each sub-field are previously stored in the number-of-times-of-rise comparator 31. The number-of-times-of-rise comparator 31 calculates a rise ratio on the basis of the count signal SL.

Furthermore, the number-of-times-of-rise comparator 31 determines whether or not the calculated rise ratio is not less than a power consumption switching ratio β %, and feeds a determination signal UC representing the results of the determination to the recovery switching determinator 32. The power consumption switching ratio β % is also previously stored in the number-of-times-of-rise comparator 31. The setting of the power consumption switching ratio β % will be described later.

The recovery switching determinator 32 generates a switching signal CT for switching a control signal S2 on the basis of the determination signal UC fed from the number-of-times-of-rise comparator 31.

The switching signal CT enters a high level when the calculated rise ratio is not less than the power consumption switching ratio β %, while entering a low level when the calculated rise ratio is less than the power consumption switching ratio β %, for example. The generated switching signal CT is fed to the control signal generator 33.

The control signal generator 33 generates data driver control signals DSa and DSb, power recovery circuit control signals Ha and Hb, a scan driver control signal CS, and a sustain driver control signal US on the basis of the image data SP corresponding to a sub-field fed from the video signal/sub-field corresponder 2, and generates control signals S1 to S4 on the basis of the image data SP and the switching signal CT.

The control signal S2 is generated on the basis of the switching signal CT fed from the recovery switching determinator 32, and is fed to the respective transistors Q2 in the first and second power recovery circuits 8*a* and 8*b* (FIG. 6). The control signal S2 switches On and OFF of the transistor Q2 depending on whether or not the rise ratio calculated by the number-of-times-of-rise comparator 31 is not less than the power consumption switching ratio β %. Thus, a power recovery system of the plasma display device 100 according to the fourth embodiment is switched. The details will be described later.

In the present embodiment, the accumulated number-of-times-of-rise detector 20 may be replaced with an accumulated number-of-times-of-fall detector. In this case, the accumulated number-of-times-of-fall detector counts the number of times of fall of the control pulses $Sa_1$ to $Sa_n$, and feeds a count signal SL representing the number of times to the sub-field processor 3. In the sub-field processor 3, the same processing as described above is performed on the basis of the fed count signal SL.

Figure 25:
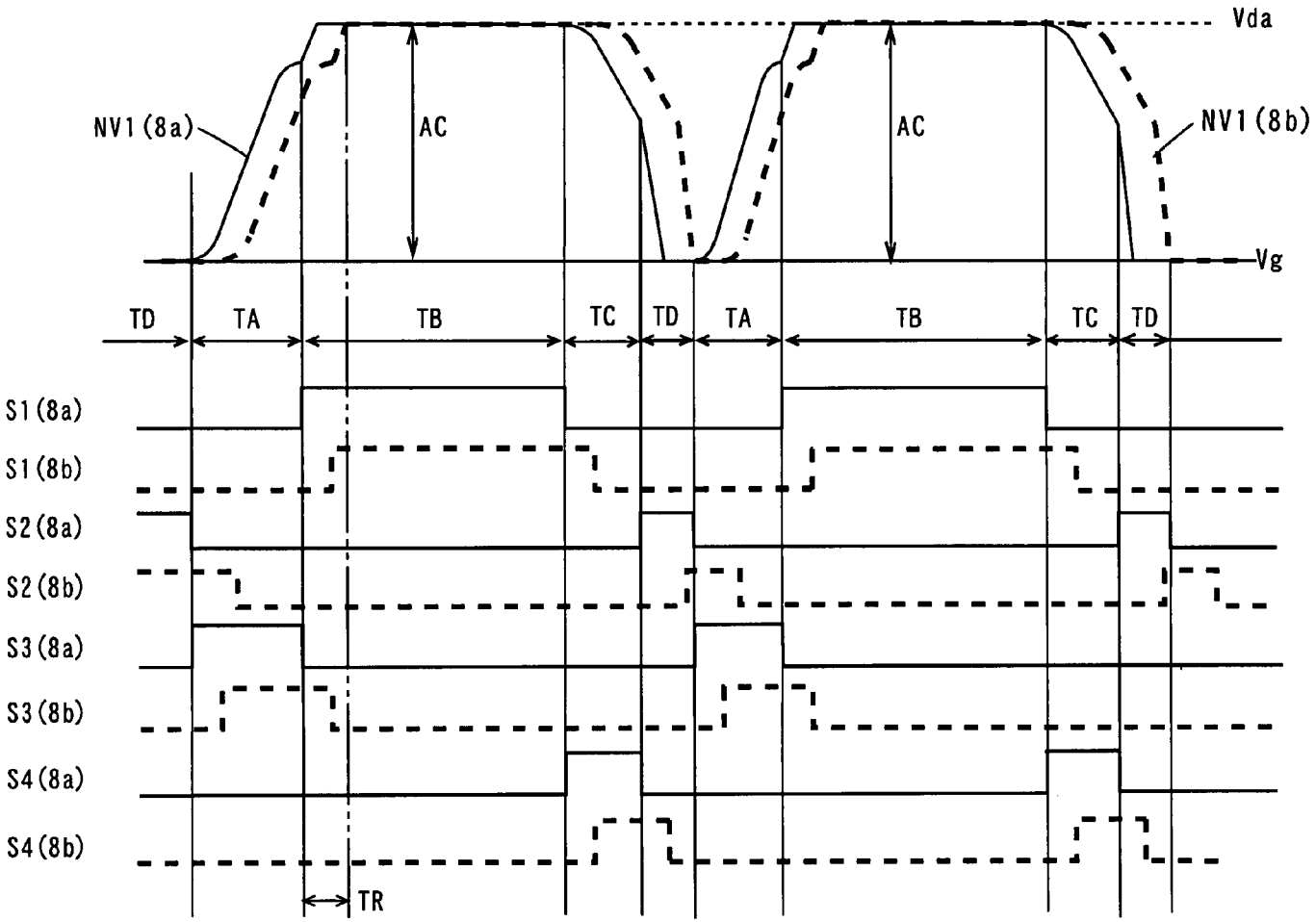
FIG. 25 is a timing chart showing the operations in a write time period of first and second power recovery circuits shown in FIG. 23 in a case where a power recovery system is switched by a control signal.

FIG. 25 is a timing chart showing the respective operations in a write time period of the first and second power recovery circuits 8*a* and 8*b* shown in FIG. 23 in a case where the power recovery system is switched on the basis of the switching signal CT when the calculated rise ratio is not less than the power consumption switching ratio β %. In FIG. 25, the respective waveforms of the voltage NV1 at the node N1 and the control signals S1 to S4 respectively fed to the transistors Q1 to Q4 as shown in FIG. 6 are indicated by solid lines. The respective signal waveforms of the voltage NV1 at the node N1 and the control signals S1 to S4 respectively fed to the transistors Q1 to Q4 in the second group of data drivers 4*b* are indicated by broken lines.

In FIG. 25, reference numeral 8*a* is attached, enclosed by parentheses, after the voltage NV1 and the control signals S1 to S4 in the first power recovery circuit 8*a*, and reference numeral 8*b* is attached, enclosed by parentheses, after the voltage NV1 and the control signals S1 to S4 in the second power recovery circuit 8*b*.

The transistors Q1 to Q4 are turned on when the control signals S1 to S4 are at a high level, while being turned off when the control signal S1 to S4 are at a low level.

The changes in the control signals S1 to S4 and the voltage NV1 at the node N1 in a time period TA and a time period TB are the same as those shown in FIG. 7 according to the first embodiment.

In a time period TC, the control signal S4 is at a high level, and the control signals S1 to S3 are at a low level. Consequently, the transistor Q4 is turned on, and the transistors Q1 to Q3 are turned off. In this case, the recovery capacitor C1 is connected to the recovery coil L through the transistor Q4 and the diode D2, and the voltage NV1 at the node N1 is gently lowered due to LC resonance of the recovery coil L, the stray capacitance Cf, and the panel capacitance Cp. At this time, charges in the stray capacitance Cf and the panel capacitance Cp are recovered in the recovery capacitor C1 through the recovery coil L, the diode D2, and the transistor Q4.

In the present embodiment, switching of the power recovery system occurs by the change in the control signal S2 in a time period TD on the basis of the switching signal CT.

In this case, in a time period TD, the control signals S1, S3, and S4 enter a low level, and the control signal S2 enters a high level. Consequently, the transistors Q1, Q3, and Q4 are turned on, and the transistor Q2 is turned on. Therefore, the node N1 is grounded.

As a result, the voltage NV1 at the node N1 that has been lowered to a predetermined voltage value in the time period TC is rapidly lowered and is fixed to a ground potential Vg.

The first power recovery circuit 8*a* repeats the operations in the time periods TA to TD, so that the charges stored in the panel capacitance Cp and the stray capacitance Cf are recovered in the recovery capacitor C1, and the recovered charges are fed to the panel capacitance Cp and the stray capacitance Cf again.

In this case, the voltage NV1 at the node N1 is fixed to a power supply voltage Vda in the time period TB, and the voltage NV1 at the node N1 is fixed to the ground voltage Vg in the time period TD, so that the recovery potential Vm at the node N3 becomes a value that is one-second the power supply voltage Vda (a change AC shown in FIG. 25).

In the plasma display device 100 according to the present embodiment, the power recovery system is thus switched on the basis of the rise ratio and the fall ratio. This is performed in order to further reduce power consumption in an address time period in the plasma display device 100. The reduction in the power consumption by switching the power recovery system will be described later.

Figure 26:
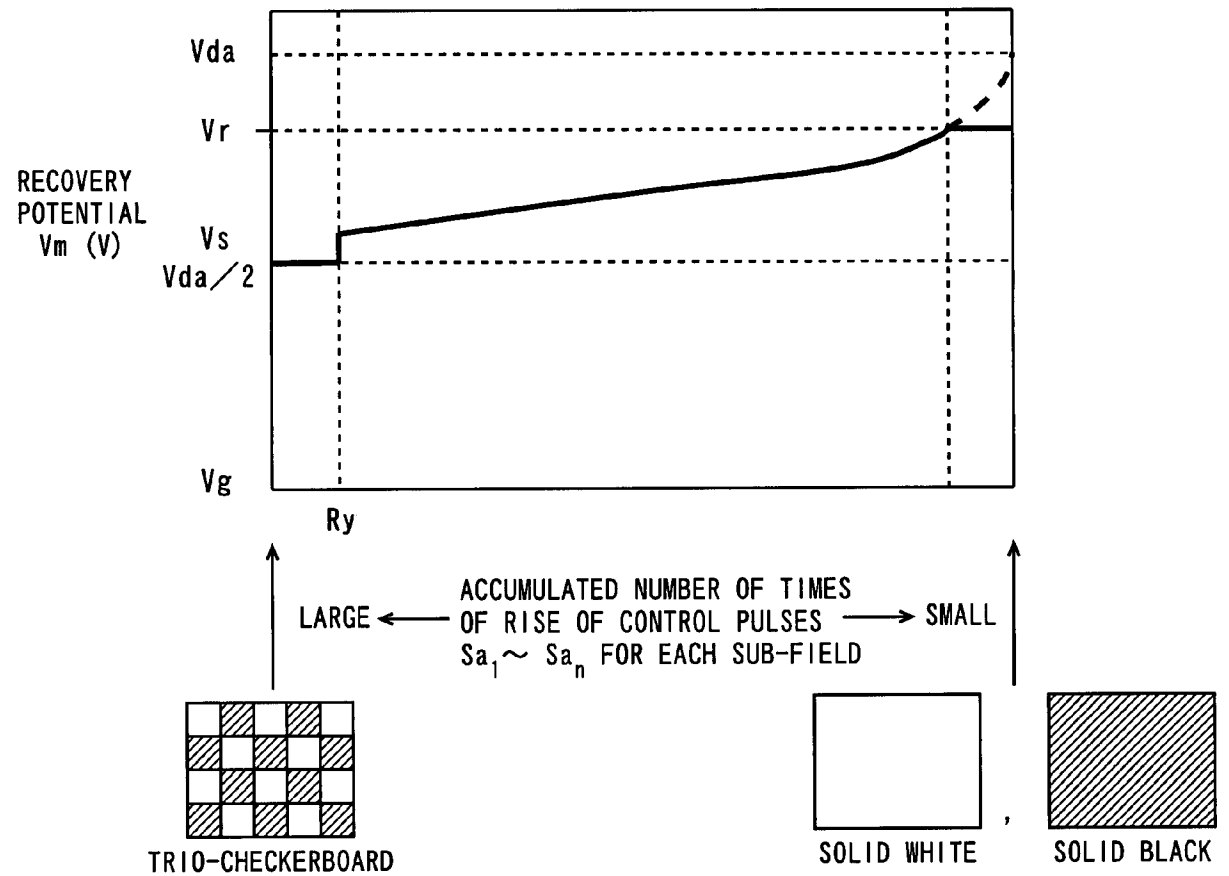
FIG. 26 is a graph showing the relationship between a recovery potential of a plasma display device according to the fourth embodiment and the accumulated number of times of rise of control pulses for each sub-field.

FIG. 26 is a graph showing the relationship between the recovery potential Vm of the plasma display device 100 according to the fourth embodiment and the accumulated number of times of rise of the control pulses $Sa_1$ to $Sa_n$ for each sub-field. In FIG. 26, the vertical axis indicates the recovery potential Vm for each sub-field, and the horizontal axis indicates the accumulated number of times of rise of the control pulses $Sa_1$ to $Sa_n$ for each sub-field.

In FIG. 26, the relationship between the recovery potential Vm and the accumulated number of times of rise of the control pulses $Sa_1$ to $Sa_n$ for each sub-field is the same as that shown in FIG. 15 described in the first embodiment except for the following.

As described in the foregoing, in the plasma display device 100 according to the present embodiment, when the rise ratio is not less than the power consumption switching ratio β %, the control signal S2 enters a high level in the time period shown in FIG. 25. That is, the power recovery system is switched.

The accumulated number of times of rise or the accumulated number of times of fall of the control pulses $Sa_1$ to $Sa_n$ for each sub-field in a case where the rise ratio or the fall ratio becomes the power consumption switching ratio β % is herein referred to as a recovery system switching number Ry.

In the present embodiment, the power recovery system is switched by setting the accumulated number of times of rise or the accumulated number of times of fall of the control pulses $Sa_1$ to $Sa_n$ for each sub-field to the recovery system switching number Ry. As a result, the recovery potential Vm becomes a value that is one-second the power supply voltage Vda in a case where the accumulated number of times of rise or the accumulated number of times of fall is not less than the recovery system switching number Ry.

Description is made of a data circuit loss in an address time period in the plasma display device 100 according to the present embodiment.

Figure 27:
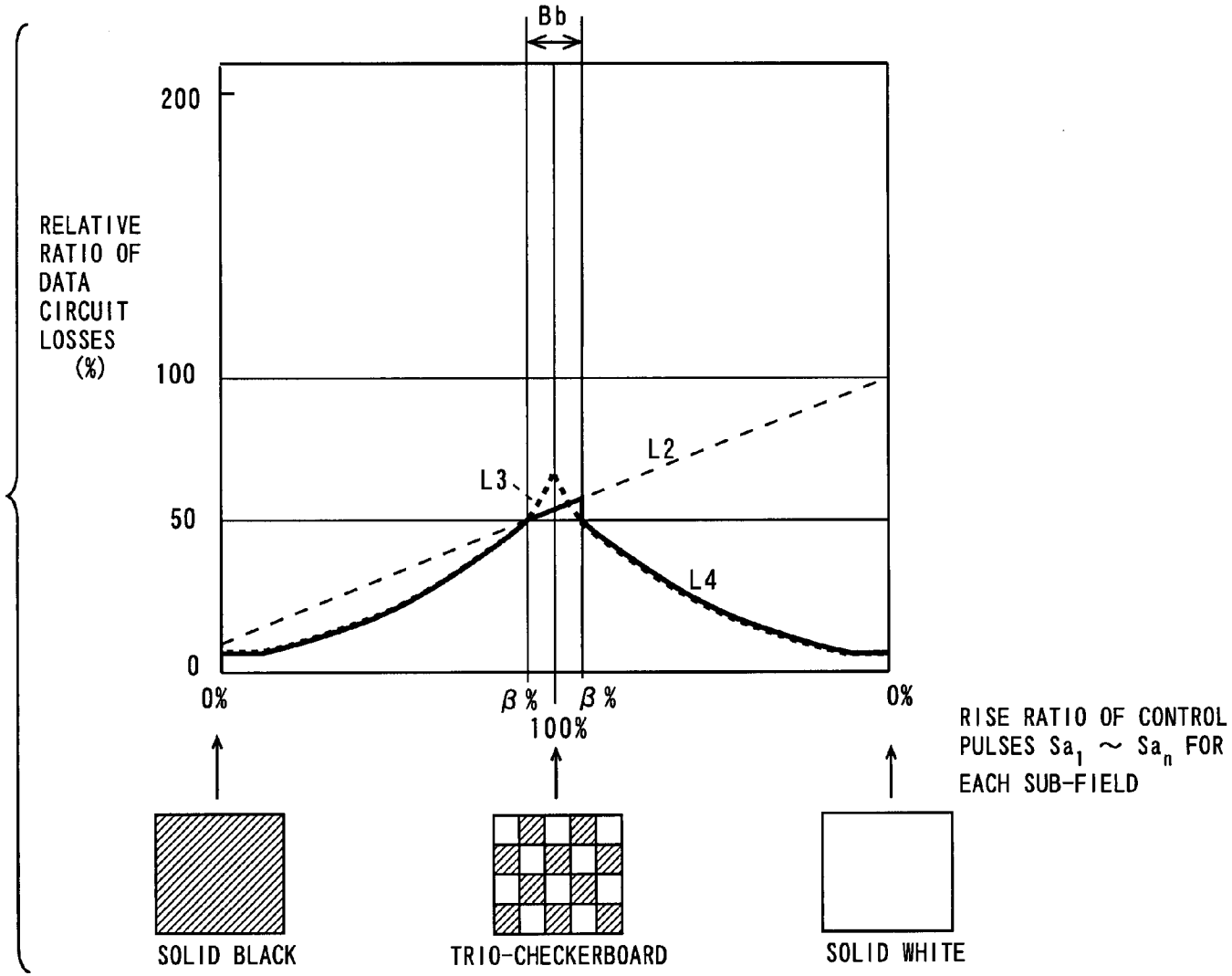
FIG. 27 is a graph for comparing power consumption in a plasma display device according to the fourth embodiment with power consumption in a plasma display device having another configuration.

FIG. 27 is a graph for comparing power consumption in the plasma display device 100 according to the fourth embodiment with power consumption in a plasma display device having another configuration.

In this example, as an object to be compared with the plasma display device 100 according to the present embodiment, the plasma display device according to the first embodiment and the conventional recovery type plasma display device are used.

In FIG. 27, the vertical axis indicates a relative radio of data circuit losses in the plasma display device 100 according to the fourth embodiment, the plasma display device according to the first embodiment, and the conventional recovery type plasma display device, as in FIG. 20. The horizontal axis indicates the rise ratio of the control pulses $Sa_1$ to $Sa_n$ for each sub-field.

In FIG. 27, respective changes in the relative ratio of the data circuit losses in the plasma display device according to the first embodiment and the conventional recovery type plasma display device with changes in the rise ratio and the fall ratio of the control pulses $Sa_1$ to $Sa_n$ for each sub-field are the same as those shown in FIG. 20 in the first embodiment. The relative ratio of data circuit losses in the conventional recovery type plasma display device is indicated by a broken line L2, and the relative ratio of data circuit losses in the plasma display device according to the first embodiment is indicated by a dotted line L3.

The relative ratio of data circuit losses in the plasma display device 100 according to the present embodiment is indicated by a thick line L4.

In a range indicated by an arrow Bb shown in FIG. 27, the relative ratio of data circuit losses indicated by the one-dot and dash line L3 in the plasma display device according to the first embodiment is higher than the relative ratio of data circuit losses indicated by the broken line L2 in the conventional recovery type plasma display device. A rise ratio at which the respective relative ratios of data circuit losses indicated by the one-dot and dash line L3 and the broken line L2 are switched is defined as a power consumption switching ratio β %. The power consumption switching ratio β % is previously stored in the above-mentioned number-of-times-of-rise comparator 31.

As shown in FIG. 27, the relative ratio of data circuit losses in the plasma display device 100 is the same as that in the plasma display device according to the first embodiment except for the range indicated by the arrow Bb.

In the range indicated by the arrow Bb shown in FIG. 27, the broken line L2 and the thick line L4 are overlapped with each other. That is, in a range in which the rise ratio for each sub-field is not less than the power consumption switching ratio β %, or a range in which the fall ratio for each sub-field is not less than the power consumption switching ratio β %, the power recovery system of the plasma display device 100 according to the present embodiment is switched to the same power recovery system as that of the conventional recovery type plasma display device.

As a result, the relative ratio of data circuit losses in the plasma display device 100 is prevented from being higher than the relative ratio of data circuit losses in the conventional recovery type plasma display device in the range indicated by the arrow Bb. Further, the maximum data circuit loss in the plasma display device 100 according to the present embodiment is made lower than that in the plasma display device according to the first embodiment.

The power recovery system of the plasma display device 100 according to the fourth embodiment is thus switched to the same power recovery system as that of the conventional recovery type plasma display device in a range in which the rise ratio for each sub-field is not less than the power consumption switching ratio β % (the accumulated number of times of rise is not less than the recovery system switching number Ry) or a range in which the fall ratio for each sub-field is not less than the power consumption switching ratio β % (the accumulated number of times of fall is not less than the recovery system switching number Ry). Consequently, power consumption is sufficiently reduced by the most suitable power recovery system in all ranges of the rise ratio and the fall ratio.

Here, the above-mentioned power consumption switching ratio β % is 95%, for example. In this case, the power recovery system of the plasma display device 100 according to the fourth embodiment is switched to the same power recovery system as that of the conventional recovery type plasma display device in a range in which the rise ratio for each sub-field is not less than 95% or a range in which the fall ratio for each sub-field is not less than 95%.

Changes in the large-small relationship of power consumption in the non-recovery type plasma display device, the conventional recovery type plasma display device, and the plasma display device according to the first embodiment will be described on the basis of FIG. 28.

Figure 28:
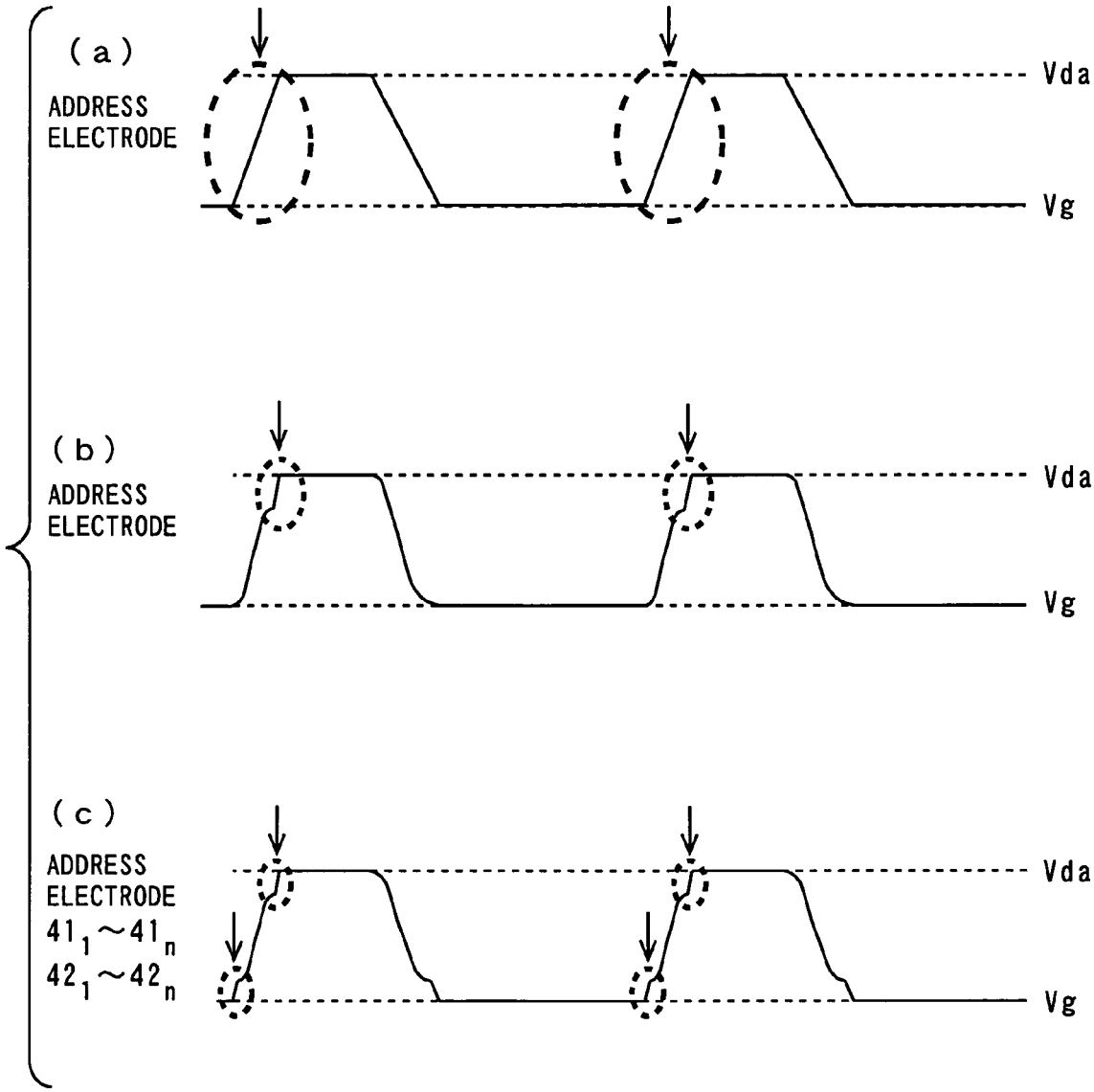
FIG. 28 is a diagram for comparing power consumption in each of a non-recovery type plasma display device, a conventional recovery type plasma display device, and a plasma display device according to a first embodiment in a case where a rise ratio for each sub-field is 100% (a case of a trio-checkerboard).
Figure 29:
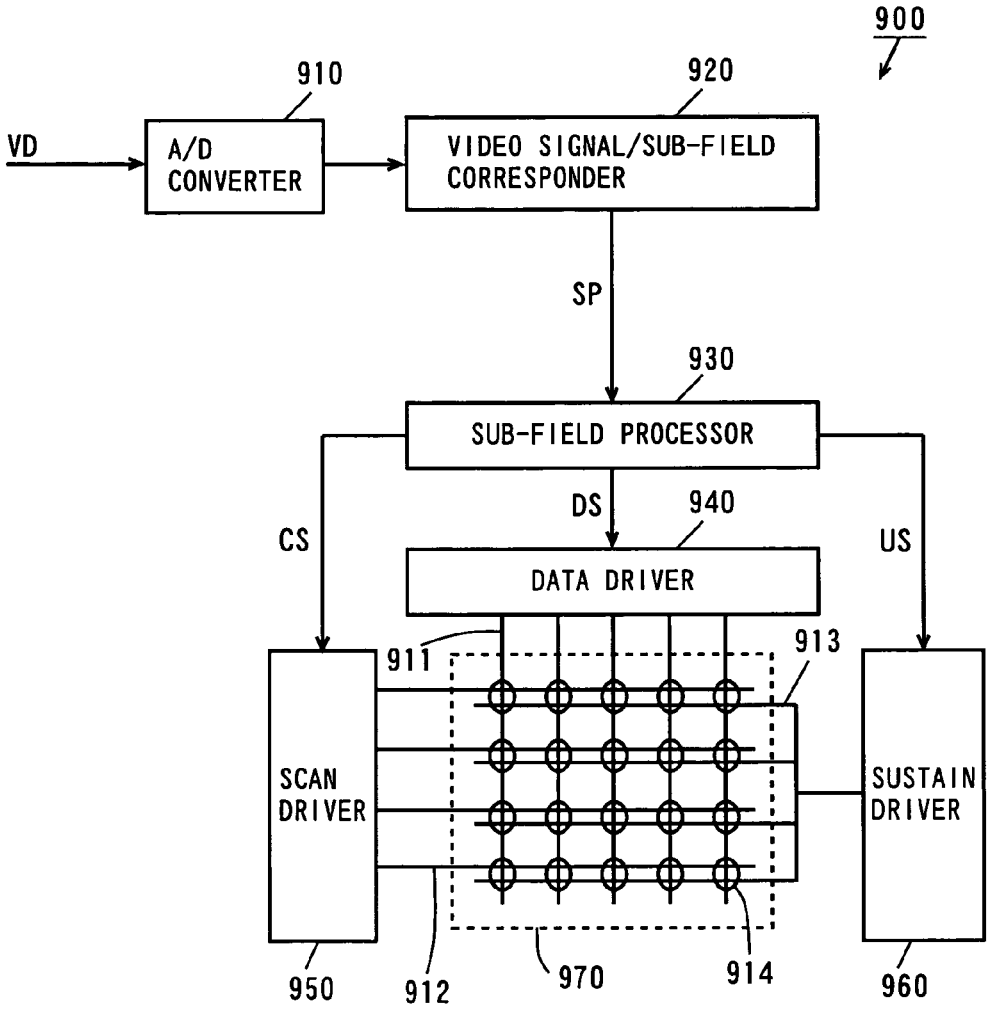
FIG. 29 PRIOR ART
FIG. 29 is a block diagram showing the basic configuration of a conventional AC-type plasma display device.
Figure 30:
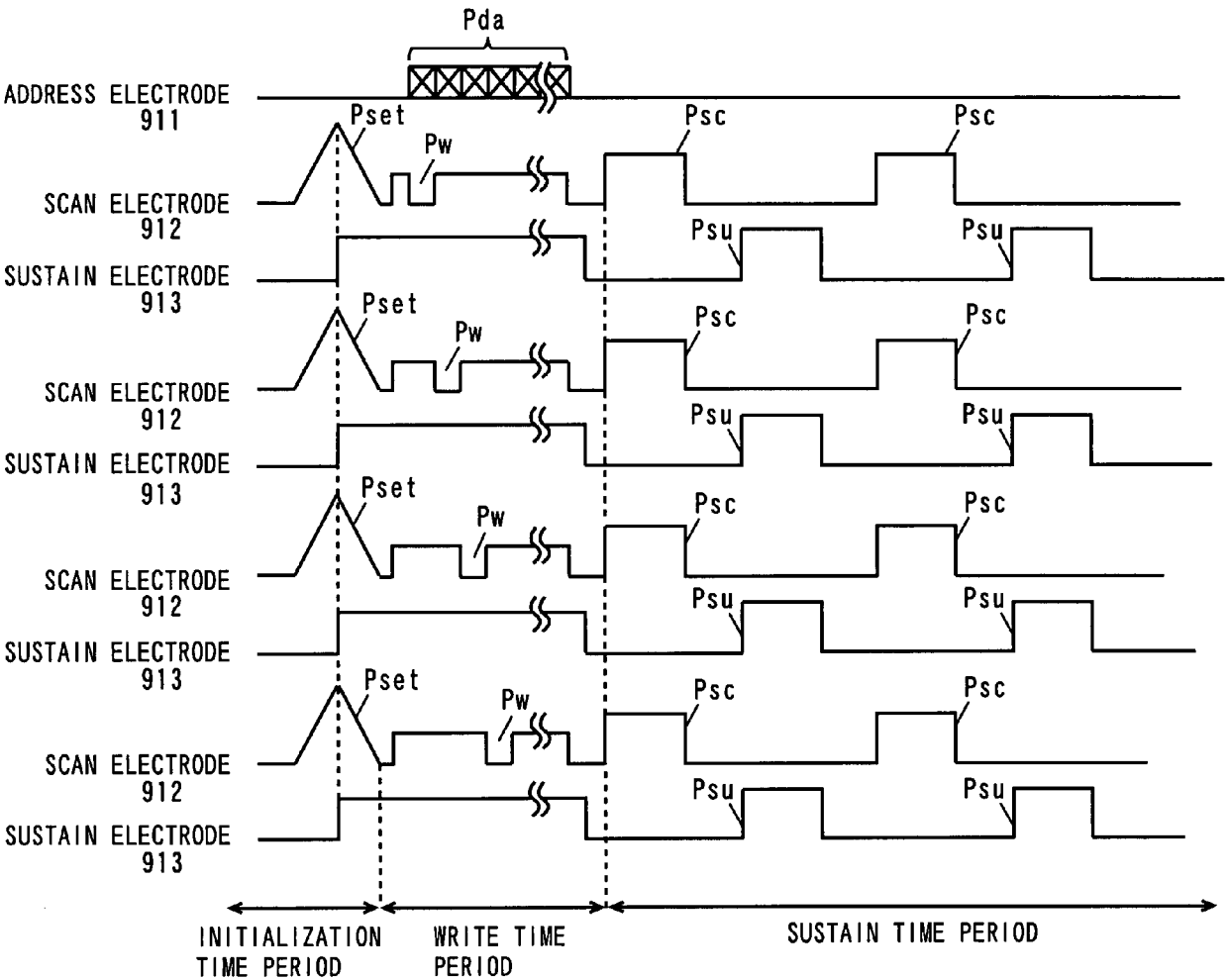
FIG. 30 PRIOR ART
FIG. 30 is a timing chart showing an example of driving voltages of address electrodes, scan electrodes, and sustain electrodes in a PDP shown in FIG. 29.
Figure 31:
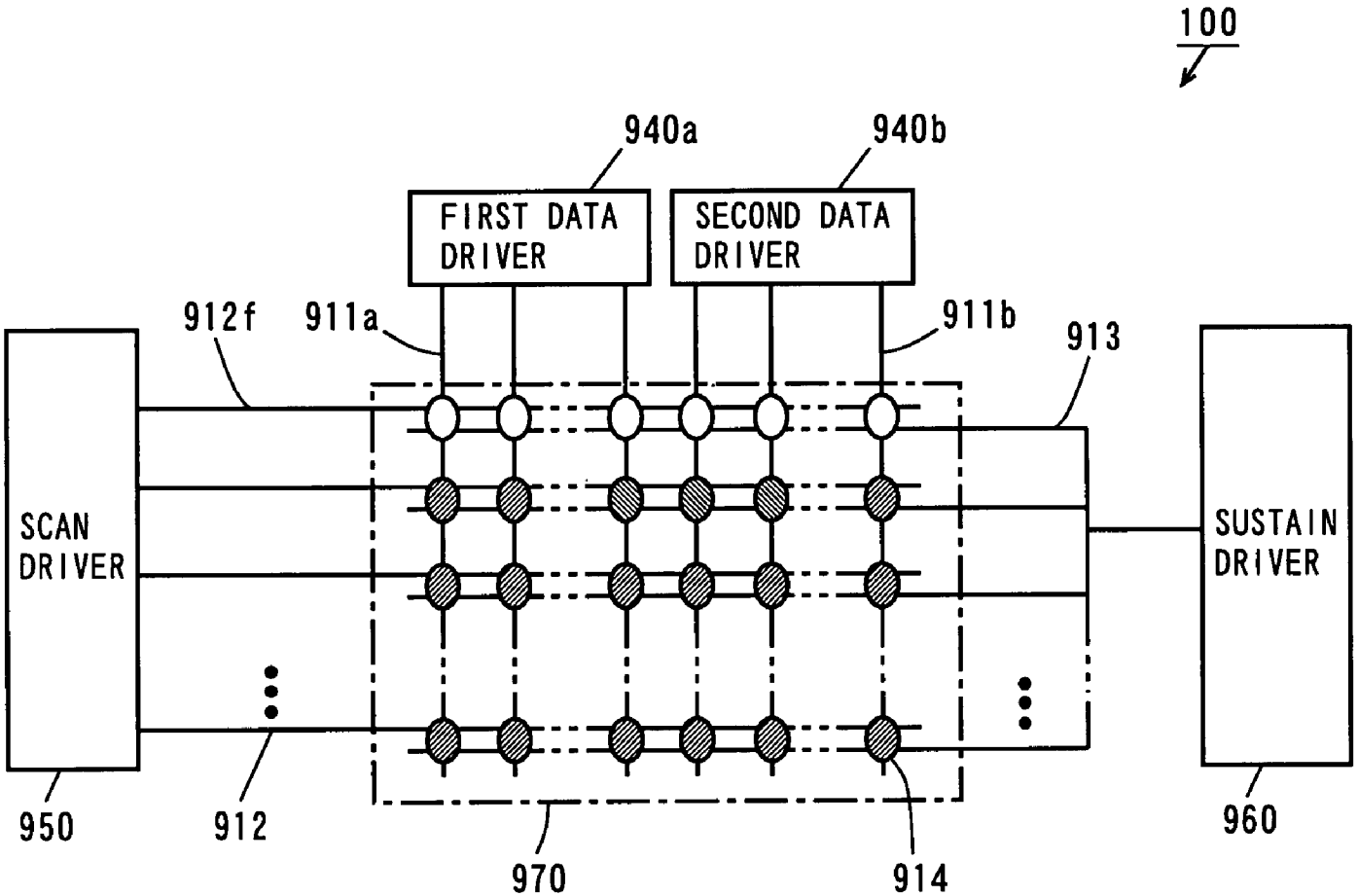
FIG. 31 PRIOR ART
FIG. 31 is a schematic view showing an example of the display state of a PDP in a plasma display device composed of a plurality of data drivers obtained by division.
Figure 32:
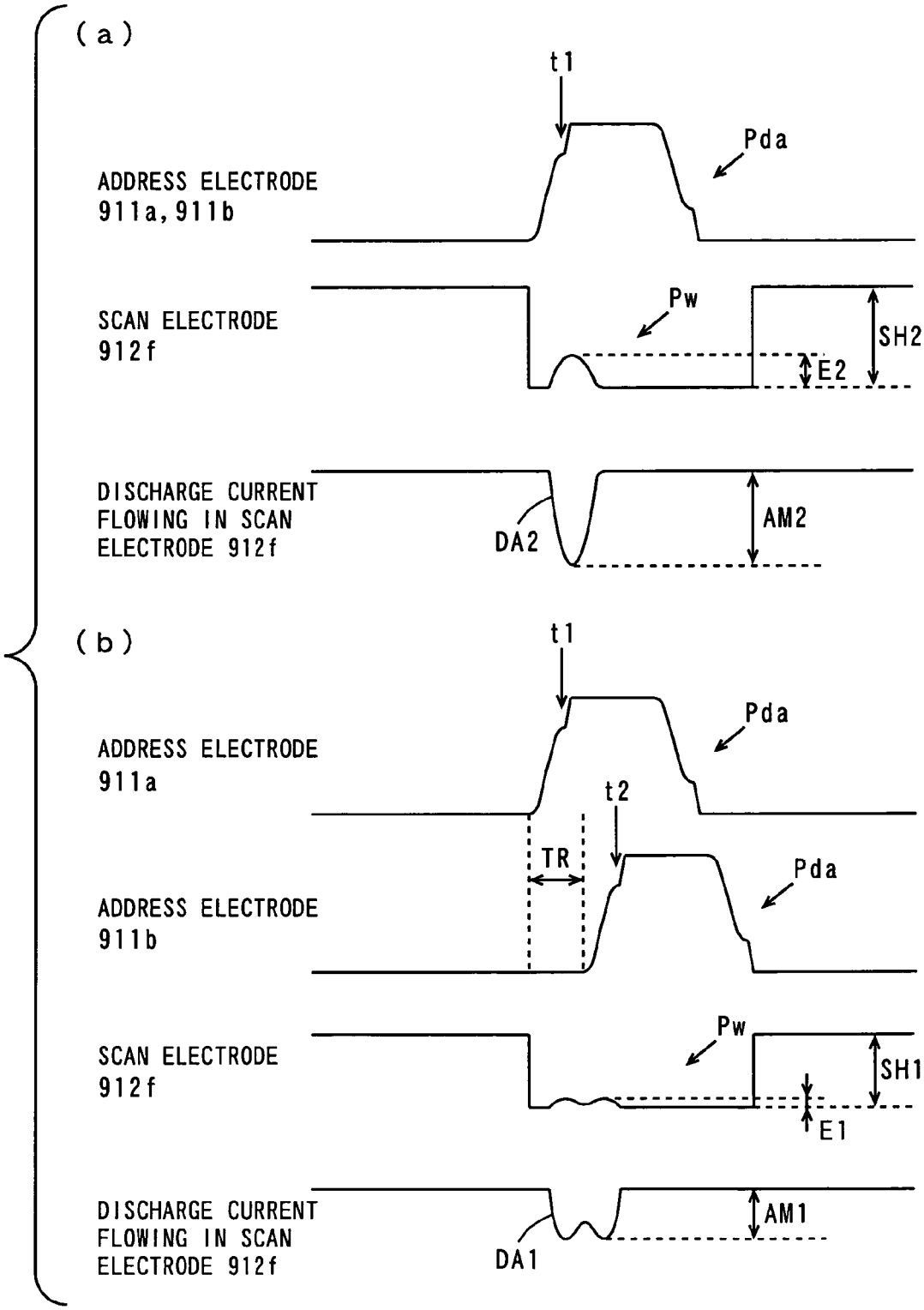
FIG. 32 PRIOR ART
FIG. 32 is a diagram for explaining dependency of an address discharge current on a data pulse phase difference.

FIG. 28 is a diagram for comparing the power consumptions in the non-recovery type plasma display device, the conventional recovery type plasma display device, and the plasma display device 100 according to the first embodiment in a case where the rise ratio for each sub-field is 100% (a case of a trio-checkerboard).

FIG. 28(*a*) shows a data pulse Pda applied to the address electrodes $\mathbf{41}_1$ to $\mathbf{41}_n$ and $\mathbf{42}_1$ to $\mathbf{42}_n$ in the non-recovery type plasma display device, FIG. 28(*b*) shows a data pulse Pda applied to the address electrodes $\mathbf{41}_1$ to $\mathbf{41}_n$ and $\mathbf{42}_1$ to $\mathbf{42}_n$ in the conventional recovery type plasma display device, and 28(*c*) shows a data pulse Pda applied to the address electrodes $\mathbf{41}_1$ to $\mathbf{41}_n$ and $\mathbf{42}_1$ to $\mathbf{42}_n$ in the plasma display device 100 according to the first embodiment.

As shown in FIG. 28(*a*), in the case where the rise ratio is 100% (in the case of a trio-checkerboard), the data pulse Pda applied to the address electrodes $\mathbf{41}_1$ to $\mathbf{41}_n$ and $\mathbf{42}_1$ to $\mathbf{42}_n$ in the non-recovery type plasma display device repeats the rise and the fall in correspondence with each of pixels composing the PDP 7. In this case, the power consumption in the non-recovery type plasma display device corresponds to a linear voltage change in a range of a broken line indicated by an arrow.

As shown in FIG. 28(*b*), in the case where the rise ratio is 100% (in the case of a trio-checkerboard), the data pulse Pda applied to the address electrodes $\mathbf{41}_1$ to $\mathbf{41}_n$ and $\mathbf{42}_1$ to $\mathbf{42}_n$ in the conventional recovery type plasma display device repeats the rise and the fall in correspondence with each of pixels composing the PDP 7, as in the non-recovery type plasma display device. In this case, the power consumption in the conventional recovery type plasma display device corresponds to a linear voltage change in a range of a broken line indicated by an arrow.

As shown in FIG. 28(*c*), in the case where the rise ratio is 100% (in the case of a trio-checkerboard), the data pulse Pda applied to the address electrodes $\mathbf{41}_1$ to $\mathbf{41}_n$ and $\mathbf{42}_1$ to $\mathbf{42}_n$ in the plasma display device according to the first embodiment repeats the rise and the fall in correspondence with each of pixels composing the PDP 7. In this case, the power consumption in the plasma display device 100 according to the first embodiment corresponds to a linear voltage change in a range of a broken line indicated by an arrow.

FIGS. 28(*a*), 28(*b*) and 28(*c*), described above, are compared with one another. The magnitude of the linear voltage change shown in FIG. 28(*a*) is much larger than the respective magnitudes of the linear voltage changes shown in FIGS. 28(*b*) and 28(*c*). In the case where the rise ratio is 100% (in the case of a trio-checkerboard), the power consumption in the non-recovery type plasma display device reaches its maximum.

As shown in FIG. 28(*c*), in the plasma display device 100 according to the first embodiment, the voltage of each of the data pulses Pda is linearly changed at the time of starting the rise and at the time of terminating the rise. Consequently, the power consumption is produced at the time of starting the rise and at the time of terminating the rise of the data pulse Pda.

On the other hand, as shown in FIG. 28(*b*), the voltage of each of the data pulses Pda is linearly changed at the time of terminating the rise in the conventional recovery type plasma display device. Consequently, the power consumption is produced at the time of starting the rise of the data pulse Pda.

In the case where the rise ratio is 100% (in the case of a trio-checkerboard), therefore, the power consumption produced in the plasma display device 100 according to the first embodiment is higher than the power consumption produced in the conventional recovery type plasma display device (in the range indicated by the arrow Bb in FIG. 20).

On the other hand, in the plasma display device 100 according to the fourth embodiment, the power recovery system is switched, as in the conventional recovery type plasma display device, in the case where the rise ratio is 100% (in the case of a trio-checkerboard). Consequently, the power consumption in the plasma display device 100 according to the fourth embodiment is prevented from being higher than the power consumption in the plasma display device having another configuration even in the case where the rise ratio is 100% (in the case of a trio-checkerboard).

In the plasma display device 100 according to the fourth embodiment, the power recovery system thereof is switched to the power recovery system of the conventional recovery type plasma display device in a case where the rise ratio or the fall ratio exceeds the power consumption switching ratio β %. As a result, in the plasma display device 100 according to the fourth embodiment, the power consumption can be sufficiently reduced even when the rise ratio or the fall ratio exceeds the power consumption switching ratio β %

That is, in the plasma display device 100 according to the fourth embodiment, the power consumption can be sufficiently reduced irrespective of the light emitted state.

The power recovery circuit 8*a* and the second power recovery circuit 8*b* in the plasma display device 100 according to the fourth embodiment are not limited to the configuration shown in FIG. 6. For example, it may have the configuration shown in FIG. 21 or 22.

Furthermore, in the number-of-times-of-rise comparator 31 shown in FIG. 24 in the plasma display device 100 according to the fourth embodiment, the rise ratio is calculated on the basis of the count signal SL from the accumulated number-of-times-of-rise detector 20, it is determined whether or not the calculated rise ratio is not less than the power consumption switching ratio β %, and the determination signal UC representing the results of the determination is fed to the recovery switching determinator 32 shown in FIG. 24. However, the recovery system switching number Ry may be previously stored, it may be determined whether or not the count signal SL from the accumulated number-of-times-of-rise detector 20 is not less than the recovery system switching number Ry, and the determination signal UC representing the results of the determination may be fed to the recovery switching determinator 32.

In the foregoing first to fourth embodiments, the plasma display device 100 correspond to a display device, the plurality of address electrodes $\mathbf{41}_1$ to $\mathbf{41}_n$ and $\mathbf{42}_1$ to $\mathbf{42}_n$ correspond to a first electrode, the plurality of scan electrodes $\mathbf{12}_1$ to $\mathbf{12}_m$ correspond to a second electrode, the discharge cell 14 corresponds to a capacitive light emitting element, the PDP 7 corresponds to a display panel, a circuit constituted by the sub-field processor 3, the first group of data drivers 4*a*, and the first power recovery circuit 8*a* and a circuit constituted by the second group of data drivers 4*b* and the second power recovery circuit 8*b* correspond to a drive circuit.

Furthermore, the voltage NV1 at the node N1 shown in FIG. 6 corresponds to a driving pulse, the write time period P2 shown in FIGS. 2 and 3 corresponds to an address time period, the data pulse phase difference TR corresponds to a phase difference, and the data pulse Pda corresponds to a data pulse.

Furthermore, the power supply voltage Vda corresponds to a first power supply voltage, the power supply terminal V1 corresponds to a first power supply terminal, the node n1 shown in FIG. 6 corresponds to a first node, the N-channel field effect transistor Q1 corresponds to a first switching element, and the N-channel field effect transistor Q2 corresponds to a second switching element.

The node N2 corresponds to a second node, the recovery coil L corresponds to an inductive element, the node N3 corresponds to a third node, the N-channel field effect transistor Q3 corresponds to a third switching element, the N-channel field effect transistor Q4 corresponds to a fourth switching element, and the recovery capacitor C1 corresponds to a recovering capacitive element.

Furthermore, the limit voltage Vr corresponds to a predetermined value, the recovery potential clamping circuits 80, 81, and 82 correspond to a potential limit circuit, the P-channel field effect transistors $\mathrm{Q}\mathbf{1}_1$ to $\mathrm{Q}\mathbf{1}_n$ and the N-channel field effect transistors $\mathrm{Q}\mathbf{2}_1$ to $\mathrm{Q}\mathbf{2}_n$ correspond to a first switching circuit, the voltage NV5 at the node N5 shown in FIG. 6 and the voltage applied to the power supply terminal V2 shown in FIG. 21 correspond to a control signal, the voltage applied to the power supply terminal V2 corresponds to a second power supply terminal, and the power supply terminal V2 corresponds to a second power supply terminal.

The diodes D3 and D4, the bipolar transistor Q5, and the resistor R3 correspond to a second switching circuit, the node N4 corresponds to a fourth node, the bipolar transistor Q5 corresponds to a fifth switching element, the diode D3 and the zener diode D5 correspond to a unidirectional conductive element, and the charge pump circuits CG1 and CG2 correspond to a charge pump circuit.

Furthermore, the nodes Na and Nc correspond to a fifth node, the capacitors CCp1 and CCp2 correspond to a charging capacitive element, the power supply terminals Vp2 and Vp4 correspond to a third power supply terminal, the voltage (15V) applied to the power supply terminals Vp2 and Vp4 corresponds to a third power supply voltage, the diodes Dp1 and Dp2 correspond to a unidirectional conductive element, and the FET drivers FD1 and FD2 correspond to a control signal output circuit.

Moreover, the first power recovery circuit 8*a* and the second power recovery circuit 8*b* correspond to an application circuit, the resistors R1 and R2 and the node N5 correspond to a division circuit, the accumulated number-of-times-of-rise detector 20 corresponds to a number-of-times detector, and the sub-field processor 3, the number-of-times-of-rise comparator 31, the recovery switching determinator 32, and the control signal generator 33 correspond to a controller. Further, the rise ratio and the fall ratio correspond to the ratio of the number of times calculated by the number-of-times detector to the maximum number of times the data pulse can rise or the maximum number of times the data pulse can fall, and the power consumption switching ratio β % corresponds to a predetermined ratio value. Further, the image data SP corresponds to image data, and the video signal/sub-field corresponder 2 corresponds to a converter.

The invention claimed is:

1. A display device, comprising:

first electrodes classified into a plurality of groups;

second electrodes respectively provided so as to cross said first electrodes;

a display panel having a plurality of capacitive light emitting elements respectively provided at intersections of said first electrodes and said second electrodes;

a drive circuit that applies a data pulse for light-emitting a selected capacitive light emitting element to the first electrodes in said plurality of groups such that phase differences respectively occur between said plurality of groups;

a number-of-times detector; and a converter, said drive circuit comprising:

a first power supply terminal that receives a first power supply voltage;

an inductive element;

a recovering capacitive element;

an application circuit that discharges charges from said recovering capacitive element by a resonance operation of a capacitance of said display panel and said inductive element to raise a potential at a first node, connects said first node and said first power supply terminal to each other, then disconnects said first node and said first power supply terminal from each other, and recovers charges in said recovering capacitive element from said first node through said inductive element by said resonance operation to lower the potential at said first node, to apply to said first node a driving pulse for applying a data pulse to the first electrodes in said plurality of groups;

a potential limiting circuit that limits a quantity of charges recovered in said recovering capacitive element, to limit a potential of said recovering capacitive element so as not to exceed a predetermined value lower than said first power supply voltage; and a controller, said converter converting, in order to divide one field into a plurality of sub-fields and discharge said capacitive light emitting element selected for each of the sub-fields to perform gray scale expression, image data corresponding to the one field into image data corresponding to the sub-field, said number-of-times detector detecting one of a number of times of rise and a number of times of fall of the data pulse applied to said first electrodes for each of the sub-fields on the basis of the image data fed from said converter, and said controller calculating a ratio of said number of times obtained by said number-of-times detector to one of a maximum number of times the data pulse can rise and a maximum number of times the data pulse can fall in each of the sub-fields, lowering, when said ratio is more than a predetermined ratio value, the potential at said first node to a predetermined voltage value, and then controlling an operation of said application circuit such that said first node is grounded.

2. The display device according to claim 1, wherein said predetermined ratio value is not less than 95%.

3. A method of driving a display device comprising first electrodes classified into a plurality of groups, second electrodes respectively provided so as to cross the first electrodes, and a display panel comprising a plurality of capacitive light emitting elements respectively provided at intersections of the first electrodes and the second electrodes, comprising:

respectively applying a data pulse for light-emitting a selected capacitive light emitting element to the first electrodes in the plurality of groups such that phase differences respectively occur between the plurality of groups, applying the data pulse comprising:

discharging charges from a recovering capacitive element by a resonance operation of a capacitance of the display panel and an inductive element to raise a potential at a first node, connecting the first node and a first power supply terminal to each other, then disconnecting the first node and the first power supply terminal from each other, and recovering the charges in the recovering capacitive element from the first node through the inductive element by the resonance operation to lower the potential at the first node, to apply to the first node a driving pulse for applying a data pulse to the first electrodes in the plurality of groups; and limiting the quantity of charges recovered in the recovering capacitive element, to limit a potential of the recovering capacitive element so as not to exceed a predetermined value lower than a first power supply voltage, said method further comprising:

converting, in order to divide one field into a plurality of sub-fields and discharge the capacitive light emitting element selected for each of the sub-fields to perform gray scale expression, image data corresponding to the one field into image data corresponding to the sub-field;

detecting one of a number of times of rise and a number of times of fall of the data pulse applied to the first electrodes for each of the sub-fields on the basis of the converted image data; and calculating a ratio of the number of times detected to one of a maximum number of times the data pulse can rise and the maximum number of times the data pulse can fall in each of the sub-fields, lowering, when the ratio is more than a predetermined ratio value, the potential at the first node to a predetermined voltage value, and then grounding the first node.

* * * * *